US007894750B2

(12) United States Patent
Inaba et al.

(10) Patent No.: US 7,894,750 B2
(45) Date of Patent: Feb. 22, 2011

(54) COMPACT AND HIGH SPEED IMAGE FORMING APPARATUS AND IMAGE FORMING METHOD USING THE SAME

(75) Inventors: Yoshinori Inaba, Numazu (JP); Tatsuya Niimi, Numazu (JP)

(73) Assignee: Ricoh Company Limited, Tokyo (JP)

( * ) Notice: Subject to any disclaimer, the term of this patent is extended or adjusted under 35 U.S.C. 154(b) by 951 days.

(21) Appl. No.: 11/749,292

(22) Filed: May 16, 2007

(65) Prior Publication Data

US 2007/0268354 A1 Nov. 22, 2007

(30) Foreign Application Priority Data

May 17, 2006 (JP) ..... 2006-137183

(51) Int. Cl.
*G03G 15/00* (2006.01)

(52) U.S. Cl. ..... 399/159

(58) Field of Classification Search ..... 399/159, 399/51, 53

See application file for complete search history.

(56) References Cited

U.S. PATENT DOCUMENTS

| | | | | |
|---|---|---|---|---|
| 5,871,876 | A | 2/1999 | Ikuno et al. | |
| 6,558,863 | B2 | 5/2003 | Rokutanzono et al. | |
| 7,186,490 | B1 | 3/2007 | Niimi et al. | |
| 2003/0215264 | A1* | 11/2003 | Yasutomi et al. | 399/159 |
| 2004/0033428 | A1 | 2/2004 | Niimi | |
| 2004/0053149 | A1 | 3/2004 | Toda et al. | |
| 2004/0120730 | A1* | 6/2004 | Niimi et al. | 399/159 |
| 2004/0183883 | A1 | 9/2004 | Suzuki et al. | |
| 2004/0185358 | A1* | 9/2004 | Kami | 399/159 |
| 2004/0234875 | A1 | 11/2004 | Toda et al. | |
| 2005/0069797 | A1 | 3/2005 | Niimi et al. | |
| 2005/0175911 | A1 | 8/2005 | Tamoto et al. | |

(Continued)

FOREIGN PATENT DOCUMENTS

EP 1229393 A1 8/2002

(Continued)

OTHER PUBLICATIONS

U.S. Appl. No. 11/855,553, filed Sep. 14, 2007, Inaba, et al.

*Primary Examiner*—David M Gray
*Assistant Examiner*—Laura K Roth
(74) *Attorney, Agent, or Firm*—Oblon, Spivak, McClelland, Maier & Neustadt, L.L.P.

(57) ABSTRACT

An image forming apparatus is provided, including an electrostatic latent image bearer; a charger charging the electrostatic latent image bearer; an irradiator irradiating the electrostatic latent image bearer with imagewise light having an image resolution not less than 1,200 dpi to form an electrostatic latent image thereon; an image developer developing the electrostatic latent image with a toner to form a toner image on the electrostatic latent image bearer; a transferer transferring the toner image onto a recording medium; and a fixer fixing the toner image on the recording medium, wherein a time for a given point on the electrostatic latent image bearer to travel from a position right in front of the irradiator to a position right in front of the image developer is shorter than 50 msec and longer than a transit time of the electrostatic latent image bearer, and an image forming method using the image forming apparatus.

19 Claims, 9 Drawing Sheets

U.S. PATENT DOCUMENTS

| | | | | |
|---|---|---|---|---|
| 2005/0181291 | A1* | 8/2005 | Kami et al. | 399/159 |
| 2006/0008719 | A1 | 1/2006 | Niimi | |
| 2006/0057479 | A1 | 3/2006 | Niimi et al. | |
| 2006/0134540 | A1 | 6/2006 | Kondo et al. | |
| 2006/0177749 | A1 | 8/2006 | Tamoto et al. | |
| 2006/0197823 | A1 | 9/2006 | Ohta et al. | |
| 2006/0198659 | A1* | 9/2006 | Niimi | 399/159 |
| 2006/0292480 | A1 | 12/2006 | Niimi | |

FOREIGN PATENT DOCUMENTS

| | | | |
|---|---|---|---|
| JP | 10-115944 | | 5/1998 |
| JP | 2000-275872 | | 10/2000 |
| JP | 2000-305289 | | 11/2000 |
| JP | 2001-312077 | | 11/2001 |
| JP | 2004-287085 | | 10/2004 |
| JP | 2005274755 | A * | 10/2005 |

* cited by examiner

COMPACT AND HIGH SPEED IMAGE FORMING APPARATUS AND IMAGE FORMING METHOD USING THE SAME

BACKGROUND OF THE INVENTION

1. Field of the Invention

The present invention relates to a compact and high-speed image forming apparatus and an image forming method.

2. Discussion of the Background

Recently, the image forming apparatus producing high-quality images having not less than 1,200 dpi has two major issues. One is to produce images at higher speeds, and the other is to become compact.

In order to produce images at higher speeds with a monochrome image forming apparatus, an electrostatic latent image bearer (hereinafter referred to as "an electrophotographic photoreceptor", a "photoreceptor" or a "photoconductive insulator") thereof typically has a higher linear speed and a larger diameter. A full-color image forming apparatus has two steps. The first step is to become a tandem having plural image forming elements and the following step is that electrostatic latent image bearers thereof have a higher linear speed and a larger diameter than the electrostatic latent image bearer of a monochrome image forming apparatus does. The image forming element is a minimum unit for forming images, including at least a photoreceptor, a charger, an irradiator and an image developer. Besides these, a transferer and a fixer are necessary, however, they need not be plural and may be one subject to shared use.

Basically having only one image forming element, the monochrome and single drum full-color image forming apparatuses generally have sizes dependent on the diameters of their photoreceptors. This is because members are arranged around the photoreceptor as a center in designing the image forming element. Typically, the larger the diameter of a photoreceptor, the larger the members therearound. Therefore, it is not so a serious issue to make the monochrome and single drum full-color image forming apparatuses compact.

Meanwhile, the tandem full-color image forming apparatus includes plural image forming elements (typically 4 elements) which are arranged in parallel, and has a limited minimum size even when the diameter of the photoreceptor is downsized. Therefore, the photoreceptor preferably has a diameter not greater than 40 mm. Typically, the diameter of the photoreceptor is proportional to the image forming speed, and therefore the smaller the diameter, the lower the image forming speed. Therefore, the linear speed of the photoreceptor has been increased as high as possible to increase the image forming speed.

However, the capabilities of members forming image forming elements such as a charger and an irradiator have been limited, and it has been difficult to design a compact image forming apparatus (the diameter of the photoreceptor is not greater than 40 mm), producing high-resolution images (not less than 1,200 dpi) at a high speed (not less than 50 pieces/min).

The chargeability of the charger needs to be improved to produce images at a higher speed. When the photoreceptor has a smaller diameter, a facing width (called a charging nip) between the photoreceptor and the charger right in front of each other is quite small (narrow) Chargers using a wire method, typified by scorotron chargers, can increase corona application to the surface of the photoreceptor by increasing the number of wires. However, the wires interfere with each other when too close to each other, and the electric power consumption increases. In addition, a grid is needed for charge stability and the charging nip width depends on the size thereof. Typically, the grid is formed of an electroconductive metal plate and located in the tangential direction of the photoreceptor. Therefore, when the photoreceptor has a smaller diameter, distances between the grid and the surface of the photoreceptor are largely different at the middle of the grid and both ends thereof, and the substantial nip width is very narrow (both ends of the photoreceptor are unstably charged). In order to solve this, a grid which is not a flat plate and curved in accordance with the curvature of the photoreceptor can be used. However, this is not practical because this makes the apparatus more complicated and the space for the charger is small.

There is a method of using a roller-shaped charger. The roller-shaped charger is located contacting the surface of a photoreceptor or close thereto with a gap of about 50 μm therebetween. Typically, the surfaces thereof rotate at an equivalent speed in the same direction, a bias is applied to the roller and the roller discharges to the photoreceptor to be charged. The smaller the diameter of the charger, the more compact the charger. When the charger has a small diameter, the chargeable range (a range wherein a gap between the photoreceptor and the surface of the roller; called a charging nip) becomes narrow and deteriorates in chargeability. However, the chargeability is not so deteriorated as the scorotron charger, and when a DC bias overlapped with an AC bias is applied to the roller, the chargeability noticeably improves. Therefore, the charging process is not limited if these technologies are used. However, the DC bias overlapped with an AC bias is a large stress to the surface of the photoreceptor, resulting in deterioration of durability (life) thereof.

On the other hand, light emitting diodes (LEDs) and laser diodes (LDs) have been used as a writing light source. The LEDs are located close to a photoreceptor in the longitudinal direction in the shape of an array. However, the resolution depends on the size of an element thereof and distances between the elements. Therefore, it cannot be said that the LED is most suitable for a light source of not less than 1,200 dpi at present. The LD emits a writing beam through a polygon mirror to a photoreceptor in the longitudinal direction thereof. When the photoreceptor has a small diameter, the linear speed thereof increases and the rotation number of the polygon mirror needs to be increased. However, the maximum rotation number of the polygon mirror is at present about 40,000 rpm and a single beam has a limited writing speed.

Plural light beams are beginning to be used. Plural LD light sources irradiate beams to a polygon mirror or a multibeam irradiator including plural LDs in an array is used. Recent multibeam irradiators include a surface emitting laser having three or more light sources and a surface emitting laser having two-dimensional light sources. These can write images having a resolution not less than 1,200 dpi on a photoreceptor.

Thus, with the improvements or new technologies of members forming the image forming elements, it is ready to prepare a compact image forming apparatus (the diameter of the photoreceptor is not greater than 40 mm), producing high-resolution images (not less than 1,200 dpi) at a high speed (not less than 50 pieces/min).

When the compactness and high-speed are to be realized at the same time, it is not clarified which part such as a linear speed of a photoreceptor and sizes of members therearound is a limiting factor.

The present inventors made various simulations of limiting process in the compact image forming apparatus (the diameter of the photoreceptor is not greater than 40 mm), producing high-resolution images (not less than 1,200 dpi) at a high speed (not less than 50 pieces/min). As a result, the linear speed of a photoreceptor needs to be increased when forming images at a high speed with the photoreceptor having a small diameter, however, the linear speed depends on an image forming speed set in the apparatus and a paper spacing. When the image forming speed is fixed, the shorter the paper spacing, and the lower the linear speed can be. However, the linear speed has a minimum limit as the paper spacing does.

The linear speed influences capabilities and sizes of image forming elements around the photoreceptor. As mentioned above, when the charger has sufficient chargeability, the charger can be small and the photoreceptor has an extra space therearound. Therefore, for example, a discharger and an irradiator can advantageously be relocated. When the photoreceptor does not have a sufficient potential reduction after discharge, an interval (distance) between the discharge and charge can be extended because the charger is small. Alternatively, when the photoreceptor does not have a sufficient potential reduction after irradiated, the irradiator can be located close to the charger and an interval (distance) between the irradiation and development can be extended.

In the compact image forming apparatus (the diameter of the photoreceptor is not greater than 40 mm), producing high-resolution images (not less than 1,200 dpi) at a high speed (not less than 50 pieces/min), the present inventors found that a time from the irradiation to the development (hereinafter referred to as an "irradiation-development time") is extremely short. Specifically, the current image forming apparatuses have an irradiation-development time of about 70 msec at earliest, however, the above-mentioned image forming apparatus has an irradiation-development time less than 50 msec.

There has been no photoreceptor used in an image forming apparatus having such a short irradiation-development time. The present inventors evaluated a time-responsiveness of surface potential light attenuation of a photoreceptor to search properties of a photoreceptor usable therein.

As a method of evaluating the time-responsiveness of surface potential light attenuation of a photoreceptor, Published Unexamined Japanese Patent Applications Nos. 10-115944 and 2001-312077 disclose a Time of Flight (TOF) method of evaluating a resin layer including a charge transport material (CTM) or a CTM and a binder resin. This is effectively used to design the formulation of a photoreceptor. However, there is a difference between the charge transport conditions of a photoreceptor used in an apparatus and those of a TOF method, i.e., an electrical field intensity in the layer of the former photoreceptor momentarily changes, and that in the layer of the latter photoreceptor is constant. In addition, the TOF method does not reflect a charge generation from a charge generation layer (CGL) and a charge injection therefrom to a charge transport layer (CTL) of a multilayer photoreceptor.

As a method of directly measuring the responsiveness of a photoreceptor, Published Unexamined Japanese Patent Application No. 2000-305289 discloses a method of recording the surface potential variation of a photoreceptor after irradiation with pulse light at a high speed with a high-speed surface potential meter; and measuring a response time required for having a predetermined potential. This is typically called a Xerographic Time of Flight (XTOF) method, and is effectively used to resolve the disadvantage of the TOF method. However, most of the light sources used in this method are different from irradiators used in electrophotographic image forming apparatuses, and the method cannot exactly be considered a direct measuring method.

Published Unexamined Japanese Patent Application No. 2000-275872 discloses a measurer measuring properties of a photoreceptor, which can fix a predetermined time (hereinafter referred to as an "irradiation-development time") for an irradiated part of the photoreceptor to reach an image developer and let a relationship (light attenuation curve) between a light quantity (energy) from a LD and an irradiated part potential be known. An embodiment of the relationship is shown in FIG. 2. FIG. 2 shows that there is an area where the surface potential lowers and an area where the surface potential does not lower as the light energy increases. The boundary line between the two areas is a boundary point, and the following measurement is performed with a lower light quantity.

As shown in FIG. 3, the variation of the irradiated part potential is measured when the irradiation-development time is changed by the measurer disclosed in Published Unexamined Japanese Patent Application No. 2000-275872. Then, as shown in FIG. 4, when the relationship between the irradiation-development time and the irradiated part potential is plotted, a folding point can be found. The irradiation-development at the folding point is defined as a transit time in the present invention. Therefore, the relationships among the irradiation-development time, the irradiated part potential and the transit time, i.e., the time responsiveness of the surface potential light attenuation of an electrophotographic photoreceptor can exactly be known. The transit time depends on the surface potential and thickness of a photoreceptor before irradiation with writing light, in other words, on the electrical field intensity applied to a photoreceptor. Therefore, when the transit time is measured, a photoreceptor having the same compositions and thickness as those of a photoreceptor actually used is needed. The surface potential of a photoreceptor before irradiation with writing light needs to be equivalent to an unirradiated surface potential of an image forming apparatus in which the photoreceptor is used.

A method of controlling the transit time of a photoreceptor will be explained in detail when a photoreceptor is explained. The present inventors analyze the transit time of a typical negatively-charged multilayer photoreceptor including a substrate, and an intermediate layer, a CGL and a CTL in this order on the substrate. As a result, the transit time reflects the transportability of a photocarrier generated in the CGL, and eventually reflects the positive-hole transportability in the CTL mostly. In order to effectively control the transit time, the formulation of the CTL proves to be essential.

The irradiation-development time is defined as a time for a given point on the photoreceptor to transport from a position right in front of the irradiator to a position right in front of the image developer. More specifically, as FIG. 1 shows, a time for a given point on the photoreceptor to transport from a position (A) right in front of the irradiator to a position (B) right in front of the image developer while the photoreceptor rotates in the direction of a dashed arrow. The position (A) is a center of writing light (beam) emitting from a writing light source to the center of a photoreceptor, and an intersecting point between the writing light and the surface of the photoreceptor. The position (B) can be said the center of a developing nip, and when a developing sleeve having the shape of a rod is used as FIG. 1 shows, can be said a position where the developing sleeve and the surface of the photoreceptor come closest to each other. Therefore, the irradiation-development time is a time (sec) from dividing a length (mm) of a circular arc from the position (A) to the position (B) by a linear speed (mm/sec) of the photoreceptor.

Thus, the relationship between the transit time and the irradiation-development time is clarified.

In the compact image forming apparatus (the diameter of the photoreceptor is not greater than 40 mm), producing high-resolution images (not less than 1,200 dpi) at a high speed (not less than 50 pieces/min), the photoreceptor needs to finish light attenuation in the irradiation-development time. When writing light is irradiated thereto in a short time as a laser beam after the photoreceptor is charged, the surface potential of the photoreceptor gradually attenuates as time passes. The potential largely attenuates for a specific time, but after the specific time passes, the potential scarcely attenuates. The specific time can be thought a transit time during which most of the photocarriers generated in the photoreceptor pass over a photosensitive layer thereof.

The time is expected to depend on the carrier generation and carrier transport time in the photoreceptor, the relationship between the process conditions and transit time is not clarified when using a tandem full-color image forming apparatus.

When the irradiator cannot follow, the irradiance level to the photoreceptor lowers, resulting in deterioration of image density in negative-positive development and deterioration of color balance in a tandem full-color image forming apparatus. Therefore, the writing image resolution is decreased.

When the transit time is longer than the irradiation-development time, the irradiated part of a photoreceptor reaches the development part while a photocarrier generated in a photosensitive layer of the photoreceptor is still being transported Therefore, (i) the surface potential of the photoreceptor does not sufficiently lower and development potential is not fully obtained, resulting in deterioration of image density in negative-positive development. (ii) Should the development potential be obtained, the surface potential lowers after passing the development part and the electrostatic adherence of a toner to the irradiated part of the photoreceptor lowers in negative-positive development, resulting in deterioration of dot image resolution or toner scattering when transferred. (iii) Further, when the photoreceptor forms a second image after forming a first image, a carrier generated late inside slightly lowers the irradiated part potential of the first image. Therefore, halftone potentials differ from each other, resulting in production of abnormal images such as a ghost (a residual image) in a monochrome image forming apparatus and deterioration of color reproducibility in a full-color image forming apparatus producing many halftone images.

Because of these reasons, a need exists for a compact image forming apparatus producing high-quality images at high speed.

SUMMARY OF THE INVENTION

Accordingly, an object of the present invention is to provide a compact image forming apparatus and image forming method, capable of producing high-quality images at high speed.

Another object of the present invention is to provide an image forming apparatus and image forming method, capable of producing highly-durable and stable-quality images with less abnormal images even after repeatedly used.

These objects and other objects of the present invention, either individually or collectively, have been satisfied by the discovery of an image forming apparatus, comprising:

an electrostatic latent image bearer;

a charger charging the electrostatic latent image bearer;

an irradiator irradiating the electrostatic latent image bearer with imagewise light having an image resolution not less than 1,200 dpi to form an electrostatic latent image thereon;

an image developer developing the electrostatic latent image with a toner to form a toner image on the electrostatic latent image bearer;

a transferer transferring the toner image onto a recording medium; and a fixer fixing the toner image on the recording medium, wherein a time for a given point on the electrostatic latent image bearer to travel from a position right in front of the irradiator to a position right in front of the image developer is shorter than 50 msec and longer than a transit time of the electrostatic latent image bearer.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a compact image forming apparatus and image forming method, capable of producing high-quality images a thigh-speed. In addition, an image forming apparatus and image forming method, capable of producing highly-durable and stable-quality images with less abnormal images even after repeated use, are provided.

The image forming apparatus of the present invention includes at least an electrostatic latent image bearer, a charger, an irradiator, an image developer, a transferee, and a fixer, wherein a traveling time of a given point of the electrostatic latent image bearer from a position right in front of the irradiator to a position right in front of the image developer is shorter than 50 msec and longer than a transit time of the electrostatic latent image bearer, and optionally includes other means such as a cleaner, a discharger, a recycler and a controller.

The image forming method of the present invention includes at least an electrostatic latent image bearer, a charging process, an irradiating process, an developing process, a transferring process, and a fixing process, wherein a traveling time of a given point of the electrostatic latent image bearer from a position right in front of the irradiating process to a position right in front of the image developing process is shorter than 50 msec and longer than a transit time of the electrostatic latent image bearer, and optionally includes other processes such as a cleaning process, a discharging process, a recycling process and a controlling process.

The image forming method of the present invention can preferably be performed using the image forming apparatus of the present invention. Specifically, the charging process, irradiating process, developing process, transferring process, discharging process and fixing process are performed with the charger, image developer, transferer, discharger and fixer, respectively. The other optional processes can be performed with the optional means mentioned above.

The photoreceptor for use in the image forming apparatus of the present invention has a transit time shorter than the irradiation-development time in the image forming apparatus, and preferably has a photosensitive layer in which a CGL and a CTL are layered on a substrate. The materials, shape, structure, dimension, etc. of the photoreceptor are not particularly limited. The photoreceptor preferably includes an electroconductive substrate.

FIGS. 5 to 8 illustrate embodiments of layer composition of electrophotographic photoreceptors for use in the present invention.

Figure 5:
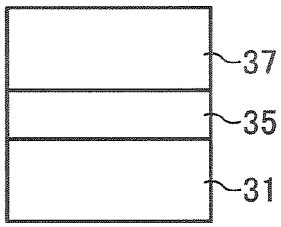
FIG. 5 is a cross-sectional view illustrating an embodiment of layer composition of an electrophotographic photoreceptor for use in the present invention.

The photoreceptor illustrated in FIG. 5 has an electroconductive substrate 31; a CGL 35 including at least an organic CGM as a main component; and a CTL 37 including a CTM as a main component on the substrate.

Figure 6:
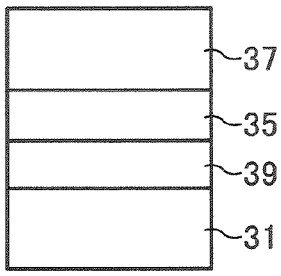
FIG. 6 is a cross-sectional view illustrating another embodiment of layer composition of an electrophotographic photoreceptor for use in the present invention.

The photoreceptor illustrated in FIG. 6 has an electroconductive substrate 31; and an intermediate layer 39 including a metal oxide, a CGL 35 including at least an organic CGM as a main component and a CTL 37 including a CTM as a main component on the substrate.

Figure 7:
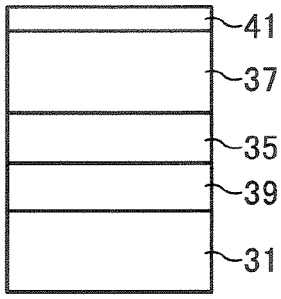
FIG. 7 is a cross-sectional view illustrating a further embodiment of layer composition of an electrophotographic photoreceptor for use in the present invention.

The photoreceptor illustrated in FIG. 7 has a structure similar to the photoreceptor illustrated in FIG. 6 except that a protection layer 41 is formed on the CTL.

Figure 8:
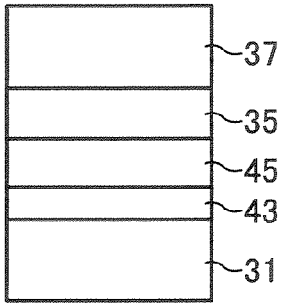
FIG. 8 is a cross-sectional view illustrating another embodiment of layer composition of an electrophotographic photoreceptor for use in the present invention.

The photoreceptor illustrated in FIG. 8 has a structure similar to the photoreceptor illustrated in FIG. 6 except that the intermediate layer 39 includes a charge blocking layer 43 and an anti-moiré layer 45.

Suitable materials for use as the electroconductive substrate 31 include materials having a volume resistivity not greater than $10^{10}\Omega\cdot$cm. Specific examples of such materials include plastic cylinders, plastic films or paper sheets, on the surface of which a metal such as aluminum, nickel, chromium, nichrome, copper, gold, silver and platinum, or a metal oxide such as a tin oxide and an indium oxide, is formed by deposition or sputtering. In addition, a plate of a metal such as aluminum, aluminum alloys, nickel and stainless steel can be used. A metal cylinder can also be used as the substrate 31, which is prepared by tubing a metal such as aluminum, aluminum alloys, nickel and stainless steel by a method such as impact ironing or direct ironing, and then treating the surface of the tube by cutting, super finishing, polishing, etc. In addition, endless belts of a metal such as nickel and stainless steel can also be used as the electroconductive substrate 31.

Further, substrates, in which a coating liquid including a binder resin and an electroconductive powder is coated on the supports mentioned above, can be used as the substrate 31. Specific examples of such an electroconductive powder include, but are not limited to, carbon black, acetylene black, powders of metals such as aluminum, nickel, iron, nichrome, copper, zinc, and silver, and metal oxides such as electroconductive tin oxides and ITO. Specific examples of the binder resin include, but are not limited to, known thermoplastic resins, thermosetting resins and photo-crosslinking resins, such as polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyarylate, a phenoxy resin, polycarbonate, a cellulose acetate resins, an ethyl cellulose resin, a polyvinyl butyral resin, a polyvinyl formal resin, polyvinyl toluene, poly-N-vinyl carbazole, an acrylic resin, a silicone resin, an epoxy resin, a melamine resin, a urethane resin, a phenolic resin and an alkyd resin. Such an electroconductive layer can be formed by coating a coating liquid in which an electroconductive powder and a binder resin are dispersed or dissolved in a proper solvent such as tetrahydrofuran, dichloromethane, methyl ethyl ketone and toluene, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON), with an electroconductive material, can also be used as the electroconductive substrate 31.

Among these materials, cylinders made of aluminum or an aluminum alloy are preferable because aluminum can be easily anodized. Suitable aluminum materials for use as the substrate include, but are not limited to, aluminum and aluminum alloys such as JIS 1000 series, 3000 series and 6000 series. Anodic oxide films can be formed by anodizing metals or metal alloys in an electrolyte solution. Among the anodic oxide films, alumite films which can be prepared by anodizing aluminum or an aluminum alloy are preferably used for the photoreceptor of the present invention. This is because the resultant photoreceptor hardly causes undesired images such as black spots and background fouling when used for reverse development (i.e., negative-positive development).

The anodizing treatment is performed in an acidic solution including an acid such as chromic acid, sulfuric acid, oxalic acid, phosphoric acid, boric acid, and sulfamic acid. Among these acids, sulfuric acid is preferably used for the anodizing treatment in the present invention. It is preferable to perform an anodizing treatment on a substrate under the following conditions:

(1) concentration of sulfuric acid: 10 to 20%

(2) temperature of treatment liquid: 5 to 25° C.

(3) current density: 1 to 4 A/dm$^2$ (4) electrolytic voltage: 5 to 30 V (5) treatment time: 5 to 60 minutes.

However, the treatment conditions are not limited thereto. The thus prepared anodic oxide film is porous and highly insulative. Therefore, the surface of the substrate is very unstable, and the physical properties of the anodic oxide film change with time. In order to avoid such a problem, the anodic oxide film is preferably subjected to a sealing treatment. The sealing treatment can be performed by, for example, the following methods:

(1) dipping the anodic oxide film in an aqueous solution of nickel fluoride or nickel acetate;

(2) dipping the anodic oxide film in boiling water; and (3) subjecting the anodic oxide film to steam sealing.

After the sealing treatment, the anodic oxide film is subjected to a washing treatment to remove foreign materials such as metal salts adhered to the surface of the anodic oxide film during the sealing treatment. Such foreign materials present on the surface of the substrate not only affect the coating quality of a layer formed thereon but also produce images having background fouling because of typically having a low electric resistance. The washing treatment is performed by washing the substrate having an anodic oxide film thereon with pure water one or more times. It is preferable that the washing treatment is performed until the wash water is as clean (i.e., deinonized) as possible. In addition, it is also preferable to rub the substrate with a washing member such as brushes in the washing treatment. The thickness of the thus prepared anodic oxide film is preferably from 5 to 15 μm. When the anodic oxide film is too thin, the barrier effect thereof is not satisfactory. In contrast, when the anodic oxide film is too thick, the time constant of the electrode (i.e., the substrate) becomes excessively large, resulting in increase of residual potential of the resultant photoreceptor and deterioration of response thereof.

The substrate preferably has a cylindrical shape (the shape of a drum) having an outer diameter not greater than 40 mm.

The intermediate layer 39 includes a resin as a main component. Since a CGL is formed on the intermediate layer typically by coating a liquid including an organic solvent, the resin in the intermediate layer preferably has good resistance to general organic solvents. Specific examples of such resins include, but are not limited to, water-soluble resins such as a polyvinyl alcohol resin, casein and a polyacrylic acid sodium salt; alcohol soluble resins such as a nylon copolymer and a methoxymethylated nylon resin; and thermosetting resins capable of forming a three-dimensional network such as a polyurethane resin, a melamine resin, an alkyd-melamine resin and an epoxy resin.

The intermediate layer includes a metal oxide for preventing moiré as well as reducing the residual potential. Specific examples of the metal oxide include, but are not limited to, titanium oxide, silica, alumina, zirconium oxide, tin oxide, indium oxide, zinc oxide, etc. Particularly, titanium oxide and zinc oxide are effectively used. In addition, the metal oxide may optionally be surface-treated.

The intermediate layer can be formed by coating a coating liquid using a proper solvent and a proper coating method, and preferably has a thickness of from 0.1 to 5 μm.

The intermediate layer 39 has both a function of preventing the charges, which are induced at the electroconductive substrate side of the layer in the charging process, from being injected into the photosensitive layer, and a function of preventing occurrence of moiré fringe caused by using coherent light such as laser light as image writing light. In the present invention it is preferable to use a functionally separated intermediate layer i.e., a combination of the charge blocking layer 43 and the anti-moiré layer 45. Next, the functionally separated intermediate layer will be explained.

The function of the charge blocking layer 43 is to prevent the charges, which are induced in the electrode (i.e., the electroconductive substrate 31) and have a polarity opposite to that of the voltage applied to the photoreceptor by a charger, from being injected to the photosensitive layer. Specifically, when negative charging is performed, the charge blocking layer 43 prevents injection of positive holes to the photosensitive layer. In contrast, when positive charging is performed, the charge blocking layer 43 prevents injection of electrons to the photosensitive layer. Specific examples of the charge blocking layer include the following layers:

(1) a layer prepared by anodic oxidation such as an aluminum oxide layer;

(2) an insulating layer of an inorganic material such as SiO;

(3) a layer made of a network of a glassy metal oxide;

(4) a layer made of polyphosphazene;

(5) a layer made of a reaction product of aminosilane;

(6) a layer made of an insulating resin; and (7) a crosslinked resin layer.

Among these layers, an insulating resin layer and a crosslinked resin layer, which can be formed by a wet coating method, are preferably used. Since the anti-moiré layer and the photosensitive layer are typically formed on the charge blocking layer by a wet coating method, the charge blocking layer preferably has good resistance to the solvents included in the coating liquids of the anti-moiré layer and the photosensitive layer.

Suitable resins for use in the charge blocking layer include, but are not limited to, thermoplastic resins such as a polyamide resin, a polyester resin and a vinyl chloride/vinyl acetate copolymer; and thermosetting resins which can be prepared by thermally polymerizing a compound having a plurality of active hydrogen atoms (such as hydrogen atoms of —OH, —$NH_2$, and —NH) with a compound having a plurality of isocyanate groups and/or a compound having a plurality of epoxy groups. Specific examples of the compound having a plurality of active hydrogen atoms include, but are not limited to, polyvinyl butyral, a phenoxy resin, a phenolic resin, a polyamide resin, a phenolic resin, a polyamide resin, a polyester resin, a polyethylene glycol resin, a polypropylene glycol resin, a polybutylene glycol resin and an acrylic resin like a hydroxyethyl methacrylate resin. Specific examples of the compound having a plurality of isocyanate groups include, but are not limited to, tolylene diisocyanate, hexamethylene diisocyanate, diphenylmethane diisocyanate, prepolymers of these compounds, etc. Specific examples of the compound having a plurality of epoxy groups include, but are not limited to, bisphenol A based on an epoxy resin, etc. Among these resins, the polyamide resin is preferably used in view of film formability, environmental stability and resistance to solvents. Particularly, an N-methoxymethylated nylon is most preferably used.

The N-methoxymethylated nylon can be prepared by modifying a polyamide, such as polyamide 6, by a method disclosed by T. L. Cairns (J. Am. Chem. Soc. 71. P651 (1949)). An amide-linked hydrogen of the original polyamide is substituted with a methoxy methyl group to form the N-alkoxymethylated nylon. The substitution rate thereof is largely dependent on the modifying conditions, however, preferably not less than 15 mol %, and more preferably not less than 35 mol % in terms of suppressing the hygroscopicity, alcohol affinity and environmental stability of the intermediate layer. The more the substitution rate, the more the alcoholic solvent affinity. However, the hygroscopicity increases and the crystallinity deteriorates, resulting in deterioration of melting point, mechanical strength and elasticity, because bulk side chain groups around the main chain affect the relaxation and coordination of the main chain. Therefore, the substitution rate is preferably not greater than 85 mol %, and more preferably not greater than 70 mol % Further, nylon 6 is most preferably used, nylon 66 is preferably used, and a copolymer nylon such as nylon 6/66/610 is not preferably used as disclosed in Published Unexamined Japanese Patent Application No. 9-265202.

In addition, oil-free alkyd resins; amino resins such as thermosetting amino resins prepared by thermally polymerizing a butylated melamine resin; and photo-crosslinking resins prepared by reacting an unsaturated resin, such as unsaturated polyurethane resins unsaturated polyester resins, with a photo-polymerization initiator such as thioxanthone compounds and methylbenzyl formate, can also be used.

Further, electroconductive polymers having a rectification property, and layers including a resin or a compound having an electron accepting or donating property which is determined depending on the polarity of the charges formed on the surface of the photoreceptor to prevent the charge injection from the substrate can also be used.

The charge blocking layer 43 preferably has a thickness not less than 0.1 μm and less than 2.0 μm, and more preferably from 0.3 μm to 1.0 μm. When the charge blocking layer is too thick, the residual potential of the photoreceptor increases after imagewise light irradiation is repeatedly performed particularly under low temperature and low humidity conditions. In contrast, the charge blocking layer is too thin, the charge blocking effect is hardly produced. The charge blocking layer 43 can include one or more materials such as crosslinking agents, solvents, additives and crosslinking promoters. The charge blocking layer 43 can be prepared by coating a coating liquid by a coating method such as blade coating, dip coating, spray coating, bead coating and nozzle coating, followed by drying and crosslinking using heat or light.

The function of the anti-moiré layer 45 is to prevent occurrence of moiré fringe in the resultant images due to interference of light, which is caused when coherent light (such as laser light) is used for optical writing. Namely, the anti-moiré layer scatters the above-mentioned writing light. In order to perform this function, the layer preferably includes a material having a high refractive index.

Since the injection of charges from the substrate 31 is blocked by the charge blocking layer 43, the anti-moiré layer 45 preferably has an ability to transport charges having the same polarity as that of the charges formed on the surface of the photoreceptor, to prevent increase of residual potential. For example, in a negative charge type photoreceptor, the anti-moiré layer 45 preferably has an electron conducting ability. Therefore it is preferable to use an electroconductive metal oxide or a conductive metal oxide for the anti-moiré layer 45. Alternatively, an electroconductive material (such as acceptors) may be added to the anti-moiré layer 45.

Specific examples of the binder resin for use in the anti-moiré layer 45 include, but are not limited to, the resins mentioned above for use in the charge blocking layer 43. Since the photosensitive layer (CGL 35 and CTL 37) is formed on the anti-moiré layer 45 by coating a coating liquid, the binder resin preferably has a good resistance to the solvent included in the photosensitive layer coating liquid.

Among the resins, thermosetting resins are preferably used. Particularly, a mixture of an alkyd resin and a melamine resin is most preferably used. The mixing ratio of an alkyd resin to a melamine resin is an important factor influencing the structure and properties of the anti-moiré layer 45, and the weight ratio thereof is preferably from 5/5 to 8/2. When the content of the melamine resin is too high, the coated film is shrunk in the thermosetting process, and thereby coating defects are formed in the resultant film. In addition, the residual potential increasing problem occurs. In contrast, when the content of the alkyd resin is too high, the electric resistance of the layer seriously decreases, and thereby the resultant images have background fouling, although residual potential of the photoreceptor is reduced.

The mixing ratio of the metal oxide to the binder resin in the anti-moiré layer 45 is also an important factor, and the volume ratio thereof is preferably from 1/1 to 3/1. When the ratio is too low (i.e., the content of the metal oxide is too low), not only the anti-moiré effect deteriorates but also the residual potential increases after repeated use. In contrast, when the ratio is too high, the film formability of the layer deteriorates, resulting in deterioration of surface conditions of the resultant layer. In addition, a problem occurs in that the upper layer (e.g., the photosensitive layer) cannot form a good film thereon because the coating liquid penetrates into the anti-moiré layer. This problem is fatal to the photoreceptor having a layered photosensitive layer including a thin charge generation layer as a lower layer because such a thin CGL cannot be formed on such a anti-moiré layer. In addition, when the ratio is too large, a problem occurs in that the surface of the metal oxide cannot be covered with the binder resin. In this case, the CGM is directly contacted with the metal oxide and thereby the possibility of occurrence of a problem in that carriers are thermally produced increases, resulting in occurrence of a background development problem.

By using two kinds of titanium oxides having different average particle diameters for the anti-moiré layer, the substrate 1 is effectively hidden by the anti-moiré layer and thereby occurrence of moiré fringes can be well prevented and formation of pinholes in the layer can also be prevented. The average particle diameters (D1 and D2) of the two kinds of titanium oxides preferably satisfy the following relationship:

$$0.2 \leqq D2/D1 \leqq 0.5.$$

When the ratio D2/D1 is too low, the surface of the titanium oxide becomes more active, and thereby stability of the electrostatic properties of the resultant photoreceptor seriously deteriorates. In contrast, when the ratio is too high, the electroconductive substrate 31 cannot be well hidden by the anti-moiré layer and thereby the anti-moiré effect deteriorates and abnormal images such as moiré fringes are produced. The average particle diameter of the pigment means the average particle diameter of the pigment in a dispersion prepared by dispersing the pigment in water while applying a strong shear force thereto.

Further, the average particle diameter (D2) of the titanium oxide (T2) having a smaller average particle diameter is also an important factor, and is preferably greater than 0.05 μm and less than 0.20 μm. When D2 is too small, hiding power of the layer deteriorates. Therefore, moiré fringes tend to be caused. In contrast, when D2 is too large, the filling factor of the titanium oxide in the layer is small, and thereby background development preventing effect cannot be well produced.

The mixing ratio of the two kinds of titanium oxides in the anti-moiré layer 45 is also an important factor, and is preferably determined such that the following relationship is satisfied:

$$0.2 \leqq T2/(T1+T2) \leqq 0.8,$$

wherein T1 represents the weight of the titanium oxide having a larger average particle diameter, and T2 represents the weight of the titanium oxide having a smaller average particle diameter. When the mixing ratio is too low, the filling factor of the titanium oxide in the layer is small, and thereby background development preventing effect cannot be well produced. In contrast, when the mixing ratio is too high, the hiding power of the layer deteriorates, and thereby the anti-moiré effect cannot be well produced.

The anti-moiré layer preferably has a thickness of from 1 to 10 μm, and more preferably from 2 to 5 μm. When the layer is too thin, the anti-moiré effect cannot be well produced. In contrast, when the layer is too thick, the residual potential increases after repeated use.

The anti-moiré layer is typically prepared as follows. A metal oxide is dispersed in a solvent together with a binder resin using a dispersion machine such as ball mills, sand mills, and attritors. In this case, crosslinking agents, other solvents, additives, crosslinking promoters, etc., can be added thereto if desired. The thus prepared coating liquid is coated on the charge blocking layer by a method such as blade coating, dip coating, spray coating, bead coating and nozzle coating, followed by drying and crosslinking using light or heat.

Next, the photosensitive layer will be explained. The photosensitive layer preferably includes the CGL 35 including an organic CGM and the CTL 37 including a CTM.

The CGL 35 includes an organic CGM as a main component, and is typically prepared by coating a coating liquid, which is prepared by dispersing an organic CGM in a solvent optionally together with a binder resin using a dispersing machine such as ball mills, attritors, sand mills and supersonic dispersing machines, on an electroconductive substrate, followed by drying.

Specific examples of the binder resins, which are optionally included in the CGL coating liquid, include but are not limited to, polyamide, polyurethane, an epoxy resin, polyketone, polycarbonate, a silicone resin, an acrylic resin, polyvinyl butyral, polyvinyl formal, polyvinyl ketone, polystyrene, polysulfone, poly-N-vinylcarbazole, polyacrylamide, polyvinyl benzal, polyester, a phenoxy resin, a vinyl chloride-vinyl acetate copolymer, polyvinyl acetate, polyphenylene oxide, polyamide, polyvinyl pyridine, a cellulose resin, casein, polyvinyl alcohol, polyvinyl pyrrolidone, etc. Among the binder resins, a polyvinyl acetal, such as polyvinyl butyral, is preferably used. The CGL preferably includes the binder resin in an amount of from 0 to 500 parts by weight, and preferably from 10 to 300 parts by weight, per 100 parts by weight of the CGM included in the layer.

Specific examples of the solvents for use in the CGL coating liquid include, but are not limited to, isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, etc. Among these solvents, ketones, esters and ethers are preferably used. The CGL preferably has a thickness of from 0.01 to 5 μm, and more preferably from 0.1 to 2 μm.

Specific examples of the CGM include an organic CGM. Specific examples of the organic CGM include, but are not limited to, known organic CGMs, e.g., phthalocyanine pigments such as metal phthalocyanine and metal-free phthalocyanine, an azulenium salt pigment, a squaric acid methine pigment, an azo pigment having a carbazole skeleton, an azo pigment having a triphenyl amine skeleton, an azo pigment having a diphenyl amine skeleton, an azo pigment having a dibenzothiophene skeleton, an azo pigment having a fluorenone skeleton, an azo pigment having an oxadiazole skeleton, an azo pigment having a bisstilbene skeleton, an azo pigment having a distyryloxadiazole skeleton, an azo pigment having a distyrylcarbazole skeleton, a perylene pigment, an anthraquinone pigment, a polycyclic quinone pigment, a quinone imine pigment, a diphenylmethane pigment, a triphenylmethane pigment, a benzoquinone pigment, a naphthoquinone pigment, a cyanine pigment, an azomethine pigment, an indigoide pigment, a bisbenzimidazole pigment, etc. These CGMs can be used alone or in combination.

Among the pigments, an asymmetric azo pigment having the following formula (I) can effectively be used:

(I)

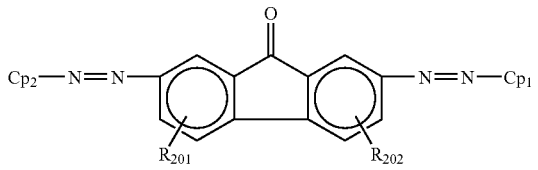

wherein $Cp_1$ and $Cp_2$ each, independently, represent a coupler residue, and $R_{201}$ and $R_{202}$ each, independently, represent a hydrogen atom, a halogen atom, an alkyl group, an alkoxy group and a cyano group.

In addition, $Cp_1$ and $Cp_2$ have the following formula (II):

(II)

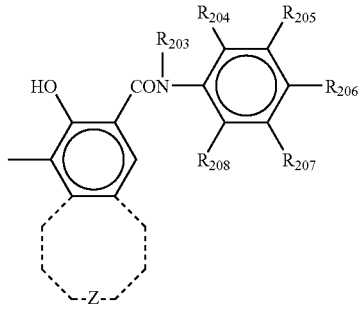

wherein $R_{203}$ represents a hydrogen atom, an alkyl group or an aryl group. $R_{204}$, $R_{205}$, $R_{206}$, $R_{207}$ and $R_{208}$ each, independently, represent a hydrogen atom, a nitro group, a cyano group, a halogen atom, a halogenated alkyl group, an alkyl group, an alkoxy group, dialkylamino group and a hydroxyl group. Z represents atoms which are required to form a substituted or an unsubstituted aromatic carbon ring, or a substituted or an unsubstituted aromatic heterocycle.

Further, a titanylphthalocyanine compound having an X-ray diffraction spectrum such that a maximum peak is observed at a Bragg (2θ) angle (±0.2°) of 27.2°; or an X-ray diffraction spectrum such that a maximum peak is observed at a Bragg (2θ) angle of 27.2±0.2°, a lowest angle peak at an angle of 7.3±0.2°, and a main peak at each of Bragg (2θ) angles (±0.2°) of 9.4°, 9.6°, and 24.0°, wherein no peak is observed between the peaks of 7.3° and 9.4° and at an angle of 26.3 (±0.2°) is also preferably used.

The organic CGM preferably has an average particle diameter not greater than 0.25 μm, and more preferably not greater than 0.2 μm. The organic CGM having a particle diameter not less than 0.25 μm is removed after being dispersed.

The average particle diameter means a volume average particle diameter, and can be determined by a centrifugal automatic particle diameter analyzer, CAPA-700 from Horiba, Ltd. The volume average particle diameter means the cumulative 50% particle diameter (i.e., Median diameter). However, by using this particle diameter determining method, there is a case where a small amount of coarse particles cannot be detected. Therefore, it is preferable to directly observe the dispersion including a CGM with an electron microscope, to determine the particle diameter of the crystal.

Next, a method of removing coarse particles from an organic CGM dispersion will be explained.

A dispersion is prepared by dispersing the organic CGM in a solvent, optionally together with a binder resin, using a ball mill, an attritor, a sand mill, a bead mill, an ultrasonic dispersing machine or the like. In this case, it is preferable that a proper binder resin is chosen in consideration of the electrostatic properties of the resultant photoreceptor and a proper solvent is chosen while considering its abilities to wet and disperse the pigment.

Specifically, after a dispersion wherein the particles are refined as much as possible is prepared, the dispersion is then filtered using a filter with a proper pore size. By using this method, a small amount of coarse particles (which cannot be visually observed or cannot be detected by a particle diameter measuring instrument) can be removed from the dispersion. In addition, the particle diameter distribution of the particles in the dispersion can be properly controlled. Specifically, it is preferable to use a filter with an effective pore diameter not greater than 5 μm, and more preferably not greater than 3 μm. By using such a filter, a dispersion in which the CGM is dispersed while having an average particle diameter not greater than 0.25 μm (or not greater than 0.20 μm) can be prepared. By using this dispersion, a CGL can be formed without causing coating defects. Therefore, the effects of the present invention can be fully produced.

When a dispersion including a large amount of coarse particles is filtered, the amount of particles removed by filtering increases, and thereby a problem occurs wherein the solid content of the resultant dispersion is seriously decreased. Therefore, it is preferable that the dispersion to be filtered has a proper particle diameter distribution (i.e., a proper particle diameter and a proper standard deviation of particle diameter). Specifically, in order to efficiently perform the filtering operation without causing the clogging problem of the filter at a little loss of the resultant CGM, it is preferable that the average particle diameter is not greater than 0.3 μm and the standard deviation of the particle diameter is not greater than 0.2 μm.

The CGMs for use in the present invention have a high intermolecular hydrogen bond force. Therefore, the dispersed pigment particles have a high interaction. As a result thereof, the dispersed CGM particles tend to aggregate. By performing the above-mentioned filtering using a filter having the specific pore diameter, such aggregates can be removed. The dispersion has a thixotropic property, and thereby particles having a particle diameter less than the pore diameter of the filter used can be removed. Alternatively, a liquid having a structural viscosity can be changed to a Newtonian liquid by filtering. By removing coarse particles from a CGL coating liquid, a good CGL can be prepared and the effect of the present invention can be produced.

It is preferable that a proper filter is chosen depending on the size of coarse particles to be removed. As a result of the present inventors' investigation, it is found that coarse particles having a particle diameter not less than 3 μm affect the image qualities of images with a resolution of 600 dpi. Therefore, it is preferable to use a filter with a pore diameter not greater than 5 μm, and more preferably not greater than 3 μm. Filters with too small a pore diameter filter out TiOPc particles, which can be used for the CGL, as well as coarse particles to be removed. In addition, such filters cause problems in that filtering takes a long time, the filters are clogged with particles, and an excessive stress is applied to the pump used. Therefore, a filter with a proper pore diameter is preferably used. Needless to say, the filter preferably has good resistance to the solvent used for the dispersion.

The CTL 37 is typically prepared by coating a coating liquid, which is prepared by dissolving or dispersing a CTM in a solvent optionally together with a binder resin, followed by drying. If desired, additives such as plasticizers, leveling agents and antioxidants can be added to the coating liquid.

The CTM includes a positive-hole transport material and an electron transport material. Specific examples of the positive-hole transport material include, but are not limited to, known materials such as poly-N-carbazole and its derivatives, poly-γ-carbazolyl ethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, etc. These CTMs can be used alone or in combination.

Specific examples of the electron transport material include, but are not limited to, electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives, etc.

Specific examples of the binder resin for use in the CTL include, but are not limited to, known thermoplastic resins and thermosetting resins, such as polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, polyvinylidene chloride, polyarylate, a phenoxy resin, polycarbonate, a cellulose acetate resin, an ethyl cellulose resin, s polyvinyl butyral resin, a polyvinyl formal resin, polyvinyl toluene, poly-N-vinyl carbazole, an acrylic resin, a silicone resin, an epoxy resin, a melamine resin, a urethane resin, a phenolic resin and an alkyd resin.

The CTL preferably includes the CTM in an amount of from 20 to 300 parts by weight, and more preferably from 40 to 150 parts by weight, per 100 parts by weight of the binder resin included in the CTL. The thickness of the CTL is preferably from 5 to 100 μm.

Suitable solvents for use in the CTL coating liquid include, but are not limited to, tetrahydrofuran, dioxane, toluene, dichloromethane, monochlorobenzene, dichloroethane, cyclohexanone, methyl ethyl ketone, acetone and the like solvents. However, in view of environmental protection, non-halogenated solvents are preferably used. Specifically, cyclic ethers such as tetrahydrofuran, dioxolan and dioxane, aromatic hydrocarbons such as toluene and xylene, and their derivatives are preferably used.

The CTL may include additives such as plasticizers and leveling agents. Specific examples of the plasticizers include, but are not limited to, known plasticizers such as dibutyl phthalate and dioctyl phthalate. The content of the plasticizer in the CTL is from 0 to 30% by weight based on the total weight of the binder resin included in the CTL. Specific examples of the leveling agents include, but are not limited to, silicone oils such as a dimethyl silicone oil and a methyl phenyl silicone oil, and polymers and oligomers including a perfluoroalkyl group in their side chain. The CTL preferably includes the leveling agent of from 0 to 1% by weight based on the total weight of the binder resin included in the CTL.

As mentioned above, the transit time of the photoreceptor typically depends on the carrier transportability of the CTL. A method of controlling the transit time is explained.

The transit time is a time for a photo carrier generated in the CGL to be injected into the CTL, pass the CTL and erase the surface charge. The time to be injected into the CTL and erase the surface charge is so short compared with the time to pass the CTL that it is ignorable. Roughly speaking, the transit time is a time for a photocarrier to pass the CTL.

Controlling the time is controlling the passing speed of the carrier and travel distance thereof. The former depends on the composition and materials of the CTL, and the latter depends on the thickness thereof.

The composition of the CTL includes a CTM, a binder resin, a concentration of the CTM and an additive. Particularly, the CTM, the concentration thereof and the binder resin are essential. Typically, a CTM having high transportability can shorten the transit time. A binder resin having a small polarity or charge transport polymer material can shorten the transit time. A CTM having a high concentration can shorten the transit time. A CTL having a thin thickness can shorten the transit time.

However, when a CTL is located at the surface, the CTL cannot be designed only for shortening the transit time. For example, when the concentration of the CTM in the CTL is increased to the maximum, the abrasion resistance thereof extremely deteriorates, resulting in short life of the resultant photoreceptor although the transit time becomes short. When the CTL has extremely a thin thickness, an insulation breakdown and background fouling of the resultant images are more liable to occur.

Therefore, after a CTL is formed using the above-mentioned materials, the transit time is measured by the method disclosed Published Unexamined Japanese Patent Application No. 2000-275872 to optimize the transit time.

A protection layer is effectively formed on the surface of the photoreceptor, with the carrier transport speed in a CTL the highest priority. The abrasion resistance of the CTL can be ignored and only the carrier transport speed therein can be focused.

The photoreceptor for use in the present invention optionally includes a protection layer, which is formed on the photosensitive layer to protect the photosensitive layer. Recently, computers are used in daily life, and therefore a need exists for a high-speed and small-sized printer. By forming a protection layer on the photosensitive layer, the resultant photoreceptor has good durability while having a high photosensitivity and producing images without abnormal images.

The protection layers for use in the present invention are classified into two types, one of which is a layer including a binder resin and a filler dispersed in the binder resin and the other of which is a layer including a crosslinked binder resin.

At first, the protection layer of the first type will be explained.

Specific examples of the material for use in the protection layer include, but are not limited to, an ABS resin, an ACS resins, an olefin-vinyl monomer copolymer, chlorinated polyether, an aryl resin, a phenolic resin, polyacetal, polyamide, polyamideimide, polyallylsulfone, polybutylene, polybutyleneterephthalate, polycarbonate, polyarylate, polyethersulfone, polyethylene, polyethyleneterephthalate, polyimide, an acrylic resin, polymethylpentene, polypropylene, polyphenyleneoxide, polysulfone, polystyrene, an AS resin, a butadiene-styrenecopolymer, polyurethane, polyvinyl chloride, polyvinylidene chloride, an epoxy resin, etc. Among these resins, polycarbonate and polyarylate are most preferably used.

In addition, in order to improve the abrasion resistance of the protection layer, fluorine-containing resins such as polytetrafluoroethylene, and silicone resins can be used therefor. Further, materials in which such resins as mentioned above are mixed with an inorganic filler such as titanium oxide, aluminum oxide, tin oxide, zinc oxide, zirconium oxide, magnesium oxide, potassium titanate and silica or an organic filler can also be used therefor.

Suitable organic fillers for use in the protection layer include, but are not limited to, powders of fluorine-containing resins such as polytetrafluoroethylene, silicone resin powders, amorphous carbon powders, etc. Specific examples of the inorganic fillers for use in the protection layer include, but are not limited to, powders of metals such as copper, tin, aluminum and indium; metal oxides such as alumina, silica, tin oxide, zinc oxide, titanium oxide, alumina, zirconia, indium oxide, antimony oxide, bismuth oxide, calcium oxide, tin oxide doped with antimony, indium oxide doped with tin; potassium titanate, etc. In view of hardness, the inorganic fillers are preferable, and in particular, silica, titanium oxide and alumina are effectively used.

The content of the filler in the protection layer is preferably determined depending on the species of the filler used and the application of the resultant photoreceptor, but the content of a filler in the surface part of the protection layer is preferably not less than 5% by weight, more preferably from 10 to 50% by weight, and even more preferably from 10 to 30% by weight, based on the total weight of the surface part of the protection layer. The filler included in the protection layer preferably has a volume average particle diameter of from 0.1 to 2 μm, and more preferably from 0.3 to 1 μm. When the average particle diameter is too small, good abrasion resistance cannot be imparted to the resultant photoreceptor. In contrast, when the average particle diameter is too large, the surface of the resultant protection layer is seriously roughened or a problem that a protection layer itself cannot be formed occurs.

In the present invention, the average particle diameter of a filler means a volume average particle diameter unless otherwise specified, and is measured using an instrument, CAPA-700 manufactured by Horiba, Ltd. In this case, the cumulative 50% particle diameter (i.e., the median particle diameter) is defined as the average particle diameter. In addition, it is preferable that the standard deviation of the particle diameter distribution curve of the filler used in the protection layer is not greater than 1 μm. When the standard deviation is too large (i.e., when the filler has too broad particle diameter distribution), the effect of the present invention cannot be produced.

The pH of the filler used in the protection layer coating liquid largely influences the dispersibility of the filler therein and the resolution of the images produced by the resultant photoreceptor. The reasons therefor are as follows. Fillers (in particular, metal oxides) typically include hydrochloric acid therein which is used when the fillers are produced. When the amount of residual hydrochloric acid is large, the resultant photoreceptor tends to produce blurred images. In addition, inclusion of too large an amount of hydrochloric acid causes the dispersibility of the filler to deteriorate.

Another reason therefor is that the charge properties of fillers (in particular, metal oxides) are largely influenced by the pH of the fillers. In general, particles dispersed in a liquid are charged positively or negatively. In this case, ions having a charge opposite to the charge of the particles gather around the particles to neutralize the charge of the particles, resulting in formation of an electric double layer, and thereby the particles are stably dispersed in the liquid. The potential (i.e., zeta potential) of a point around one of the particles decreases (i.e., approaches to zero) as the distance between the point and the particle increases. Namely, a point far apart from the particle is electrically neutral, i.e., the zeta potential thereof is zero. In this case, the higher the zeta potential, the better the dispersion of the particles. When the zeta potential is nearly equal to zero, the particles easily aggregate (i.e., the particles are unstably dispersed). The zeta potential of a system largely depends on the pH of the system. When the system has a certain pH, the zeta potential becomes zero. This pH point is called an isoelectric point. It is preferable to increase the zeta potential by setting the pH of the system to be far apart from the isoelectric point, in order to enhance the dispersion stability of the system.

It is preferable for the protection layer to include a filler having an isoelectric point at a pH of 5 or more, in order to prevent formation of blurred images. In other words, fillers having a highly basic property can be preferably used in the photoreceptor of the present invention because the effect of the present invention can be heightened. Fillers having a highly basic property have a high zeta potential (i.e., the fillers are stably dispersed) when the system for which the fillers are used is acidic.

In this application, the pH of a filler means the pH of the filler at the isoelectric point, which is determined by the zeta potential of the filler. Zeta potential can be measured by a laser beam potential meter manufactured by Otsuka Electronics Co., Ltd.

In addition, in order to prevent production of blurred images, fillers having a high electric resistance (i.e., not less than $1\times10^{10}\Omega\cdot$cm in resistivity) are preferably used. Further, fillers having a pH of not less than 5 and fillers having a dielectric constant of not less than 5 can be more preferably used. Fillers having a dielectric constant of not less than 5 and/or a pH of not less than 5 can be used alone or in combination. In addition, combinations of a filler having a pH of not less than 5 and a filler having a pH of less than 5, or combinations of a filler having a dielectric constant of not less than 5 and a filler having a dielectric constant of less than 5, can also be used. Among these fillers, α-alumina having a closest packing structure is preferably used. This is because α-alumina has a high insulating property, a high heat stability and a good abrasion resistance, and thereby formation of blurred images can be prevented and abrasion resistance of the resultant photoreceptor can be improved.

Figure 1:
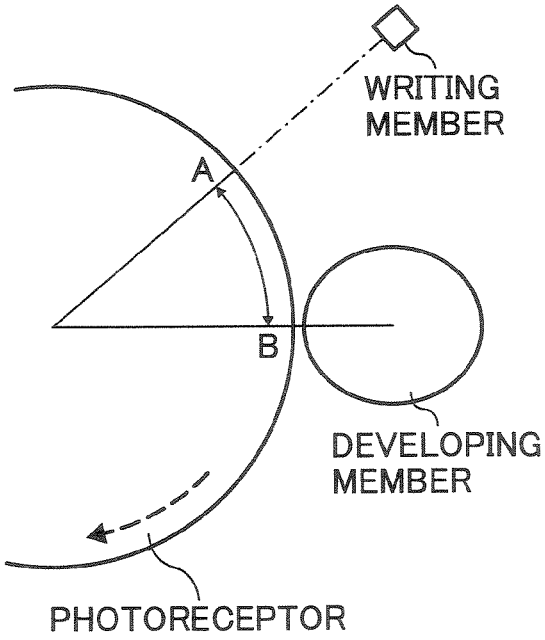
FIG. 1 is a schematic view for explaining an irradiation-development time in an image forming apparatus.
Figure 2:
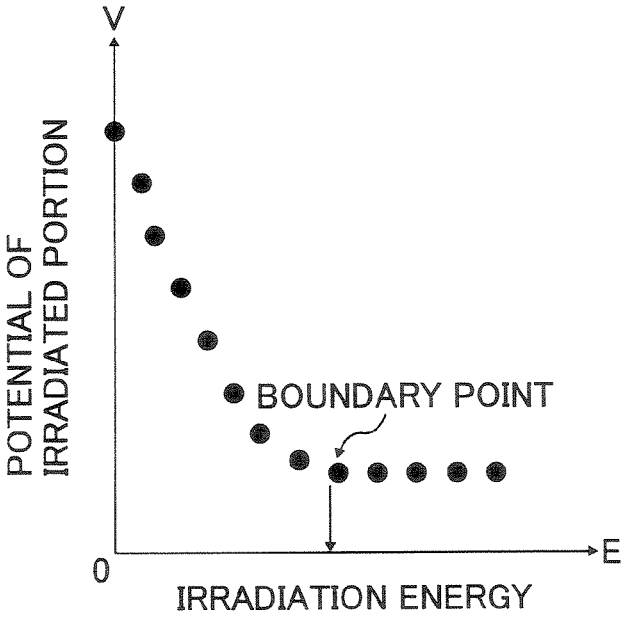
FIG. 2 is a graph showing a light attenuation property of a photoreceptor.

In the present invention, the resistivity of a filler is defined as follows. The resistivity of a powder such as fillers largely changes depending on the filling factor of the powder when the resistivity is measured. Therefore, it is necessary to measure the resistivity under a constant condition. In the present application, the resistivity is measured by a device similar to the devices disclosed in FIG. 1 of JP 5-113688. The surface area of the electrodes of the device is 4.0 $cm^2$. Before the resistivity of a sample powder is measured, a load of 4 kg is applied to one of the electrodes for 1 minute and the amount of the sample powder is adjusted such that the distance between the two electrodes becomes 4 mm. The resistivity of the sample powder is measured by pressing the sample powder only by the weight (i.e., 1 kg) of the upper electrode without applying any other load to the sample. The voltage applied to the sample powder is 100 V. When the resistivity is not less than $10^6\Omega\cdot$cm, HIGH RESISTANCEMETER (from Yokogawa Hewlett-Packard Co.) is used to measure the resistivity. When the resistivity is less than 106Ω Ω·cm, a digital multimeter (from Fluke Corp.) is used.

The dielectric constant of a filler is measured as follows. A cell similar to that used for measuring the resistivity is also used for measuring the dielectric constant. After a load is applied to a sample powder, the capacity of the sample powder is measured using a dielectric loss measuring instrument (from Ando Electric Co., Ltd.) to determine the dielectric constant of the powder.

The fillers to be included in the protection layer are preferably subjected to a surface treatment using a surface treatment agent in order to improve the dispersion of the fillers in the protection layer. When a filler is poorly dispersed in the protection layer, the following problems occur:

(1) the residual potential of the resultant photoreceptor increases;

(2) the transparency of the resultant protection layer decreases;

(3) coating defects are formed in the resultant protection layer;

(4) the abrasion resistance of the protection layer deteriorates;

(5) the durability of the resultant photoreceptor deteriorates; and (6) the image qualities of the images produced by the resultant photoreceptor deteriorate.

Suitable surface treatment agents include known surface treatment agents. However, surface treatment agents which can maintain the highly insulating property of the fillers used are preferably used. As for the surface treatment agents, titanate coupling agents, aluminum coupling agents, zircoaluminate coupling agents, higher fatty acids, combinations of these agents with a silane coupling agent, $Al_2O_3$, $TiO_2$, $ZrO_2$, silicones, aluminum stearate, and the like, can be preferably used to improve the dispersibility of fillers and to prevent formation of blurred images. These materials can be used alone or in combination. When fillers treated with a silane coupling agent are used, the resultant photoreceptor tends to produce blurred images. However, combinations of a silane coupling agent with one of the surface treatment agents mentioned above can often produce good images without blurring. The coating weight of the surface treatment agents is preferably from 3 to 30% by weight, and more preferably from 5 to 20% by weight, based on the weight of the filler to be treated, although the weight is determined depending on the average primary particle diameter of the filler. When the content of the surface treatment agent is too low, the dispersibility of the filler cannot be improved. In contrast, when the content is too high, the residual potential of the resultant photoreceptor seriously increases.

These fillers can be dispersed using a proper dispersion machine. In this case, the fillers are preferably dispersed such that the aggregated particles are dissociated and primary particles of the fillers are dispersed, to improve the transparency of the resultant protection layer.

In addition, a CTM can be included in the protection layer to enhance the photo response and to reduce the residual potential of the resultant photoreceptor. The CTMs mentioned above for use in the charge transport layer can also be used for the protection layer. When a low-molecular-weight CTM is used for the protection layer, the concentration of the CTM may be changed in the thickness direction of the protection layer. Specifically, it is preferable to reduce the concentration of the CTM at the surface part of the protection layer in order to improve the abrasion resistance of the resultant photoreceptor. At this point, the concentration of the CTM means the ratio of the weight of the low-molecular-weight CTM to the total weight of the protection layer. Further, a charge transport polymer material is very effectively used to improve the durability (abrasion resistance) and high-speed charge transportability of the resultant photoreceptor. The filler dispersed in the protection layer does not affect the transit time much, which depends on the carrier transport speed in the part of binder resin+CTM.

The protection layer can be formed by any known coating methods. The thickness of the protection layer is preferably from 0.1 to 10 μm.

Next, a crosslinked protection layer will be explained. The crosslinked protection layer is preferably prepared by subjecting a reactive monomer having plural crosslinkable functional groups in a molecule to a crosslinking reaction upon application of light or heat thereto. By forming a protection layer having such a three-dimensional network, the photoreceptor has good abrasion resistance.

In order to prepare the above-mentioned protection layer, monomers having a charge transportable moiety in the entire part or a part thereof are preferably used. By using such monomers, the resultant protection layer has the charge transport moiety in the three-dimensional network. Therefore, the CTL can fully exercise a charge transport function. Among the monomers, monomers having a triarylamine structure are preferably used. Thus, the carrier transport speed is increased to shorten the transit time.

The protection layer having such a three-dimensional structure has good abrasion resistance but often forms a crack therein if the layer is too thick. In order to prevent occurrence of such a cracking problem, a multilayer protection layer in which a crosslinked protection layer is formed on a protection layer in which a low molecular weight CTM is dispersed in a polymer can be used.

The crosslinked protection layer having a charge transport structure is preferably prepared by reacting and crosslinking a radical polymerizable tri- or more-functional monomer having no charge transport structure and a radical polymerizable monofunctional compound having a charge transport structure. This protection layer has high hardness and high elasticity because of having a well-developed three dimensional network and a high crosslinking density. In addition, since the surface of the protection layer is uniform and smooth, the protection layer has good abrasion resistance and scratch resistance. Although it is important to increase the crosslinking density of the protection layer, a problem in that the protection layer has a high internal stress due to the occurrence of shrinkage in the crosslinking reaction. The internal stress increases as the thickness of the protection layer increases. Therefore, when a thick protection layer is crosslinked, problems occur in that the protection layer is cracked and peels. Even though these problems are not caused when a photoreceptor is new, the problems are easily caused when the photoreceptor receives various stresses after being repeatedly subjected to charging, developing, transferring and cleaning.

In order to prevent occurrence of the problems, the following techniques can be used:

(1) a polymeric component is added to the crosslinked protection layer;

(2) a large amount of mono- or di-functional monomers are used for forming the crosslinked protection layer; and (3) a polyfunctional monomer having a group capable of imparting softness to the resultant crosslinked protection layer is used for forming the crosslinked protection layer. However, all the crosslinked protection layers prepared using these techniques have a low crosslinking density. Therefore, a good abrasion resistance cannot be imparted to the resultant protection layers. In contrast, the crosslinked protection layer of the photoreceptor for use in the present invention has a well-developed three-dimensional network, a high crosslinking density and a high charge transporting ability when having a thickness of from 1 to 10 μm. Therefore, the resultant photoreceptor has high abrasion resistance and hardly causes cracking and peeling problems. The thickness of the crosslinked protection layer is preferably from 2 to 8 μm. In this case, the margin for the above-mentioned problems can be improved and flexibility in choosing materials for forming a protection layer having a higher crosslinking density can be enhanced.

The reasons why the photoreceptor for use in the present invention hardly causes the cracking and peeling problems are as follows:

(1) a relatively thin crosslinked protection layer having a charge transport structure is formed and thereby increase of internal stress of the photoreceptor can be prevented; and (2) since a CTL is formed below the crosslinked protection layer having a charge transport structure, the internal stress of the crosslinked protection layer can be relaxed. Therefore, it is not necessary to increase the amount of polymer components in the protection layer. Accordingly, the occurrence of problems in that the protection layer is scratched or a film (such as a toner film) is formed on the protection layer, which is caused by incomplete mixing of polymer components and the crosslinked material formed by reaction of radical polymerizable monomers, can be prevented. In addition, when a protection layer is crosslinked by irradiating light, a problem occurs in that the inner part of the protection layer is incompletely reacted because the charge transport moieties absorb light if the protection layer is too thick. However, since the protection layer of the photoreceptor for use in the present invention has a thickness of not greater than 10 μm, the inner part of the protection layer can be completely crosslinked and thereby a good abrasion resistance can be imparted to the entire protection layer. Further, since the crosslinked protection layer is prepared using a monofunctional monomer having a charge transport structure, the monofunctional monomer is incorporated in the crosslinking bonds formed by one or more tri- or more-functional monomers. When a crosslinked protection layer is formed using a low molecular weight CTM having no functional group, a problem occurs in that the low molecular weight CTM is separated from the crosslinked resin, resulting in precipitation of the low molecular weight CTM and formation of a clouded protection layer, and thereby the mechanical strength of the protection layer is deteriorated. When a crosslinked protection layer is formed using di- or more-functional charge transport compounds as main components, the resultant protection layer is seriously distorted, resulting in increase of internal stress, because the charge transfer moieties are bulky, although the protection layer has a high crosslinking density.

Further, the photoreceptor of the present invention has good electric properties, good stability, and high durability. This is because the crosslinked protection layer has a structure in that a unit obtained from a monofunctional monomer having a charge transport structure is connected with the crosslinking bonds like a pendant. In contrast, the protection layer formed using a low molecular weight CTM having no functional group causes the precipitation and clouding problems, and thereby the photosensitivity of the photoreceptor is deteriorated and residual potential of the photoreceptor is increased (i.e., the photoreceptor has poor electric properties). In addition, in the crosslinked protection layer formed using di- or more-functional charge transport compounds as main components, the charge transport moieties are fixed in the crosslinked network, and thereby charges are trapped, resulting in deterioration of photosensitivity and increase of residual potential. When such electric properties of a photoreceptor are deteriorated, problems occur in that the resultant images have low image density and character images are narrowed. Since a CTL having a high mobility and few charge traps can be formed as the CTL of the photoreceptor of the present invention, the production of side effects in electric properties of the photoreceptor can be prevented even when the crosslinked protection layer is formed on the CTL.

Further, the crosslinked protection layer of the present invention is insoluble in organic solvents and typically has an excellent abrasion resistance. The crosslinked protection layer prepared by reacting a tri- or more-functional polymerizable monomer having no charge transport structure with a monofunctional monomer having a charge transport structure has a well-developed three-dimensional network and a high crosslinking density. However, in a case where materials (such as mono- or di-functional monomers, polymer binders, antioxidants, leveling agents, and plasticizers) other than the above-mentioned polymerizable monomers are added and/or the crosslinking conditions are changed, problems in that the crosslinking density of the resultant protection layer is locally low and the resultant protection layer is constituted of aggregates of minute crosslinked material having a high crosslinking density tend to occur. Such a crosslinked protection layer has poor mechanical strength and poor resistance to organic solvents. Therefore, when the photoreceptor is repeatedly used, a problem occurs in that apart of the protection layer is seriously abraded or is released from the protection layer. In contrast, the crosslinked protection layer for use in the present photoreceptor has high molecular weight and good solvent resistance because of having a well-developed three dimensional network and a high crosslinking density. Therefore, the resultant photoreceptor has excellent abrasion resistance and does not cause the above-mentioned problems.

Next, the constituents of the coating liquid for forming the crosslinked protection layer having a charge transport structure will be explained.

The tri- or more-functional monomers having no charge transport structure mean monomers which have three or more radical polymerizable groups and which do not have a charge transport structure (such as a positive hole transport structure (e.g., triarylamine, hydrazone, pyrazoline and carbazole structures); and an electron transport structure (e.g., condensed polycyclic quinine structure, diphenoquinone structure, a cyano group and a nitro group)). As the radical polymerizable groups, any radical polymerizable groups having a carbon-carbon double bond can be used. Suitable radical polymerizable groups include, but are not limited to, 1-substituted ethylene groups and 1,1-disubstituted ethylene groups having the following formulae, respectively.

1-Substituted Ethylene Groups $$CH_2{=}CH{-}X_1{-}$$

wherein $X_1$ represents an arylene group (such as a phenylene group and a naphthylene group), which optionally has a substituent, a substituted or unsubstituted alkenylene group, a —CO— group, a —COO— group, a —CON($R^{10}$) group (wherein $R^{10}$ represents a hydrogen atom, an alkyl group (e.g., a methyl group, and an ethyl group), an aralkyl group (e.g., a benzyl group, a naphthylmethyl group and a phenetyl group), an aryl group (e.g., a phenyl group and a naphthyl group), or a —S— group.

Specific examples of the groups having the formula include, but are not limited to, a vinyl group, a styryl group, 2-methyl-1,3-butadienyl group, a vinylcarbonyl group, acryloyloxy group, acryloylamide, vinyl thioether, etc.

1,1-disubstituted Ethylene Groups $$CH_2{=}C(Y){-}X_2{-}$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), a —$COOR^{11}$ group (wherein $R^{11}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups)) or a —$CONR^{12}R^{13}$ group (wherein each of $R^{12}$ and $R^{13}$ independently represents a hydrogen atom, a substituted or unsubstituted alkyl group (such as methyl and ethyl groups), a substituted or unsubstituted aralkyl group (such as benzyl, naphthylmethyl and phenethyl groups), or a substituted or unsubstituted aryl group (such as phenyl and naphthyl groups)); and $X_2$ represents a group selected from the groups mentioned above for use in $X_1$ and an alkylene group, wherein at least one of Y and $X_2$ is an oxycarbonyl group, a cyano group, an alkenylene group or an aromatic group.

Specific examples of the groups having formula (XI) include, but are not limited to, an α-chloroacryloyloxy group, a methacryloyloxy group, an α-cyanoethylene group, an α-cyanoacryloyloxy group, an α-cyanophenylene group, a methacryloyl amino group, etc.

Specific examples of the substituents for use in the groups $X_1$, $X_2$ and Y include, but are not limited to, halogen atoms, a nitro group, a cyano group, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), etc.

Among these radical polymerizable tri- or more-functional groups, acryloyloxy groups and methacryloyloxy groups having three or more functional groups are preferably used. Compounds having three or more acryloyloxy groups can be prepared by subjecting (meth) acrylic acid (salts), (meth) acrylhalides and (meth)acrylates, which have three or more hydroxyl groups, to an ester reaction or an ester exchange reaction. The three or more radical polymerizable groups included in a radical polymerizable tri- or more-functional monomer are the same as or different from the others therein.

Specific examples of the radical polymerizable tri- or more-functional monomer include, but are not limited to, trimethylolpropane triacrylate (TMPTA), trimethylolpropane trimethacrylate, trimethylolpropane alkylene-modified triacrylate, trimethylolpropane ethyleneoxy-modified triacrylate, trimethylolpropane propyleneoxy-modified triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified triacrylate, glycerol ethyleneoxy-modified triacrylate, glycerol propyleneoxy-modified triacrylate, tris(acryloxyethyl)isocyanurate, dipentaerythritol hexaacrylate (DPHA), dipentaerythritol caprolactone-modified hexaacrylate, dipentaerythritol hydroxypentaacrylate, alkylated dipentaerythritol tetraacrylate, alkylated dipentaerythritol triacrylate, dimethylolpropane tetraacrylate (DTMPTA), pentaerythritol ethoxy triacrylate, ethyleneoxy-modified triacryl phosphate, 2,2,5,5-tetrahydroxymethylcyclopentanone tetraacrylate, etc. These monomers are used alone or in combination.

In order to form a dense crosslinked network in the crosslinked protection layer, the ratio (Mw/F) of the molecular weight (Mw) of the tri- or more-functional monomer to the number of functional groups (F) included in a molecule of the monomer is preferably not greater than 250. When the number is too large, the resultant protective becomes soft and thereby the abrasion resistance of the layer slightly deteriorates. In this case, it is not preferable to use only one monomer having a functional group having a long chain group such as ethylene oxide, propylene oxide and caprolactone. The content of the unit obtained from the tri- or more-functional monomers in the crosslinked protection layer is preferably from 20 to 80% by weight, and more preferably from 30 to 70% by weight based on the total weight of the protection layer. When the content is too low, the three dimensional crosslinking density is low, and thereby good abrasion resistance cannot be imparted to the protection layer. In contrast, when the content is too high, the content of the charge transport compound decreases, and good charge transport property cannot be imparted to the protection layer. In order to balance the abrasion resistance and charge transport property of the crosslinked protection layer, the content of the unit obtained from the tri- or more-functional monomers in the protection layer is preferably from 30 to 70% by weight.

Suitable radical polymerizable monofunctional compounds having a charge transport structure for use in preparing the crosslinked protection layer include, but are not limited to, compounds having one radical polymerizable functional group and a charge transport structure such as positive hole transport groups (e.g., triarylamine, hydrazone, pyrazoline and carbazole structures) and electron transport groups (e.g., electron accepting aromatic groups such as condensed polycyclic quinine structure, diphenoquinone structure, and cyano and nitro groups). As the functional group of the radical polymerizable monofunctional compounds, acryloyloxy and methacryloyloxy groups are preferably used. Among the charge transport groups, triarylamine groups are preferably used. Among the compounds having a triarylamine group, compounds having the following formula (1) or (2) are preferably used because of having good electric properties (i.e., high photosensitivity and low residual potential).

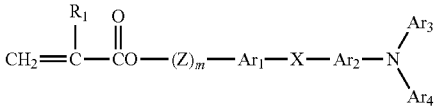

(1)

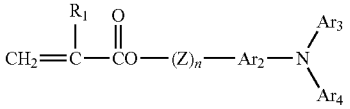

(2)

wherein $R_1$ represents a hydrogen atom, a halogen atom, a substituted or an unsubstituted alkyl group, a substituted or an unsubstituted aralkyl group, a substituted or an unsubstituted aryl group, a cyano group, a nitro group, an alkoxy group, —$COOR_7$ wherein $R_7$ represents a hydrogen atom, a halogen atom, a substituted or an unsubstituted alkyl group, a substituted or an unsubstituted aralkyl group and a substituted or an unsubstituted aryl group and a halogenated carbonyl group or $CONR_8R_9$, wherein each of $R_8$ and $R_9$ independently represent a hydrogen atom, a halogen atom, a substituted or an unsubstituted alkyl group, a substituted or an unsubstituted aralkyl group and a substituted or an unsubstituted aryl group; $Ar_1$ and $Ar_2$ each, independently, represent a substituted or an unsubstituted arylene group; $Ar_3$ and $Ar_4$ each, independently, represent a substituted or an unsubstituted aryl group; X represents a single bond, a substituted or an unsubstituted alkylene group, a substituted or an unsubstituted cycloalkylene group, a substituted or an unsubstituted alkylene ether group, an oxygen atom, a sulfur atom and vinylene group; Z represents a substituted or an unsubstituted alkylene group, a substituted or an unsubstituted alkylene ether group and alkyleneoxycarbonyl group; and m and n represent 0 and an integer of from 1 to 3.

In the formulae (1) and (2), among substituted groups of $R_1$, the alkyl groups include, but are not limited to, methyl groups, ethyl groups, propyl groups, butyl groups, etc.; the aryl groups include, but are not limited to, phenyl groups, naphtyl groups, etc; aralkyl groups include, but are not limited to, benzyl groups, phenethyl groups, naphthylmethyl groups, etc.; and alkoxy groups include, but are not limited to, methoxy groups, ethoxy groups, propoxy groups, etc.

These may be substituted by alkyl groups such as halogen atoms, nitro groups, cyano groups, methyl groups and ethyl groups; alkoxy groups such as methoxy groups and ethoxy groups; aryloxy groups such as phenoxy groups; aryl groups such as phenyl groups and naphthyl groups; aralkyl groups such as benzyl groups and phenethyl groups.

The substituted group of $R_1$ is preferably a hydrogen atom or a methyl group.

$Ar_3$ and $Ar_4$ each, independently, represent a substituted or an unsubstituted aryl group, and specific examples thereof include, but are not limited to, condensed polycyclic hydrocarbon groups, non-condensed cyclic hydrocarbon groups and heterocyclic groups.

The condensed polycyclic hydrocarbon group is preferably a group having 18 or less carbon atoms forming a ring such as a fentanyl group, a indenyl group, a naphthyl group, an azulenyl group, a heptalenyl group, a biphenylenyl group, an indacenyl group, a fluorenyl group, an acenaphthylenyl group, a praadenyl group, an acenaphthenyl group, a phenalenyl group, a phenantolyl group, an anthryl group, a fluoranthenyl group, an acephenantolylenyl group, an aceanthrylenyl group, a triphenylel group, a pyrenyl group, a chrysenyl group and a naphthacenyl group.

Specific examples of the non-condensed cyclic hydrocarbon groups and heterocyclic groups include, but are not limited to, monovalent groups of monocyclic hydrocarbon compounds such as benzene, diphenylether, polyethylenediphenylether, diphenylthioether, and diphenylsulfone; monovalent groups of non-condensed hydrocarbon compounds such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene; and monovalent groups of ring gathering hydrocarbon compounds such as 9,9-diphenylfluorene.

Specific examples of the heterocyclic groups include monovalent groups such as carbazole, dibenzofuran, dibenzothiophene and oxadiazole.

Specific examples of the substituted or unsubstituted aryl group represented by $Ar_3$ and $Ar_4$ include, but are not limited to, the following groups:

(1) a halogen atom, a cyano group and a nitro group;

(2) a straight or a branched-chain alkyl group having 1 to 12, preferably from 1 to 8, and more preferably from 1 to 4 carbon atoms, and these alkyl groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkyl groups include, but are not limited to, methyl groups, ethyl groups, n-butyl groups, i-propyl groups, t-butyl groups, s-butyl groups, n-propyl groups, trifluoromethyl groups, 2-hydroxyethyl groups, 2-ethoxyethyl groups, 2-cyanoethyl groups, 2-methocyethyl groups, benzyl groups, 4-chlorobenzyl groups, 4-methylbenzyl groups, 4-phenylbenzyl groups, etc.

(3) alkoxy groups (—$OR_2$) wherein $R_2$ represents an alkyl group specified in (2). Specific examples thereof include, but are not limited to, methoxy groups, ethoxy groups, n-propoxy groups, i-propoxy groups, t-butoxy groups, s-butoxy groups, i-butoxy groups, 2-hydroxyethoxy groups, benzyloxy groups, trifluoromethoxy groups, etc.

(4) aryloxy groups, and specific examples of the aryl groups include, but are not limited to, phenyl groups and naphthyl groups. These aryl group may include an alkoxy group having 1 to 4 carbon atoms, an alkyl group having 1 to 4 carbon atoms or a halogen atom as a substituent. Specific examples of the aryloxy groups include, but are not limited to, phenoxy groups, 1-naphthyloxy groups, 2-naphthyloxy groups, 4-methoxyphenoxy groups, 4-methylphenoxy groups, etc.

(5) alkyl mercapto groups or aryl mercapto groups such as methylthio groups, ethylthio groups, phenylthio groups and p-methylphenylthio groups.

(6)

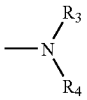

wherein $R_3$ and $R_4$ each, independently, represent a hydrogen atom, an alkyl groups specified in (2) and an aryl group, and specific examples of the aryl groups include, but are not limited to, phenyl groups, biphenyl groups and naphthyl groups, and these may include an alkoxy group having 1 to 4 carbon atoms, an alkyl group having 1 to 4 carbon atoms or a halogen atom as a substituent, and $R_3$ and $R_4$ may form a ring together. Specific examples of the groups having this formula include, but are not limited to, amino groups, diethylamino groups, N-methyl-N-phenylamino groups, N,N-diphenylamino groups, N—N-di(tolyl)amino groups, dibenzylamino groups, piperidino groups, morpholino groups, pyrrolidino groups, etc.

(7) a methylenedioxy group, an alkylenedioxy group such as a methylenedithio group or an alkylenedithio group (8) a substituted or an unsubstituted styryl group, a substituted or an unsubstituted β-phenylstyryl group, a diphenylaminophenyl group, a ditolylaminophenyl group, etc.

The arylene groups represented by $Ar_1$ and $Ar_2$ are derivative divalent groups from the aryl groups represented by $Ar_3$ and $Ar_4$ The above-mentioned X represents a single bond, a substituted or an unsubstituted alkylene group, a substituted or an unsubstituted cycloalkylene group, a substituted or an unsubstituted alkylene ether group, an oxygen atom, a sulfur atom and vinylene group.

The substituted or unsubstituted alkylene group is a straight or a branched-chain alkylene group having 1 to 12, preferably from 1 to 8, and more preferably from 1 to 4 carbon atoms, and these alkylene groups may further include a fluorine atom, a hydroxyl group, a cyano group, an alkoxy group having 1 to 4 carbon atoms, a phenyl group or a halogen atom, an alkyl group having 1 to 4 carbon atoms or a phenyl group substituted by an alkoxy group having 1 to 4 carbon atoms. Specific examples of the alkylene groups include, but are not limited to, methylene groups, ethylene groups, n-butylene groups, i-propylene groups, t-butylene groups, s-butylene groups, n-propylene groups, trifluoromethylene groups, 2-hydroxyethylene groups, 2-ethoxyethylene groups, 2-cyanoethylene groups, 2-methocyethylene groups, benzylidene groups, phenylethylene groups, 4-chlorophenyl ethylene groups, 4-methylphenylethylene groups, 4-biphenylethylene groups, etc.

The substituted or unsubstituted cycloalkylene group is a cyclic alkylene group having 5 to 7 carbon atoms, and these alkylene groups may include a fluorine atom, a hydroxyl group, a cyano group, an alkoxy group having 1 to 4 carbon atoms. Specific examples thereof include, but are not limited to, cyclohexylidine groups, cyclohexylene groups and 3,3-dimethylcyclohexylidine groups, etc.

Specific examples of the substituted or unsubstituted alkylene ether groups include, but are not limited to, ethylene oxy, propylene oxy, ethylene glycol, propylene glycol, diethylene glycol, tetraethylene glycol and tripropylene glycol, and the alkylene group of the alkylene ether group may include a substituent such as a hydroxyl group, a methyl group and an ethyl group.

The vinylene group has the following formula:

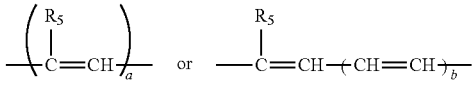

wherein $R_5$ represents a hydrogen atom, an alkyl group (same as those specified in (2)), an aryl group (same as those represented by $Ar_3$ and $Ar_4$); a represents 1 or 2; and b represents 1, 2 or 3.

Z represents a substituted or an unsubstituted alkylene group, a divalent substituted or an unsubstituted alkylene ether group and alkyleneoxycarbonyl group.

Specific examples of the substituted or unsubstituted alkylene group include those of X.

Specific examples of the divalent substituted or unsubstituted alkylene ether group include those of X.

Specific examples of the divalent alkyleneoxycarbonyl group include, but are not limited to, a divalent caprolactone-modified group.

In addition, the monofunctional radical polymerizing compound having a charge transport structure of the present invention is more preferably a compound having the following formula (3):

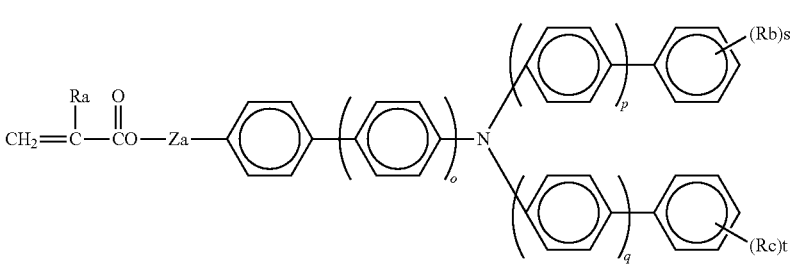

wherein o, p and q each, independently, represent 0 or 1; Ra represents a hydrogen atom or a methyl group; Rb and Rc each, independently, represents a substituent besides a hydrogen atom and an alkyl group having 1 to 6 carbon atoms, and may be different from each other when having plural carbon atoms; sand t represent 0 or an integer of from 1 to 3; Za represents a single bond, a methylene group, ethylene group,

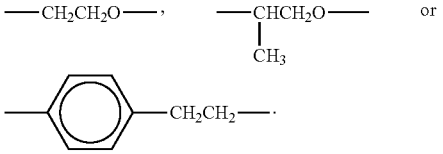

The compound having formula (3) is preferably a compound having a methyl group or a ethyl group as a substituent of Rb and Rc.

The monofunctional radical polymerizing compound having a charge transport structure of the formulae (1), (2) and particularly (3) for use in the present invention does not become an end structure because the carbon carbon double bonds is polymerized while opened to the both sides, and is built in a chain polymer. In a crosslinked polymer polymerized with a radical polymerizing monomer having three or more functional groups, the compound is present in a main chain and in a crosslinked chain between the main chains (the crosslinked chain includes an intermolecular crosslinked chain between a polymer and another polymer and an intramolecular crosslinked chain wherein a part having a folded main chain and another part originally from the monomer, which is polymerized with a position apart therefrom in the main chain are polymerized). Even when the compound is present in a main chain or a crosslinked chain, a triarylamine structure suspending from the chain has at least three aryl groups radially located from a nitrogen atom, is not directly bonded with the chain and suspends through a carbonyl group or the like, and is sterically and flexibly fixed although bulky. The triarylamine structures can spatially be located so as to be moderately adjacent to one another in a polymer, and has less structural distortion in a molecule. Therefore, it is supposed that the monofunctional radical polymerizing compound having a charge transport structure in a surface layer of an electrophotographic photoreceptor can have an intramolecular structure wherein blocking of a charge transport route is comparatively prevented.

Specific examples of the monofunctional radical polymerizing compound having a charge transport structure include compounds having the following formulae, but the compounds are not limited thereto.

No. 1

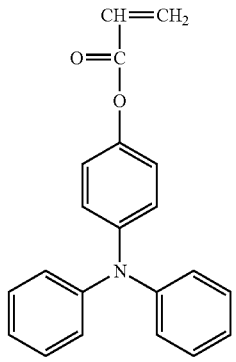

No. 2

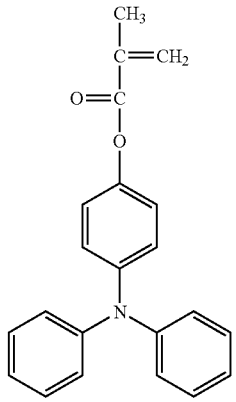

No. 3

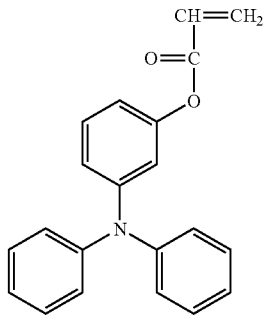

-continued
No. 4
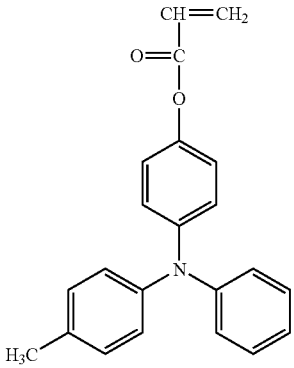
No. 5
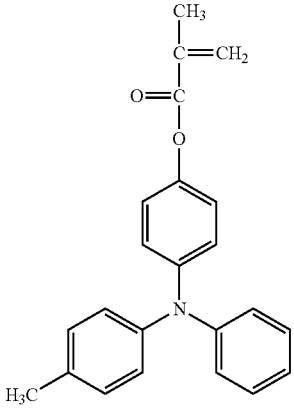
No. 6
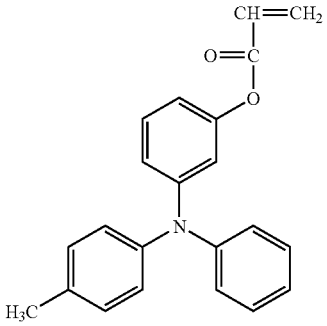
No. 7
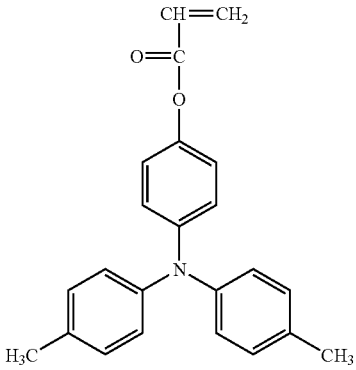
-continued
No. 8
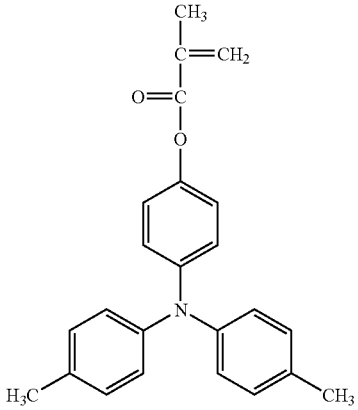
No. 9
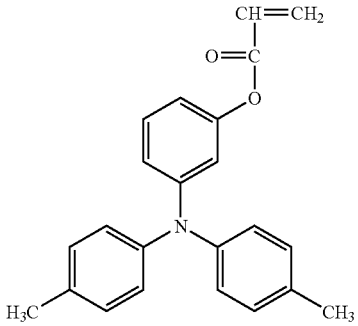
No. 10
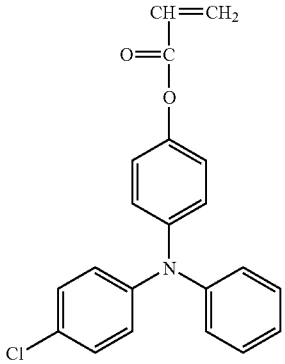
No. 11
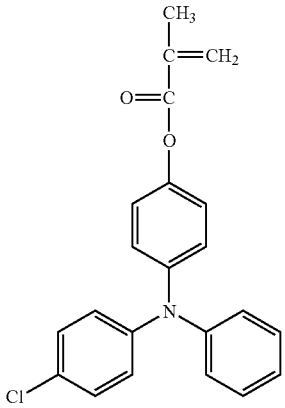

-continued
No. 12
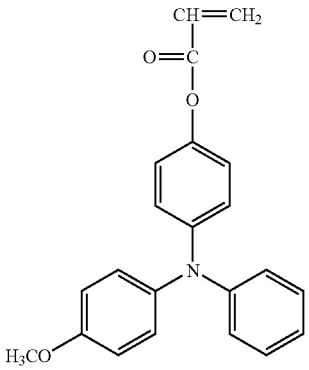
No. 13
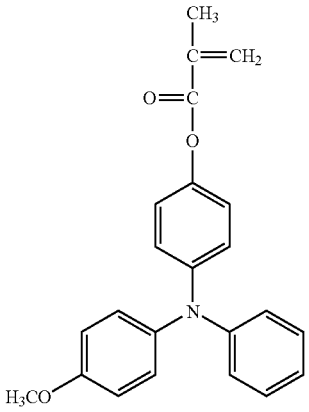
No. 14
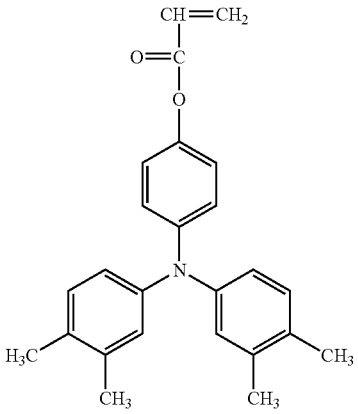
-continued
No. 15
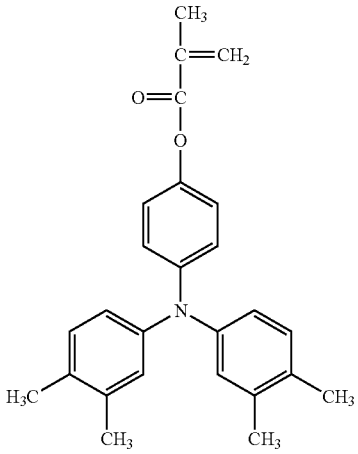
No. 16
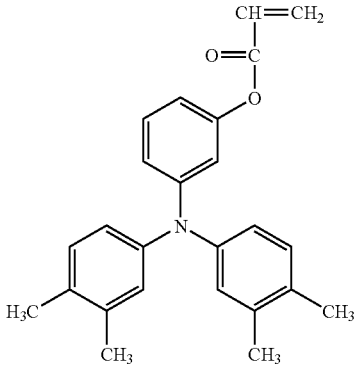
No. 17
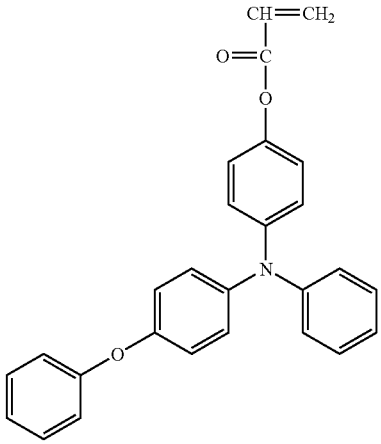

-continued
No. 18
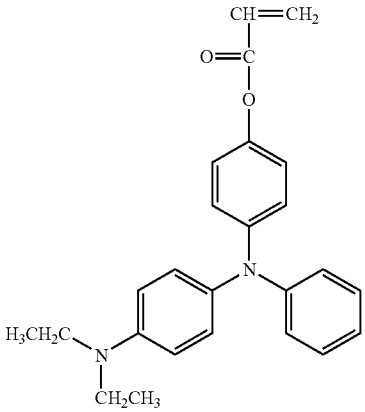
No. 19
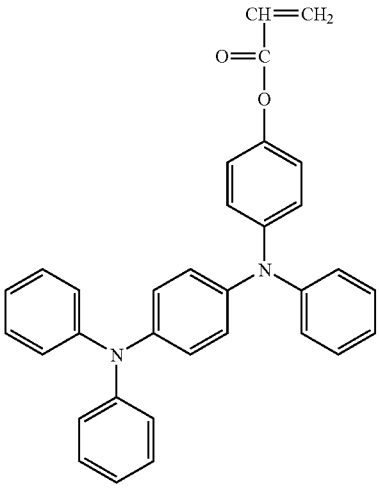
No. 20
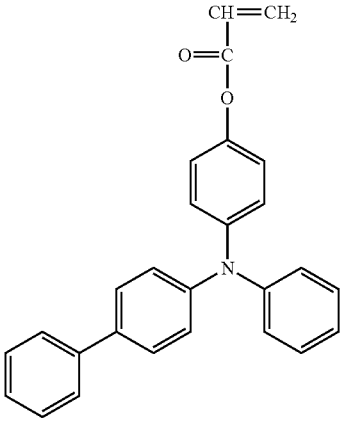
-continued
No. 21
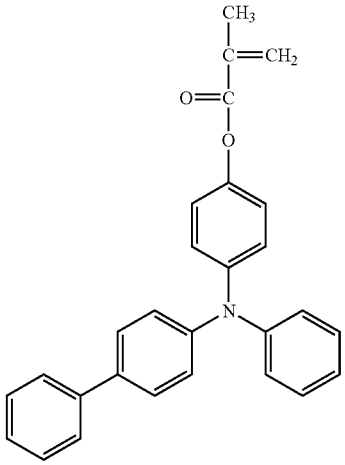
No. 22
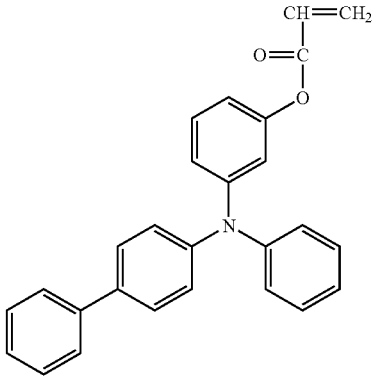
No. 23
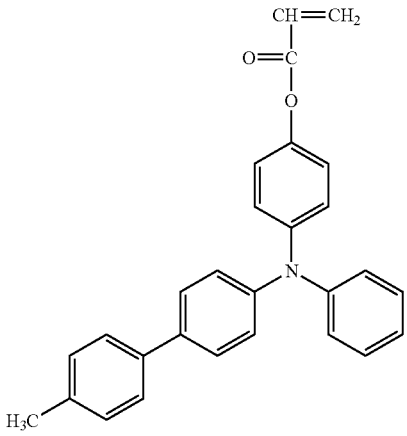

-continued
No. 24
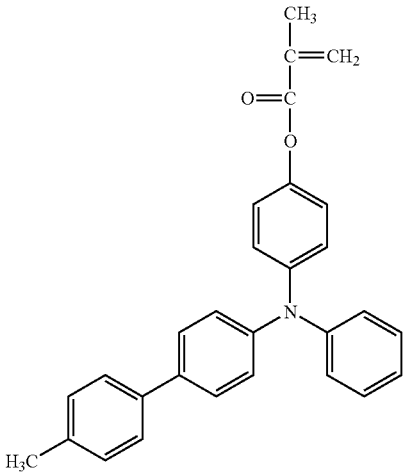
No. 25
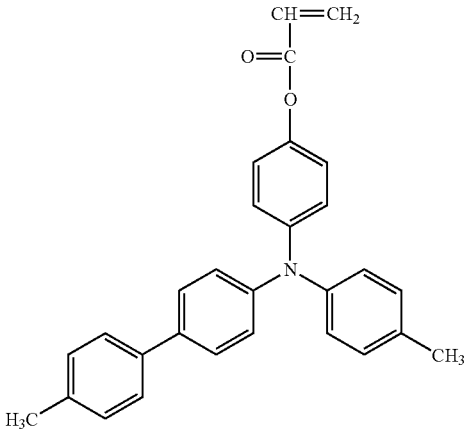
No. 26
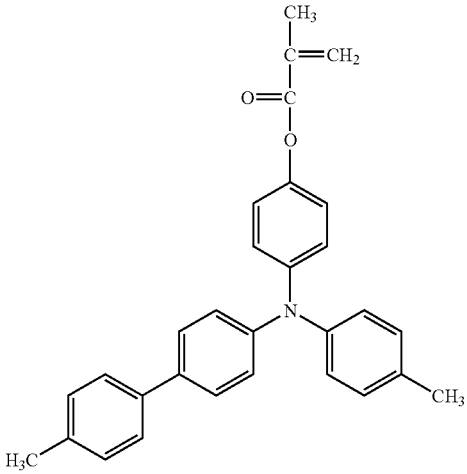
-continued
No. 27
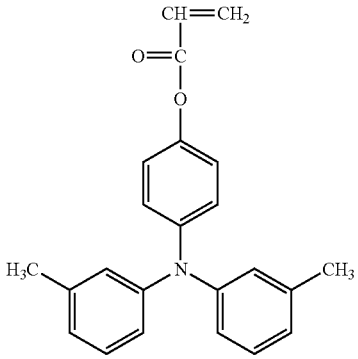
No. 28
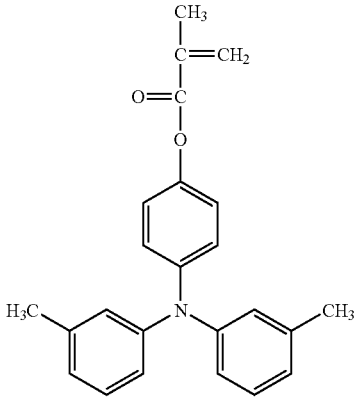
No. 29
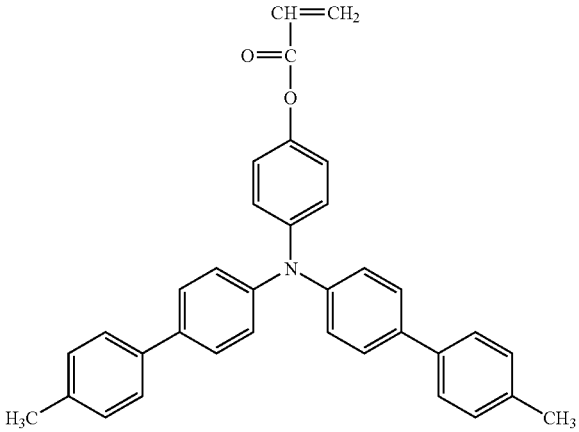
No. 30
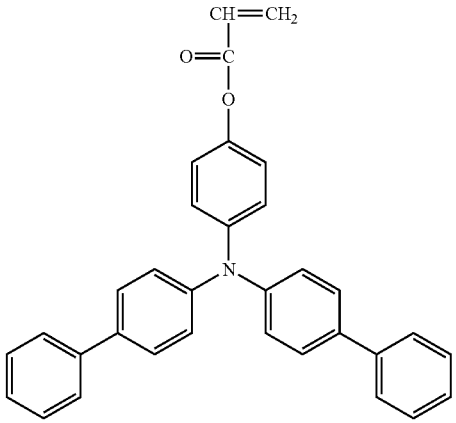

-continued
No. 31
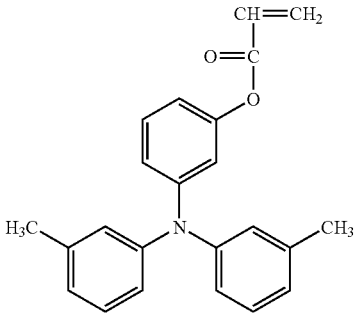
No. 32
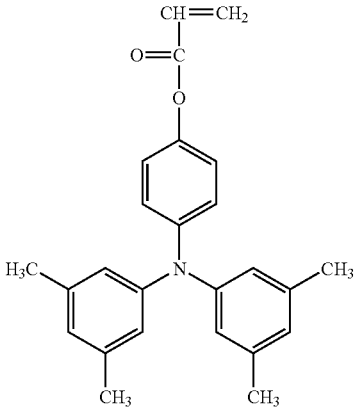
No. 33
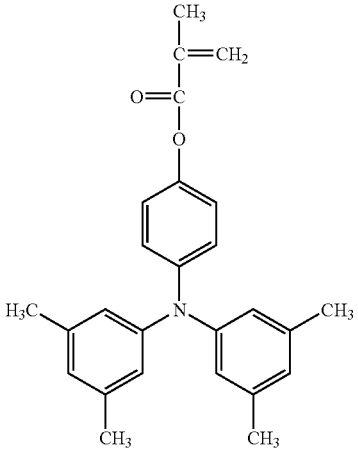
No. 34
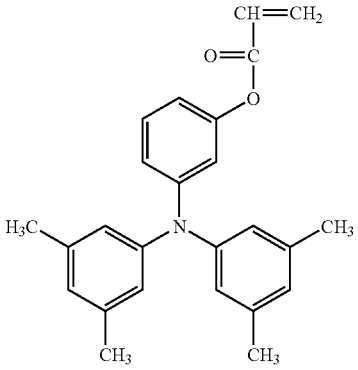
-continued
No. 35
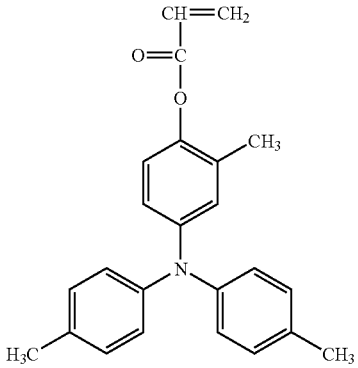
No. 36
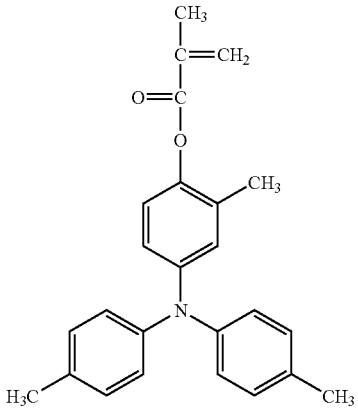
No. 37
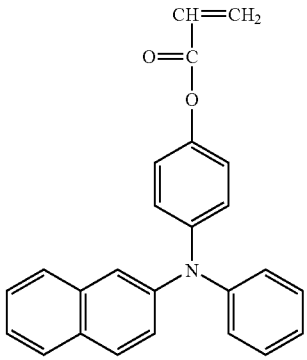
No. 38
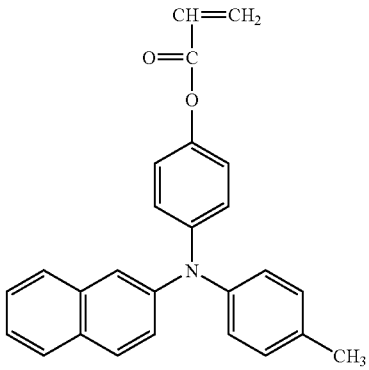

-continued
No. 39
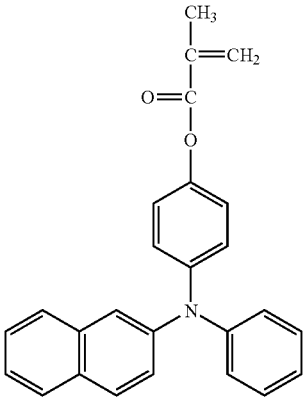
No. 40
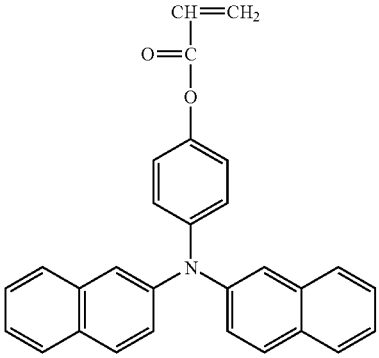
No. 41
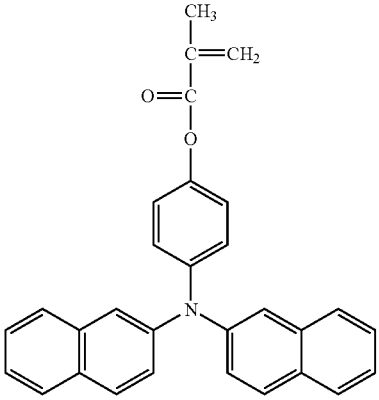
-continued
No. 42
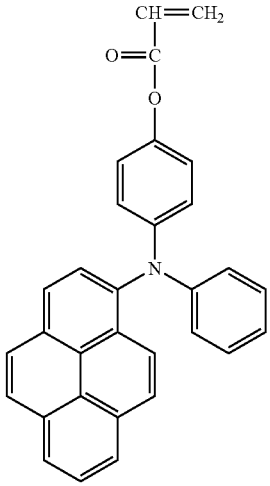
No. 43
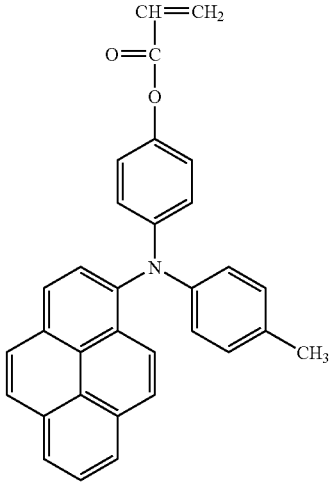
No. 44
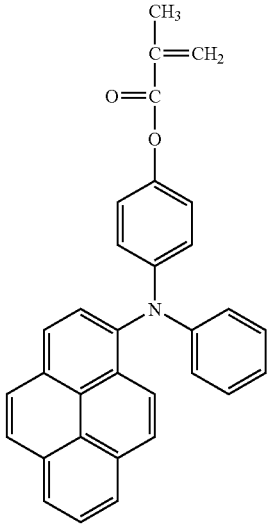

-continued
No. 45
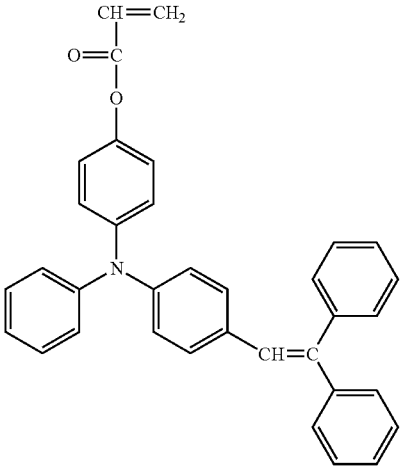
No. 46
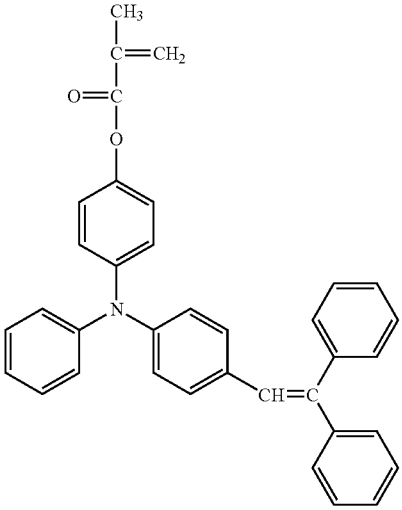
No. 47
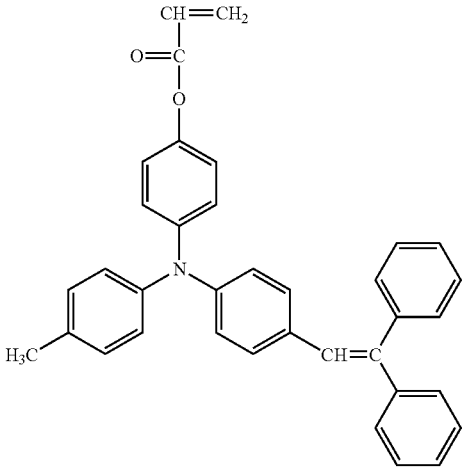
-continued
No. 48
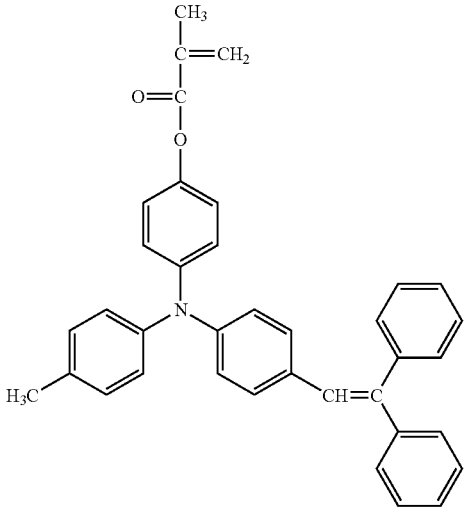
No. 49
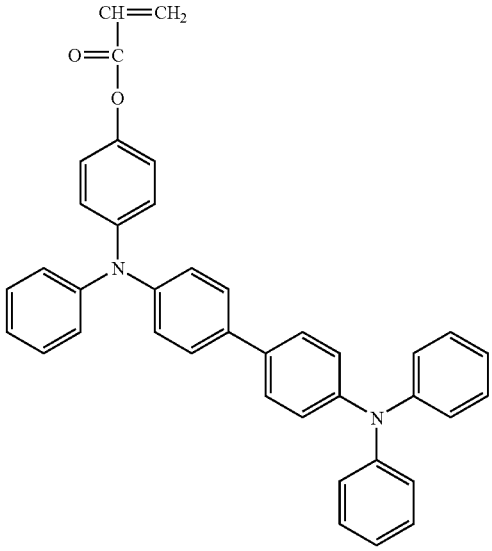
No. 50
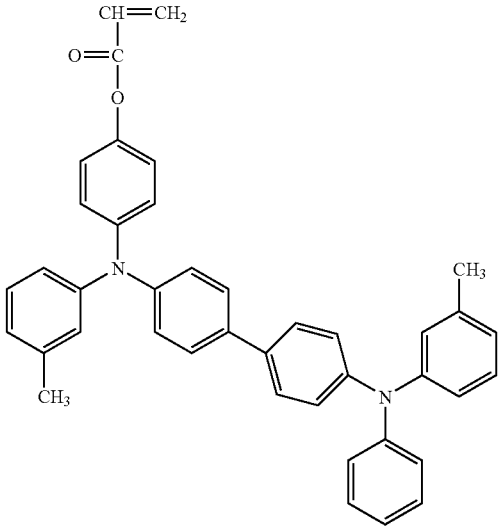

-continued
No. 51
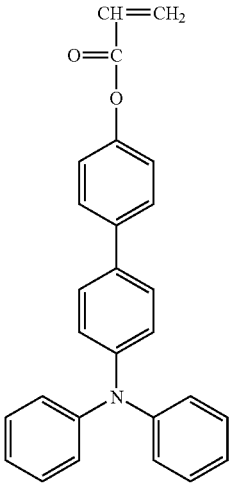
No. 52
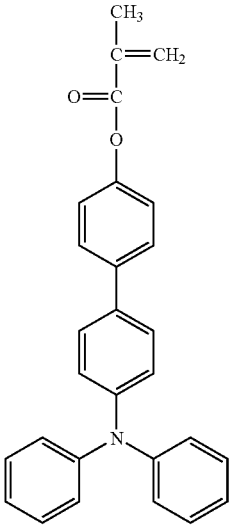
No. 53
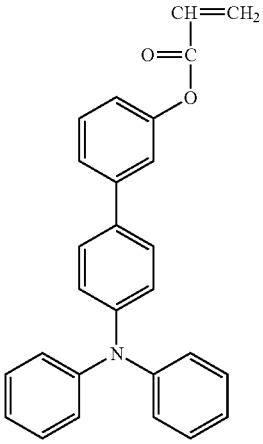
-continued
No. 54
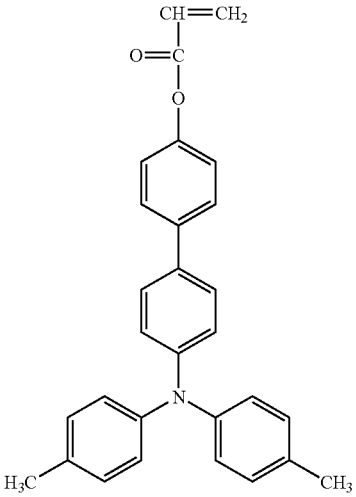
No. 55
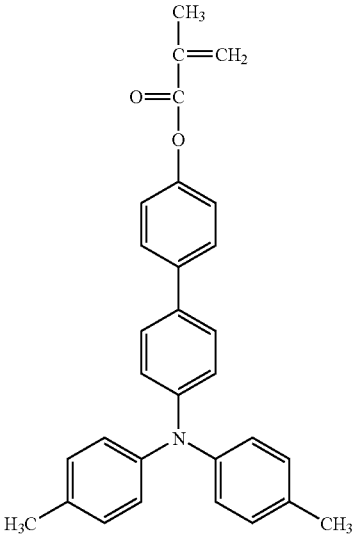
No. 56
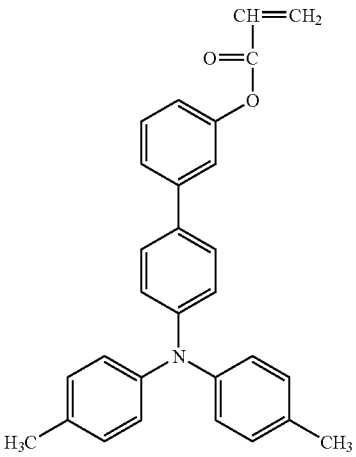

-continued
No. 57
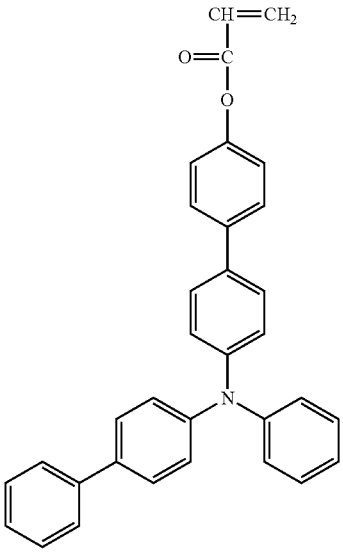
No. 58
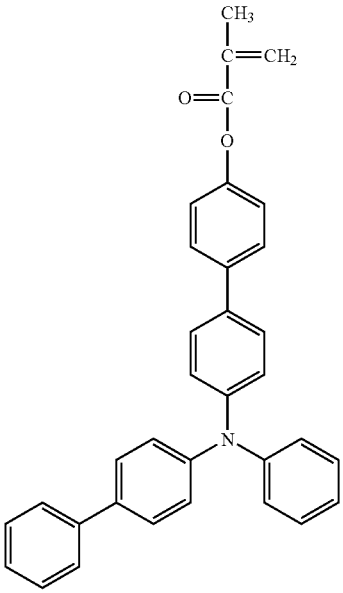
-continued
No. 59
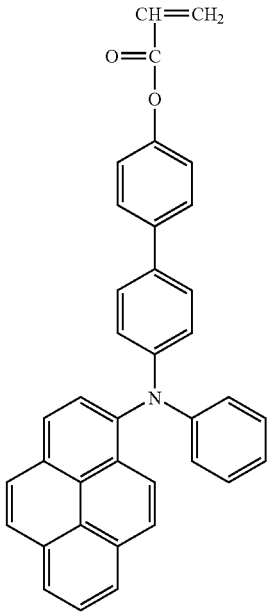
No. 60
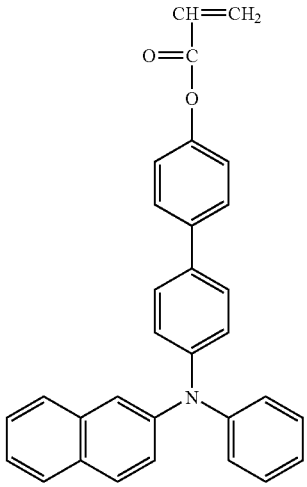
No. 61
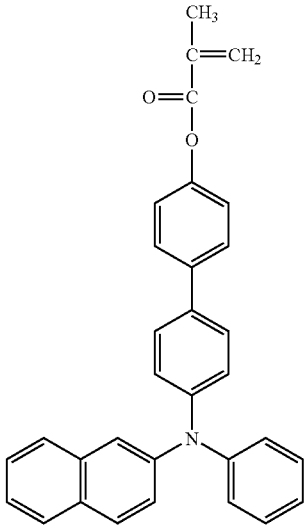

-continued
No. 62
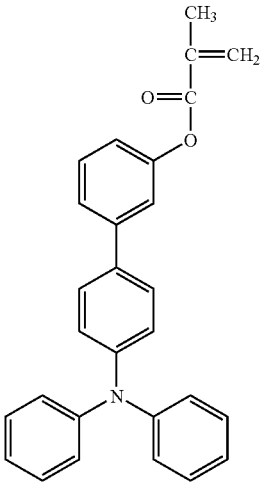
No. 63
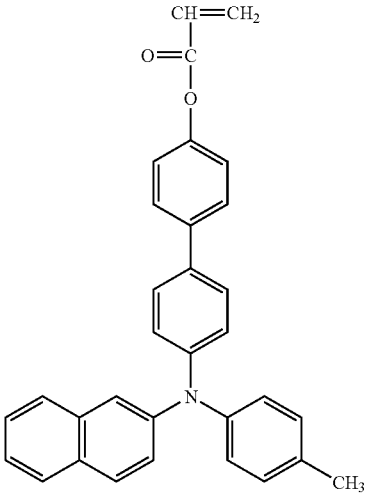
No. 64
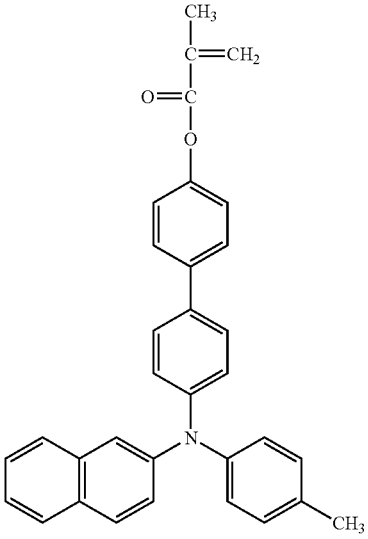
-continued
No. 65
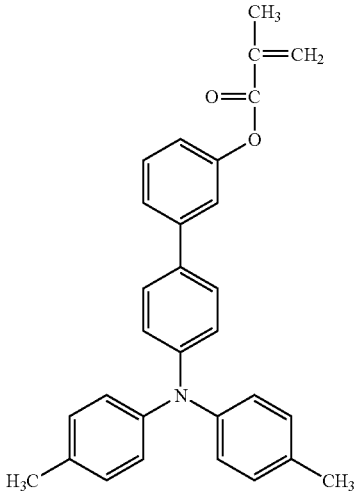
No. 66
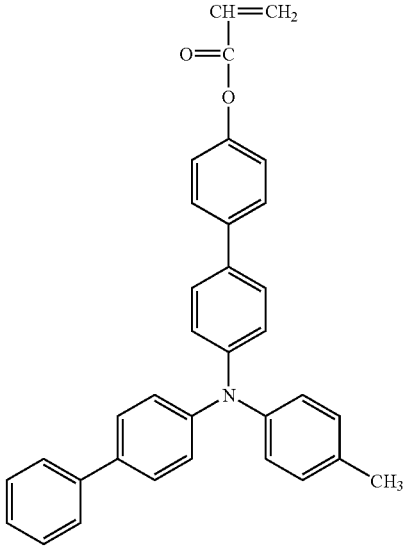
No. 67
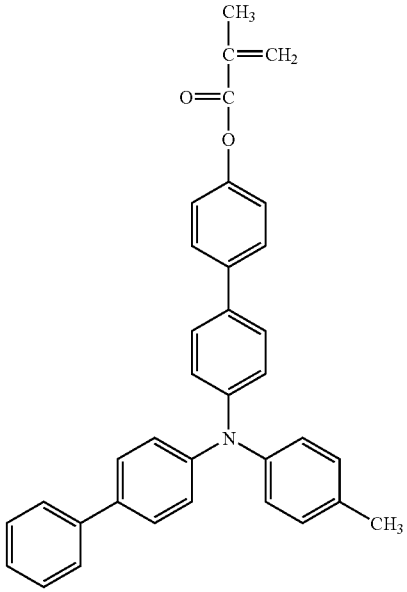

-continued
No. 68
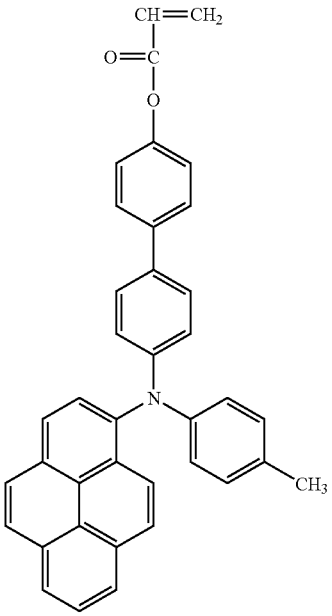
-continued
No. 70
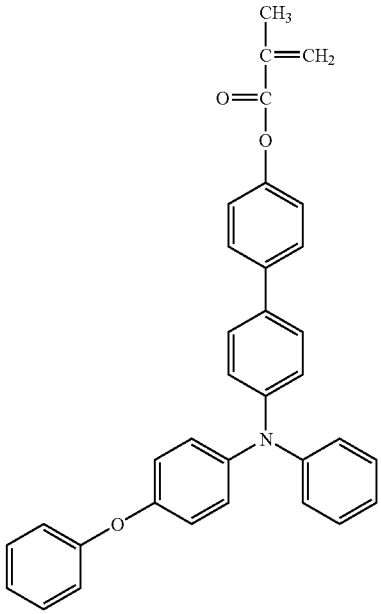
No. 69
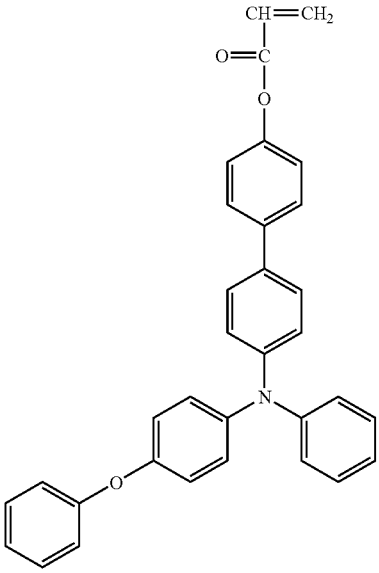
No. 71
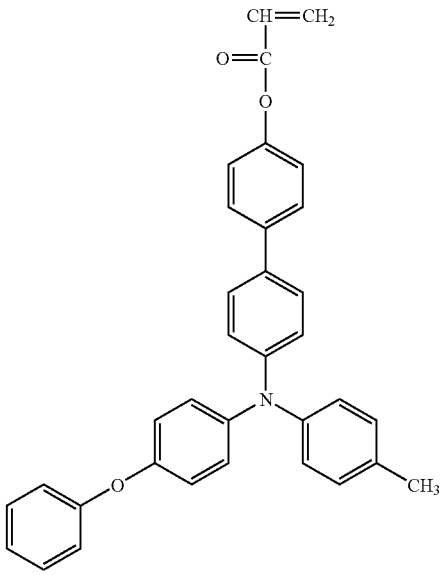

-continued
No. 72
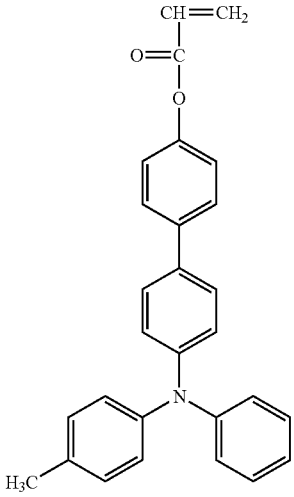
No. 73
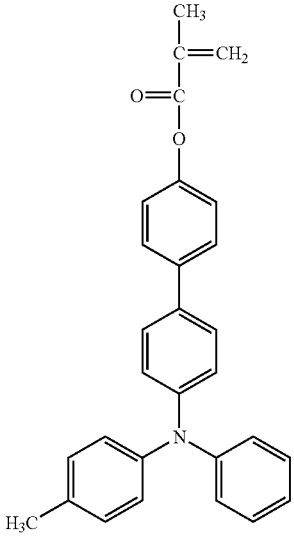
No. 74
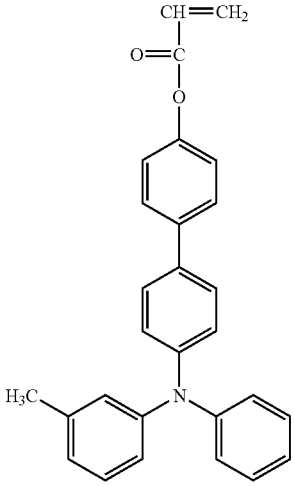
-continued
No. 75
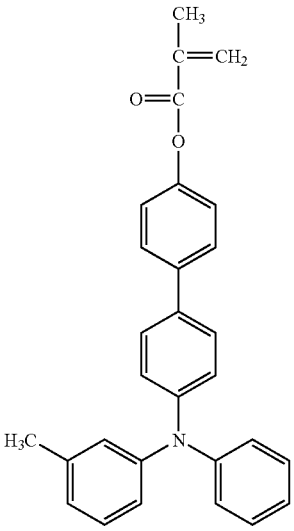
No. 76
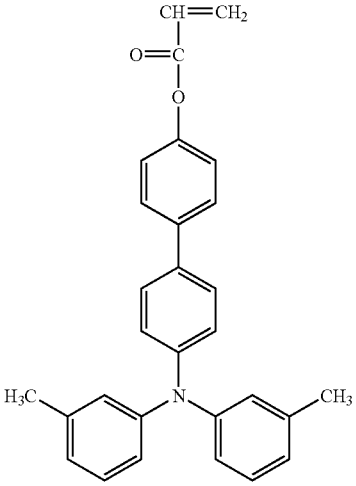
No. 77
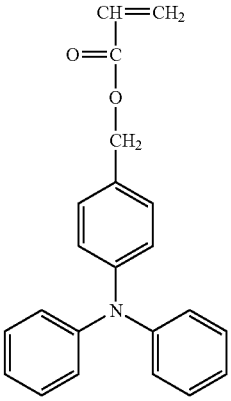

-continued
No. 78
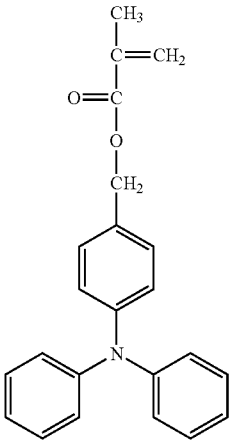
No. 79
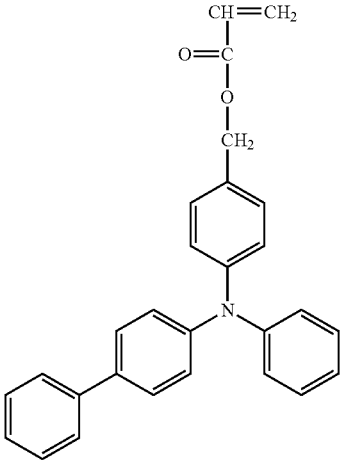
No. 80
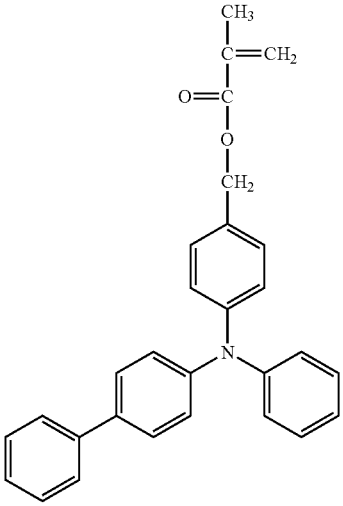
-continued
No. 81
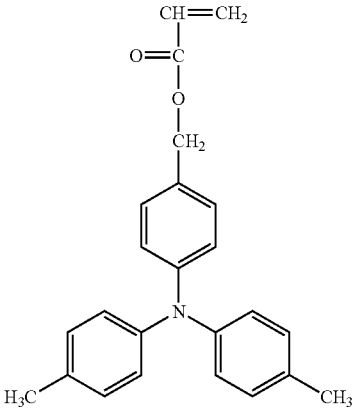
No. 82
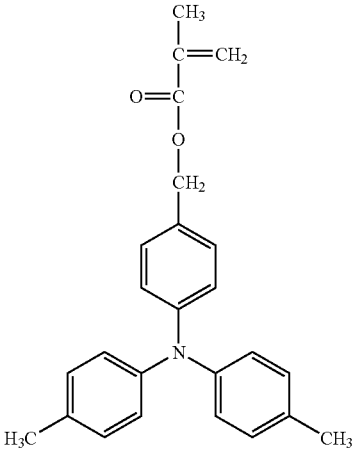
No. 83
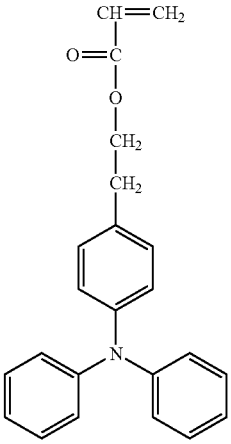

-continued
No. 84
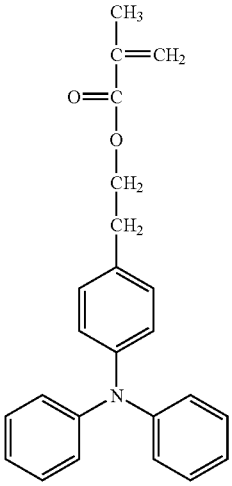
No. 85
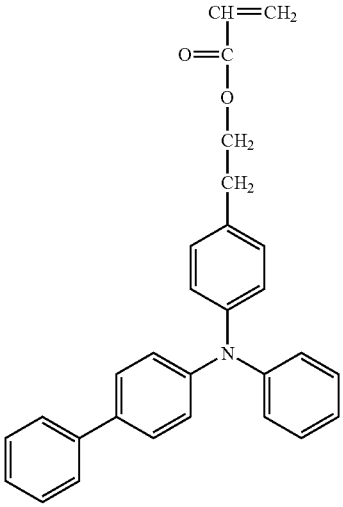
No. 86
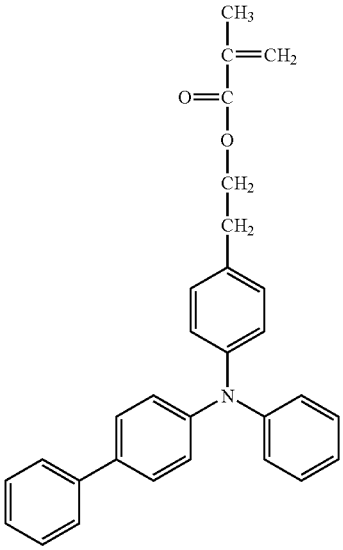
-continued
No. 87
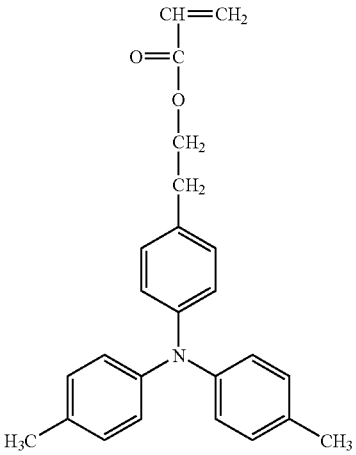
No. 88
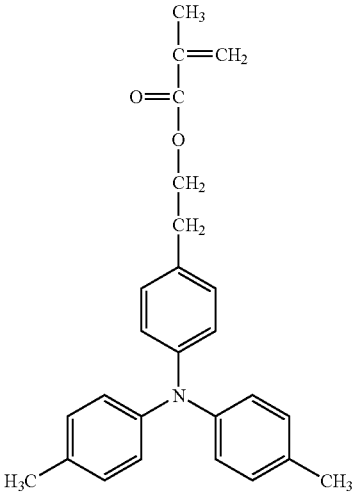
No. 89
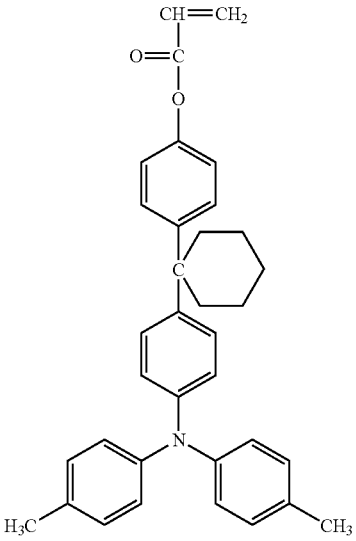

-continued
No. 90
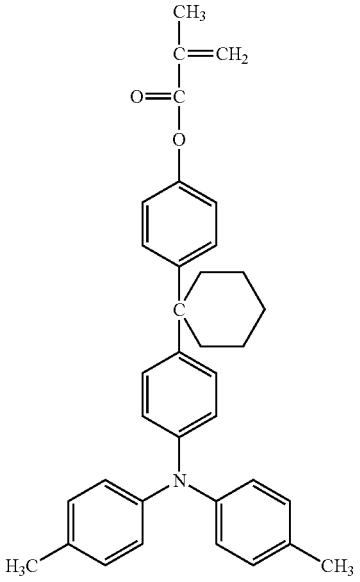
No. 91
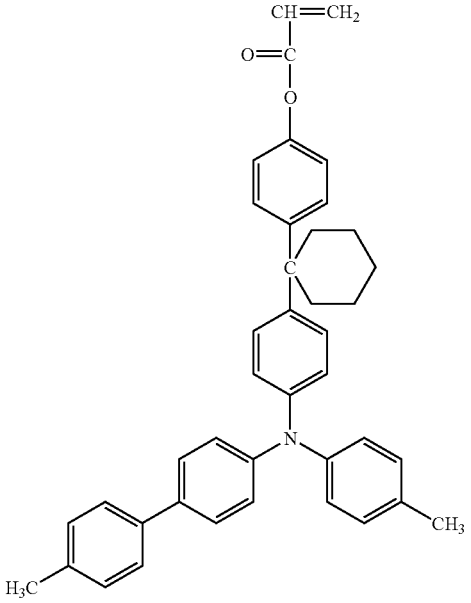
-continued
No. 92
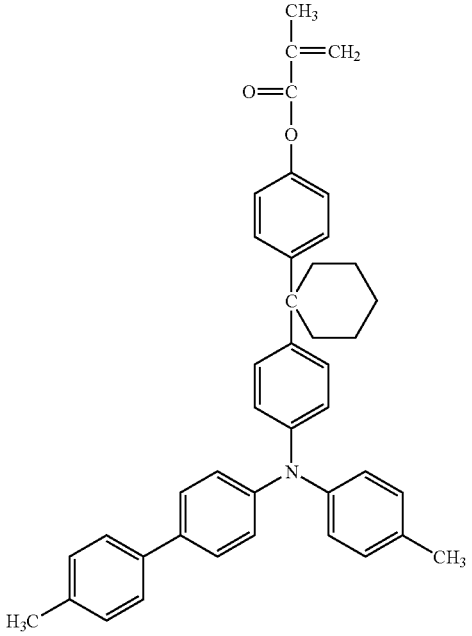
No. 93
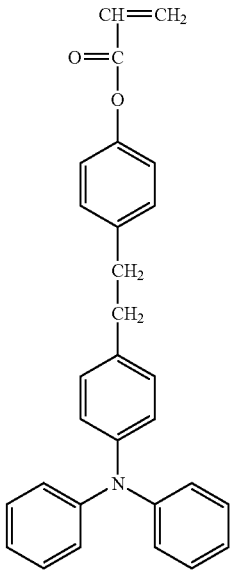

-continued
No. 94
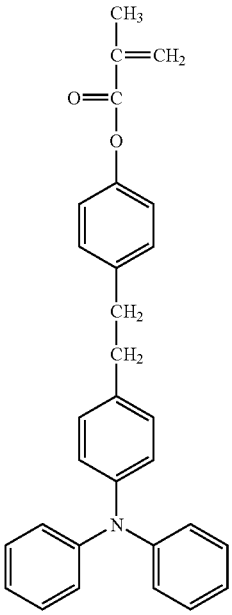
No. 95
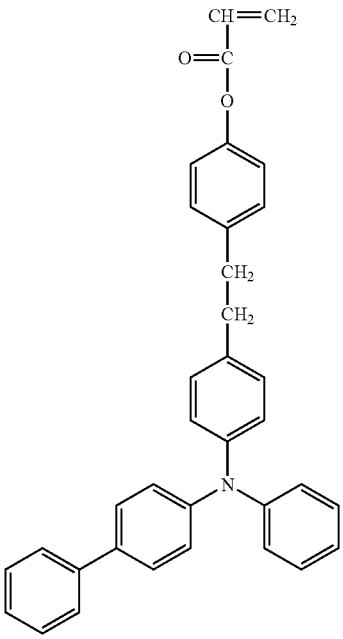
-continued
No. 96
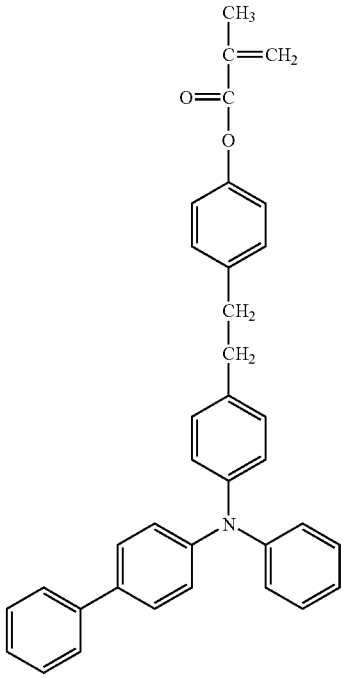
No. 97
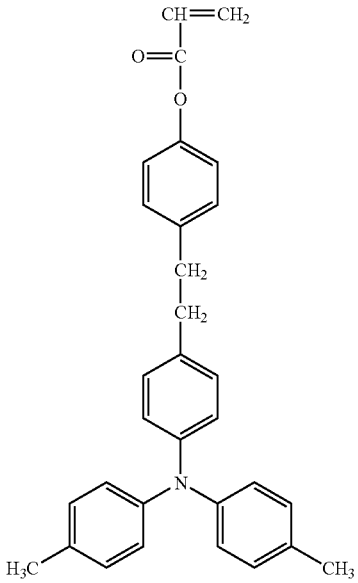

-continued
No. 98
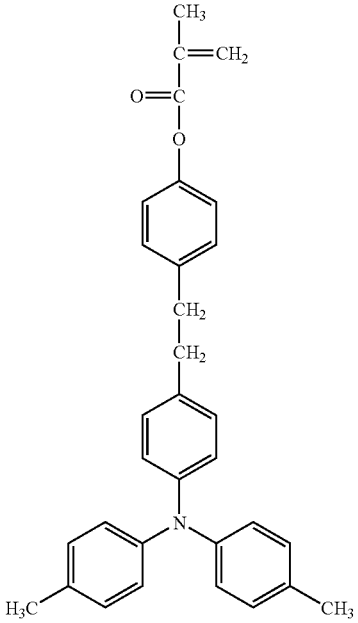
No. 99
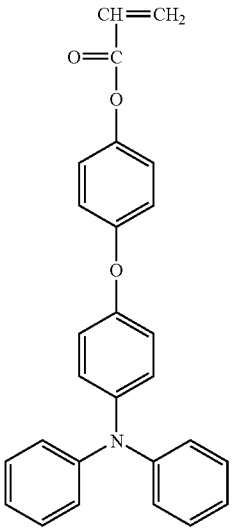
-continued
No. 100
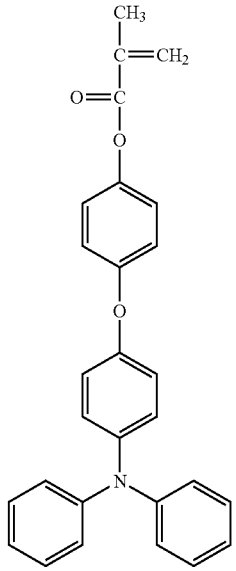
No. 101
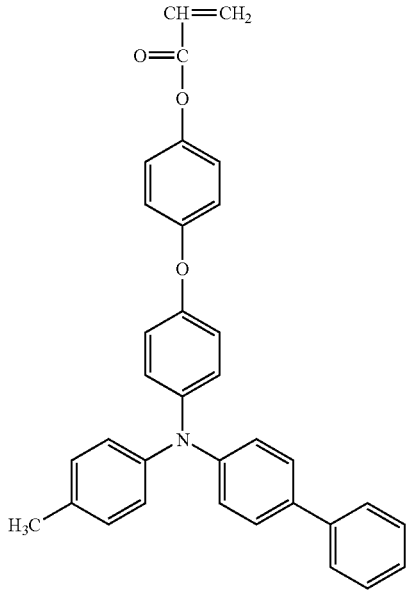

-continued
No. 102
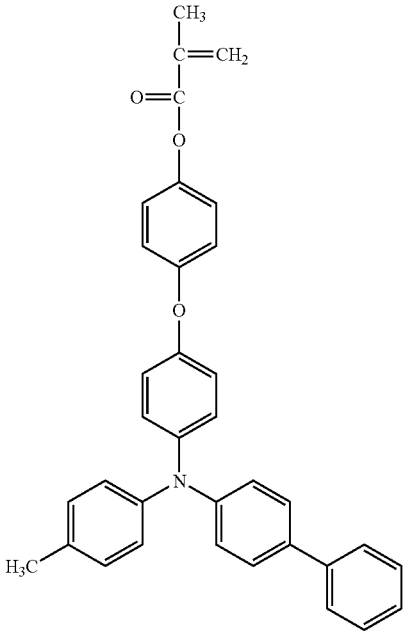
No. 103
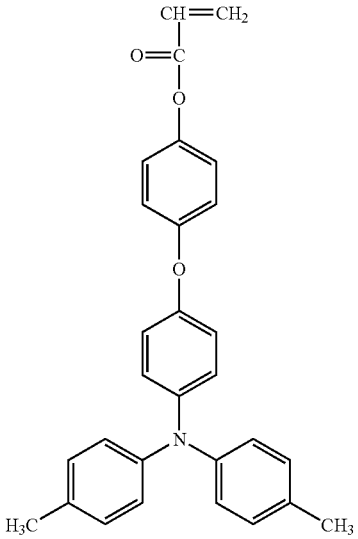
-continued
No. 104
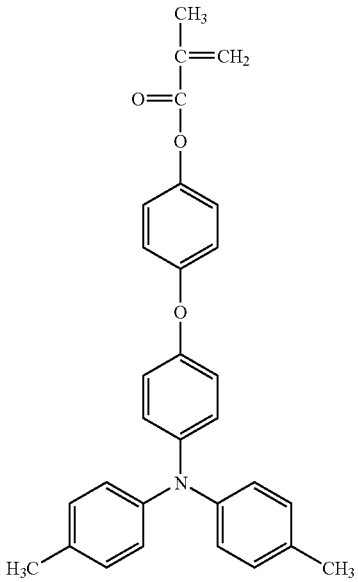
No. 105
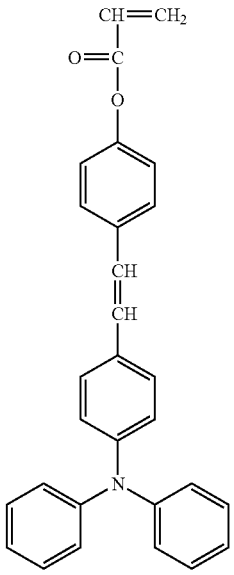

-continued
No. 106
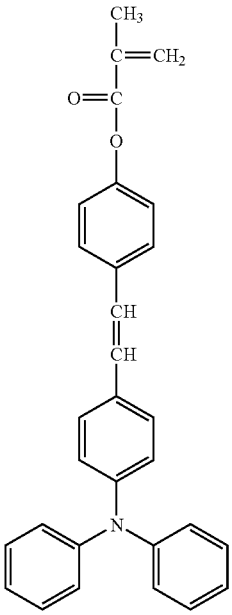
-continued
No. 108
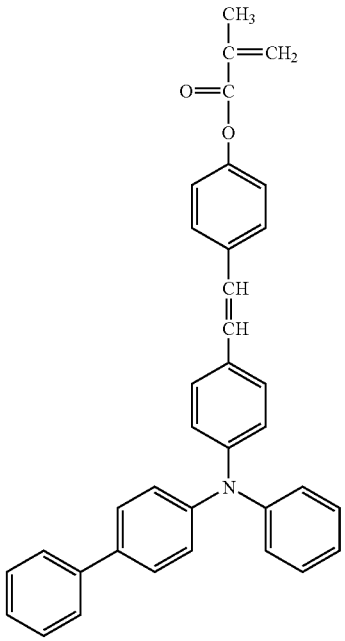
No. 107
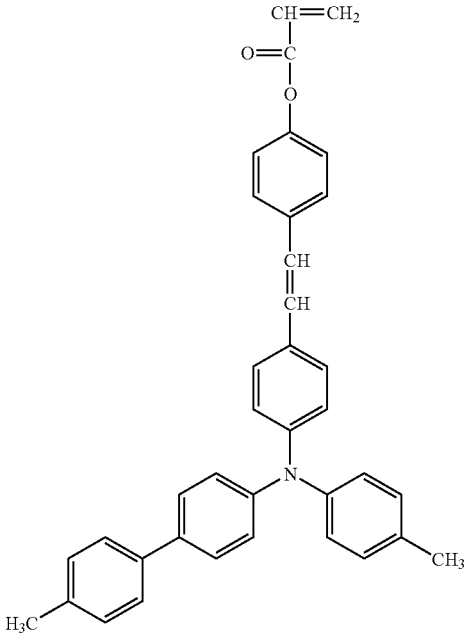
No. 109
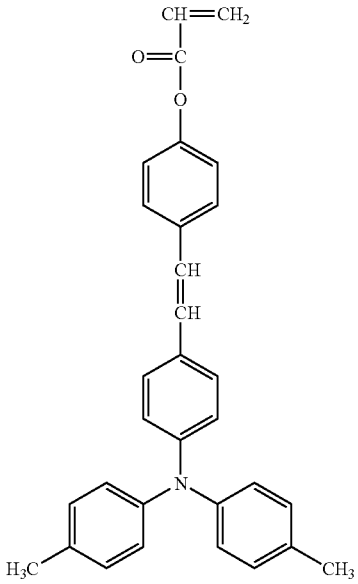

-continued
No. 110
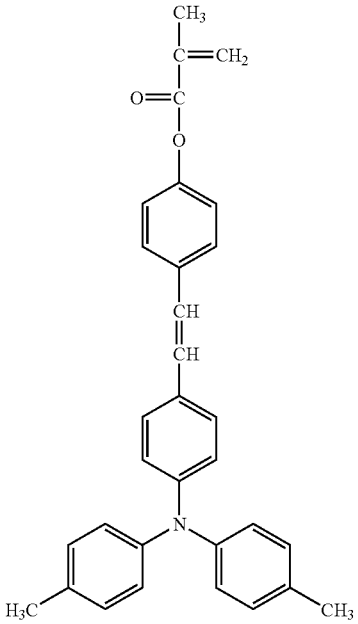
No. 111
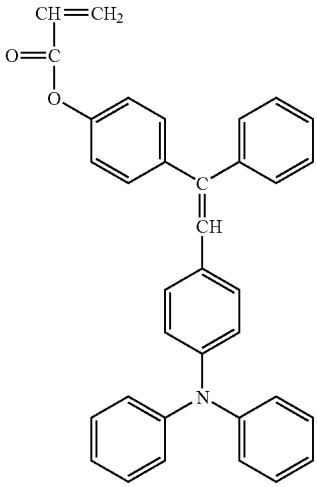
No. 112
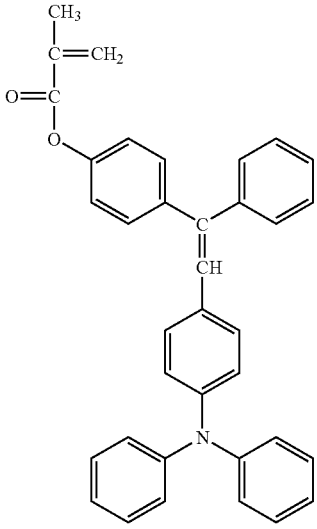
-continued
No. 113
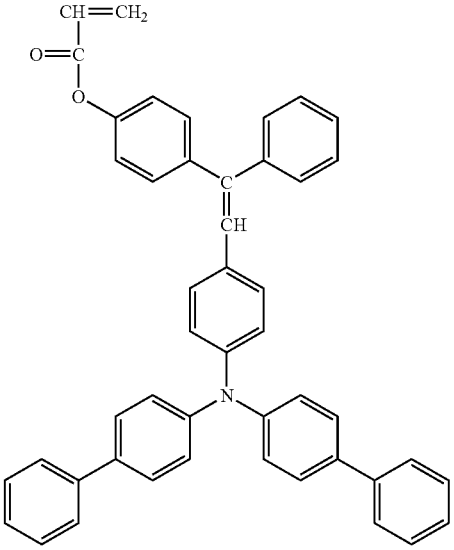
No. 114
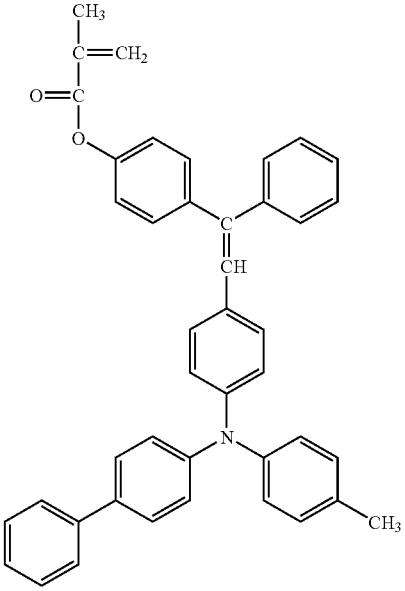
No. 115
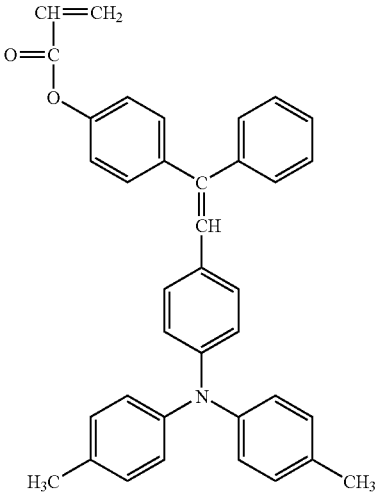

-continued
No. 116
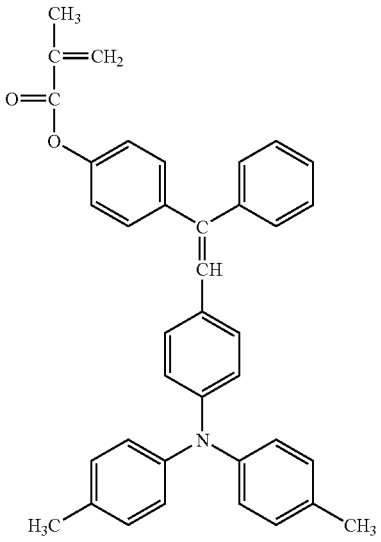
No. 117
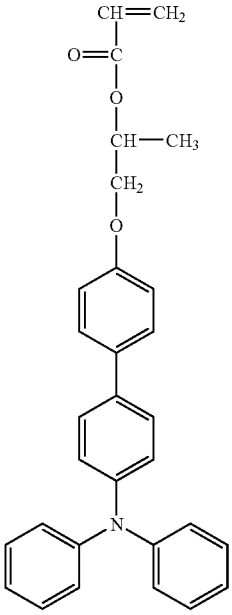
-continued
No. 118
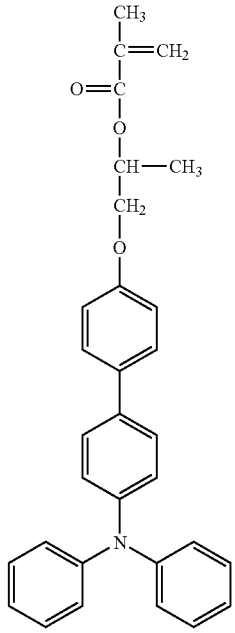
No. 119
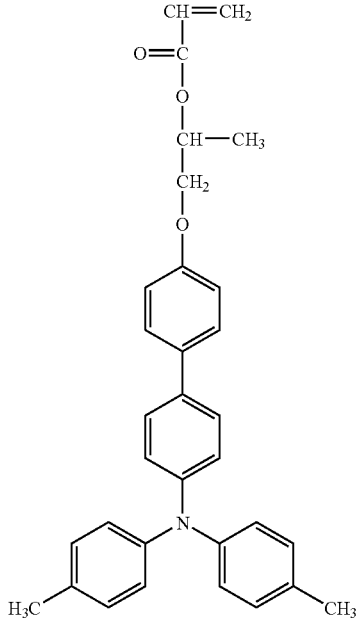

-continued
No. 120
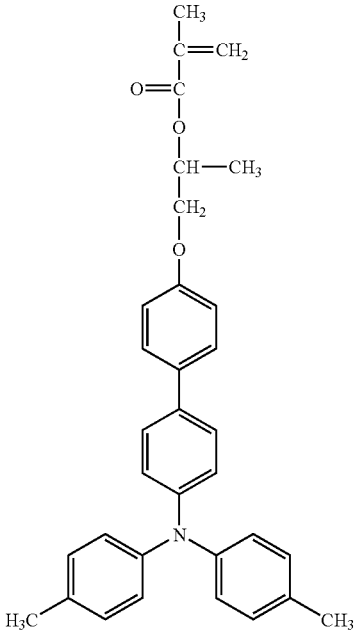
-continued
No. 122
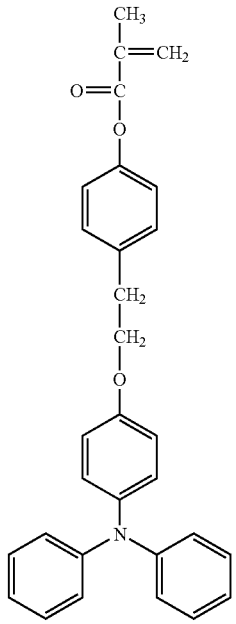
No. 121
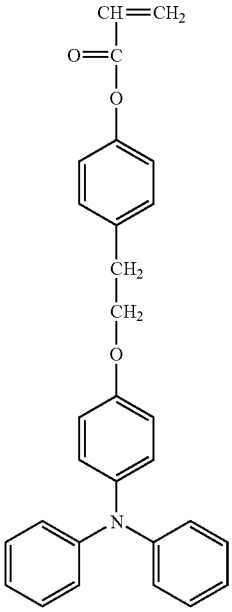
No. 123
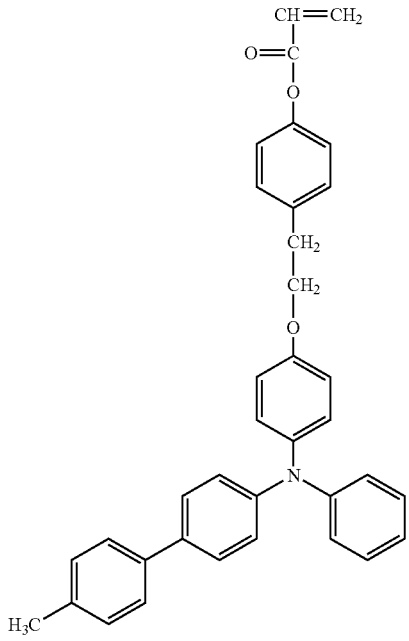

-continued
No. 124
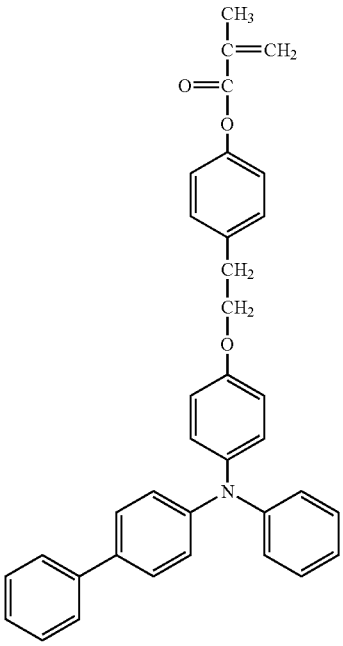
No. 125
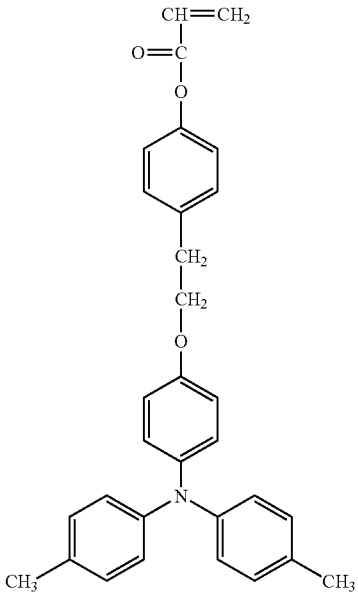
-continued
No. 126
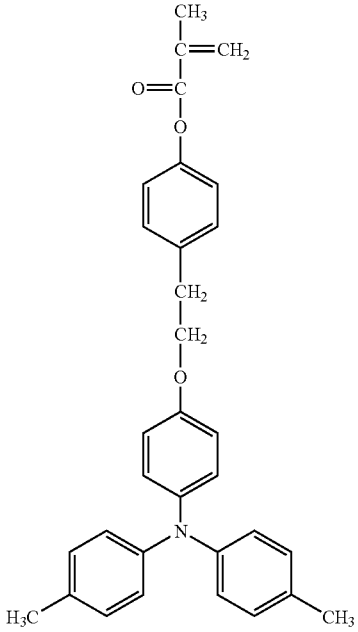
No. 127
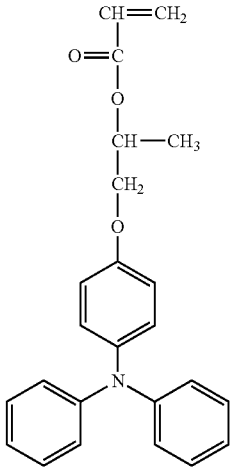
No. 128
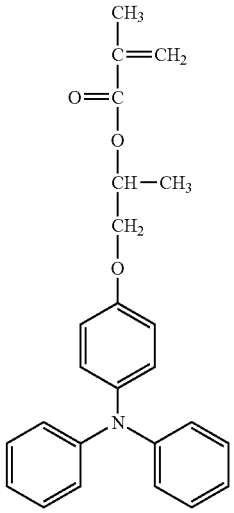

-continued
No. 129
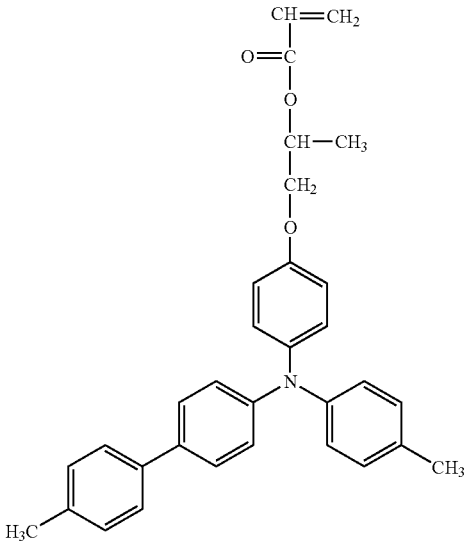
No. 130
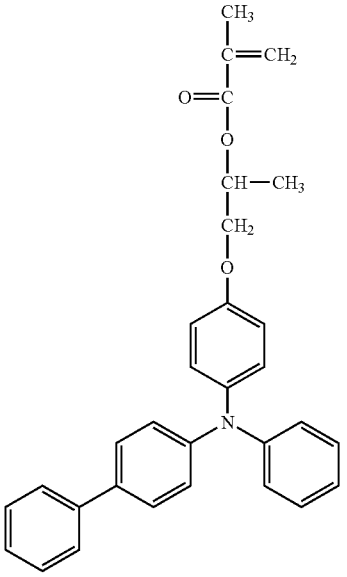
No. 131
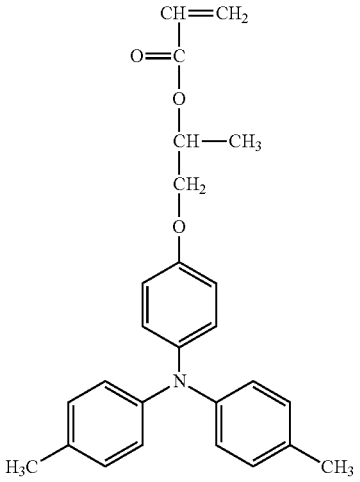
-continued
No. 132
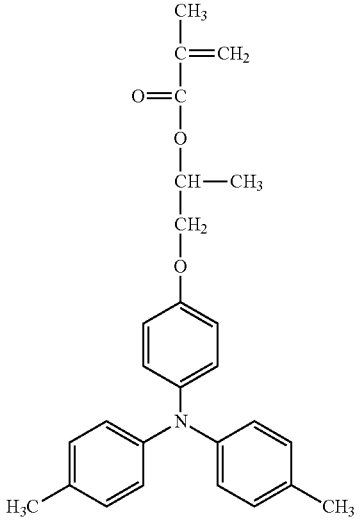
No. 133
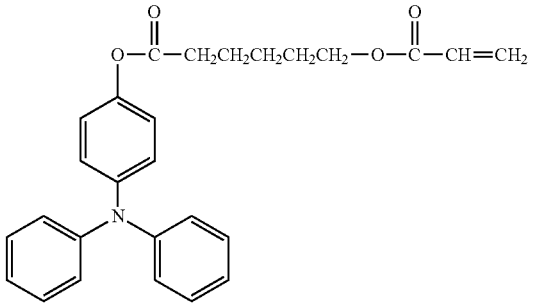
No. 134
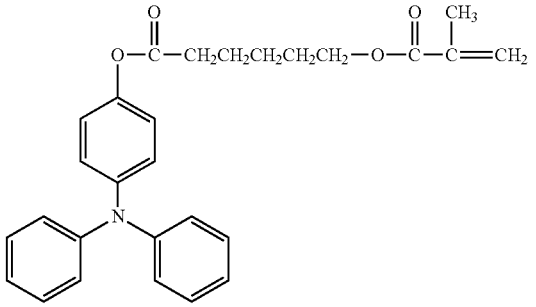
No. 135
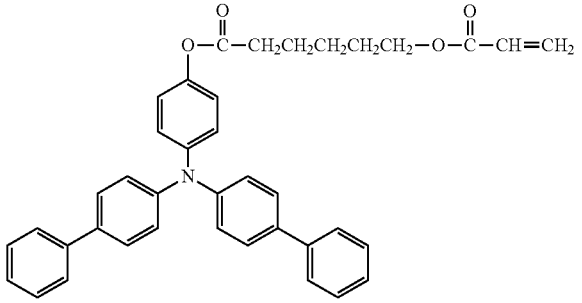

-continued
No. 136
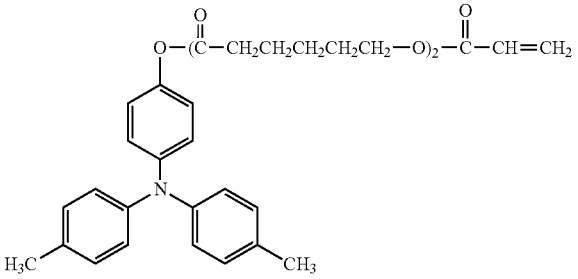
No. 137
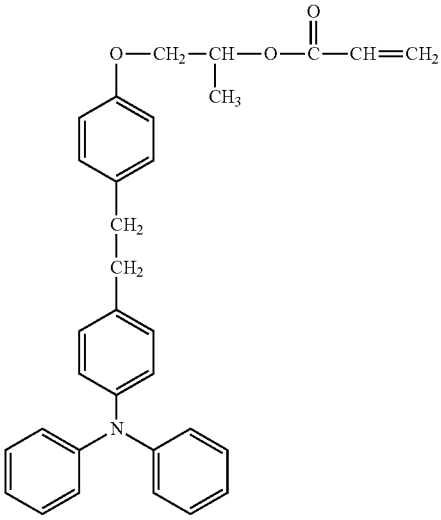
No. 138
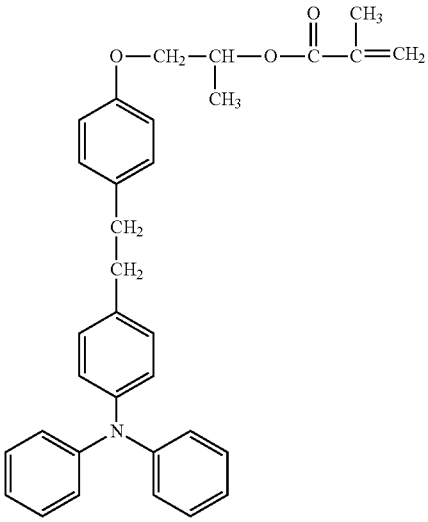
-continued
No. 139
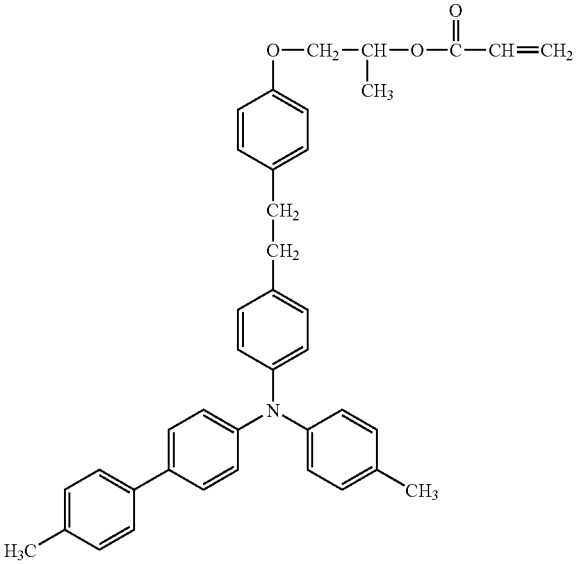
No. 140
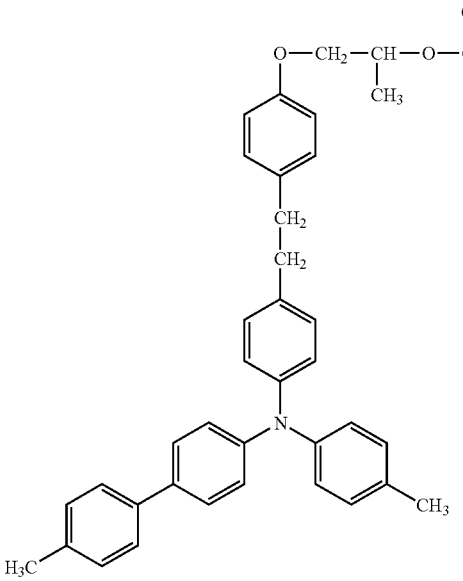

-continued
No. 141
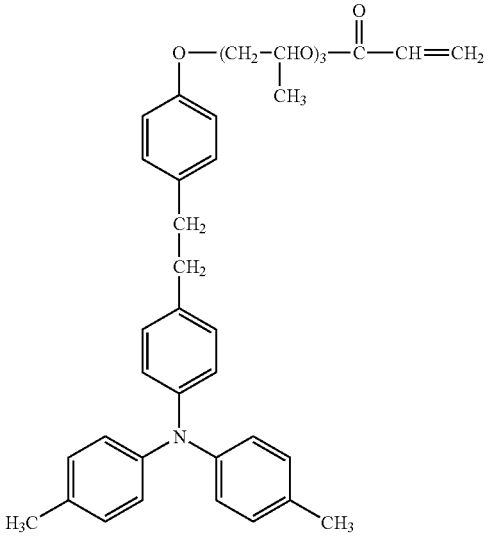
No. 142
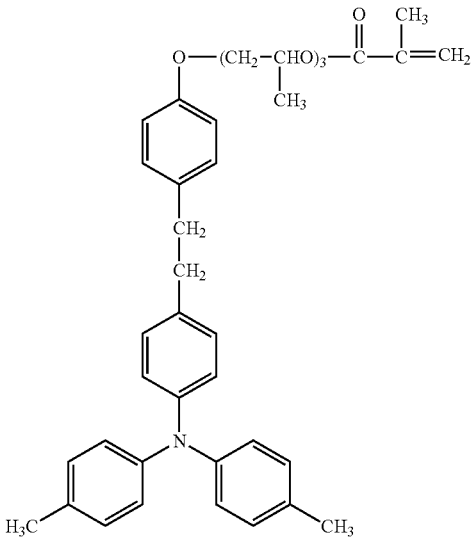
No. 143
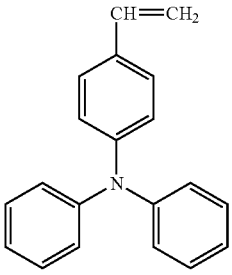
-continued
No. 144
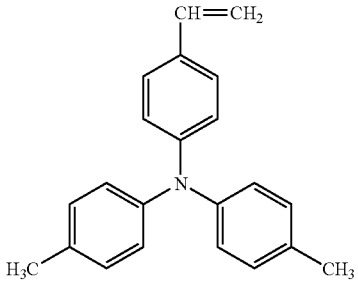
No. 145
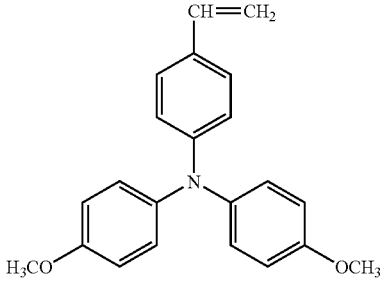
No. 146
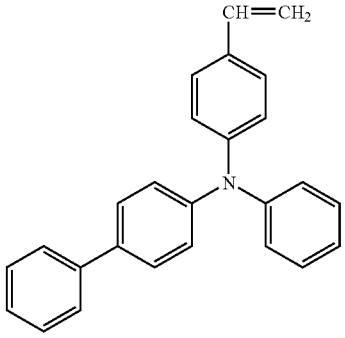
No. 147
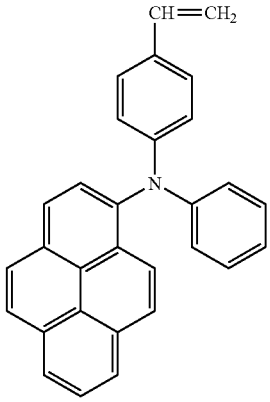
No. 148
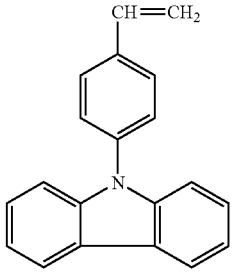

-continued
No. 149
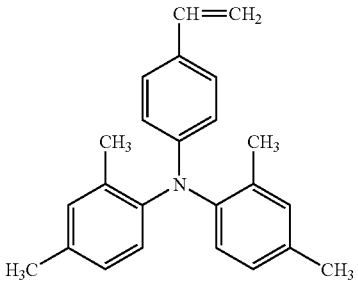
No. 150
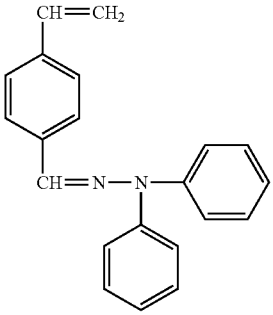
No. 151
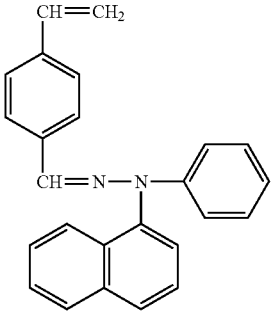
No. 152
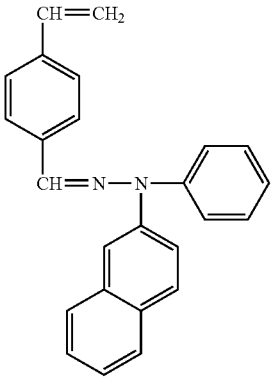
No. 153
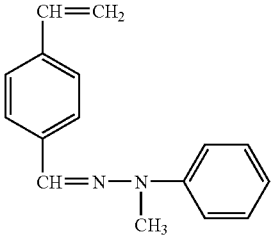
-continued
No. 154
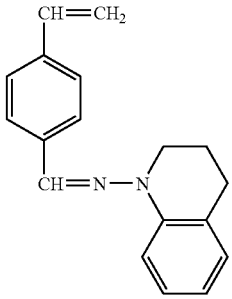
No. 155
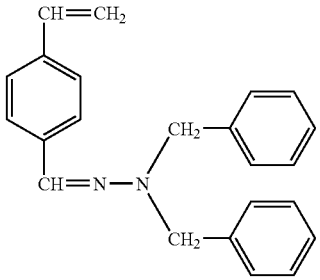
No. 156
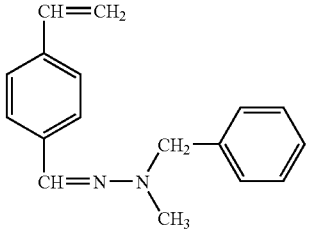
No. 157
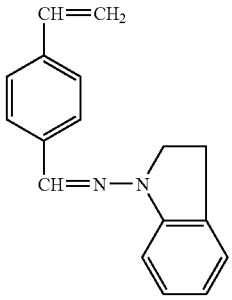
No. 158
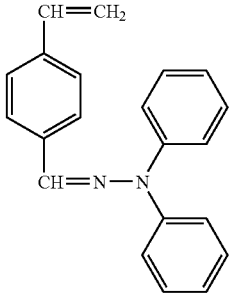

-continued

No. 159

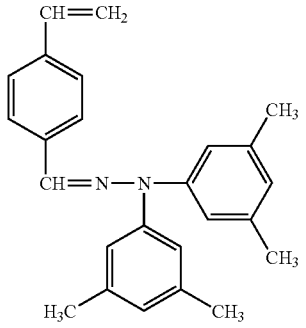

No. 160

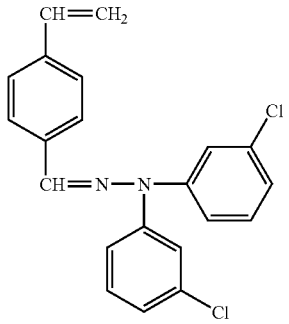

The radical polymerizable monofunctional compounds are used for imparting a charge transport property to the resultant protection layer. The additive amount of the radical polymerizable monofunctional compounds is preferably from 20 to 80% by weight, and more preferably from 30 to 70% by weight, based on the total weight of the protection layer. When the additive amount is too small, good charge transport property cannot be imparted to the resultant polymer, and thereby the electric properties (such as photosensitivity and residual potential) of the resultant photoreceptor deteriorate. In contrast, when the additive amount is too large, the crosslinking density of the resultant protection layer decreases, and thereby the abrasion resistance of the resultant photoreceptor deteriorates. From this point of view, the additive amount of the monofunctional monomers is from 30 to 70% by weight.

The crosslinked protection layer is typically prepared by reacting (crosslinking) at least a radical polymerizable tri- or more-functional monomer and a radical polymerizable monofunctional compound. However, in order to reduce the viscosity of the coating liquid, to relax the stress of the protection layer, and to reduce the surface energy and friction coefficient of the protection layer, known radical polymerizable mono-or di-functional monomers and radical polymerizable oligomers having no charge transport structure can be used in combination therewith.

Specific examples of the radical polymerizable monofunctional compounds having no charge transport structure include, but are not limited to, 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isostearyl acrylate, stearyl acrylate, styrene, etc.

Specific examples of the radical polymerizable difunctional monomers having no charge transport structure include, but are not limited to, 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacryalte, neopentylglycol diacrylate, bisphenol A-ethyleneoxy-modified diacrylate, bisphenol F-ethyleneoxy-modified diacrylate, neopentylglycol diacryalte, etc.

Specific examples of the mono- or di-functional monomers for use in imparting a function such as low surface energy and/or low friction coefficient to the crosslinked protection layer include, but are not limited to, fluorine-containing monomers such as octafluoropentyl acrylate, 2-perfluorooctylethyl acrylate, 2-perfluorooctylethyl methacrylate, and 2-perfluoroisononylethyl acrylate; and vinyl monomers, acrylates and methacrylates having a polysiloxane group such as siloxane units having a repeat number of from 20 to 70 which are described in Published Examined Japanese Patent Application Nos. 05-60503 and 06-45770 (e.g., acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl). Specific examples of the radical polymerizable oligomers include, but are not limited to, epoxyacrylate oligomers, urethane acrylate oligomers, polyester acrylate oligomers, etc.

The additive amount of such mono- and di-functional monomers is preferably not greater than 50 parts by weight, and more preferably not greater than 30 parts by weight, per 100 parts by weight of the tri- or more-functional monomers used. When the additive amount is too large, the crosslinking density decreases, and thereby the abrasion resistance of the resultant protection layer deteriorates.

In addition, in order to efficiently crosslink the protection layer, a polymerization initiator can be added to the protection layer coating liquid. Suitable polymerization initiators include heat polymerization initiators and photo polymerization initiators. The polymerization initiators can be used alone or in combination.

Specific examples of the heat polymerization initiators include, but are not limited to, peroxide initiators such as 2,5-dimethylhexane-2,5-dihydroperoxide, dicumyl peroxide, benzoyl peroxide, t-butylcumyl peroxide, 2,5-dimethyl-2,5-di(peroxybenzoyl)hexyne-3, di-t-butylperoxide, t-butylhydroperoxide, cumenehydroperoxide, lauroyl peroxide, and 2,2-bis(4,4-di-t-butylperoxycyclohexy)propane; and azo type initiators such as azobisisobutyronitrile, azobiscyclohexanecarbonitrile, azobisbutyricacidmethyl ester, hydrochloric acid salt of azobisisobutylamidine, and 4,4'-azobiscyanovaleric acid.

Specific examples of the photopolymerization initiators include, but are not limited to, acetophenone or ketal type photopolymerization initiators such as diethoxyacetophenone, 2,2-dimethoxy-1,2-diphenylethane-1-one, 1-hydroxycyclohexyl-phenyl-ketone; 4-(2-hydroxyethoxy)phenyl-(2-hydroxy-2-propyl)ketone, 2-benzyl-2-dimethylamino-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime; benzoin ether type photopolymerization initiators such as benzoin, benzoin methyl ether, benzoin ethyl ether, benzoin isobutyl ether, and benzoin isopropyl ether; benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acryalted benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, imidazole compounds, etc. Photopolymerization accelerators can be used alone or in combination with the above-mentioned photopolymerization initiators. Specific examples of the photopolymerization accelerators include, but are not limited to, triethanolamine, methyldiethanolamine, ethyl 4-dimethylaminobenzoate, isoamyl 4-dimethylaminobenzoate, 2-dimethylaminoethyl benzoate, 4,4'-dimethylaminobenzophenone, etc.

The additive amount of the polymerization initiators is preferably from 0.5 to 40 parts by weight, and more preferably from 1 to 20 parts by weight, per 100 parts by weight of the total weight of the radical polymerizable monomers used.

In order to relax the stress of the crosslinked protection layer and to improve the adhesion of the protection layer to the CTL, the protection layer coating liquid may include additives such as plasticizers, leveling agent, and low molecular weight charge transport materials having no radical polymerizability. Specific examples of the plasticizers include, but are not limited to, known plasticizers for use in general resins, such as dibutylphthalate, and dioctyl phthalate. The additive amount of the plasticizers in the protection layer coating liquid is preferably not greater than 20% by weight, and more preferably not greater than 10% by weight, based on the total solid components included in the coating liquid. Specific examples of the leveling agents include, but are not limited to, silicone oils (such as dimethylsilicone oils, and methylphenylsilicone oils), and polymers and oligomers having a perfluoroalkyl group in their side chains. The additive amount of the leveling agents is preferably not greater than 3% by weight based on the total solid components included in the coating liquid.

The crosslinked protection layer is typically prepared by coating a coating liquid including a radical polymerizable tri- or more-functional monomer and a radical polymerizable monofunctional compound on the CTL and then crosslinking the coated layer. When the monomers are liquid, it may be possible to dissolve other components in the monomers, resulting in preparation of the protection layer coating liquid. The coating liquid can optionally include a solvent to well dissolve the other components and/or to reduce the viscosity of the coating liquid. Specific examples of the solvents include, but are not limited to, alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated solvents such as dichloromethane, dichloroethane, trichloroethane, and chlorobenzene; aromatic solvents such as benzene, toluene, and xylene; cellosolves such as methyl cellosolve, ethyl cellosolve and cellosolve acetate; etc. These solvents can be used alone or in combination. The additive amount of the solvents is determined depending on the solubility of the solid components, the coating method used, and the target thickness of the protection layer. Coating methods such as dip coating methods, spray coating methods, bead coating methods, and ring coating methods can be used for forming the protection layer.

After coating a protection layer coating liquid, energy such as heat energy, photo energy and radiation energy is applied to the coated layer to crosslink the layer. Specific examples of the method for applying heat energy are as follows:

(1) applying heated gas (such as air and nitrogen gas) thereto;

(2) contacting a heated material thereto; and (3) irradiating the coated layer with light or electromagnetic waves from the coated layer side or the opposite side.

The temperature at which the coated protection layer is heated is preferably from 100 to 170° C. When the temperature is too low, the crosslinking speed becomes too slow, and thereby a problem is caused in that the coated layer is not sufficiently crosslinked. When the temperature is too high, the crosslinking reaction is unevenly performed, and thereby a problem is caused in that the resultant protection layer has a large strain or includes non-reacted functional groups. In order to uniformly perform the crosslinking reaction, a method in which the coated layer is first heated at a relatively low temperature (not higher than about 100° C.), followed by heating at a relatively high temperature (not lower than about 100° C.) is preferably used. Specific examples of the light source for use in photo-crosslinking the coated layer include, but are not limited to, ultraviolet light emitting devices such as high pressure mercury lamps and metal halide lamps. In addition, visible light emitting lamps can also be used if the radical polymerizable monomers and the photopolymerization initiators used have absorption in a visible region. The illuminance intensity is preferably from 50 to 1000 mW/cm$^2$. When the illuminance intensity is too low, it takes a long time until the coated layer is crosslinked. In contrast, when the illuminance intensity is too high, a problem is caused in that the crosslinking reaction is unevenly performed, thereby forming wrinkles in the resultant protection layer, or the layer includes non-reacted reaction groups therein. In addition, a problem occurs in that due to rapid crosslinking, the resultant protection layer causes cracks or peeling. Specific examples of the radiation energy applying methods include, but are not limited to, methods using electron beams. Among these methods, the methods using heat or light are preferably used because the reaction speed is high and the energy applying devices have a simple structure.

The thickness of the crosslinked protection layer is preferably from 1 to 10 μm, and more preferably from 2 to 8 μm. When the crosslinked protection layer is too thick, the above-mentioned cracking and peeling problems occurs. When the thickness is not greater than 8 μm, the margin for the cracking and peeling problems can be increased. Therefore, a relatively large amount of energy can be applied to the coated layer, and thereby crosslinking density can be further increased. In addition, flexibility in choosing materials for imparting good abrasion resistance to the protection layer and flexibility in setting crosslinking conditions can be enhanced. In general, a radical polymerization reaction is obstructed by oxygen included in the air, namely, crosslinking is not well performed in the surface part (from 0 to about 1 μm in the thickness direction) of the coated layer due to oxygen in the air, resulting in formation of an unevenly-crosslinked layer. Therefore, if the crosslinked protection layer is too thin (i.e., the thickness of the protection layer is less than about 1 μm), the layer has poor abrasion resistance. Further, when the protection layer coating liquid is coated directly on a CTL, the components included in the CTL tend to be dissolved in the coated liquid, resulting in migration of the components into the protection layer. In this case, if the protection layer is too thin, the components are migrated into the entire protection layer, resulting in occurrence of a problem in that crosslinking cannot be well performed or the crosslinking density is low. Thus, the thickness of the protection layer is preferably not less than 1 μm so that the protection layer has good abrasion resistance and scratch resistance. However, if the entire protection layer is abraded, the CTL located below the protection layer is abraded more easily than the protection layer. In this case, problems occur in that the photosensitivity of the photoreceptor seriously changes and uneven half tone images are produced. In order that the resultant photoreceptor can produce high quality images for a long period of time, the crosslinked protection layer preferably has a thickness not less than 2 μm.

When the crosslinked protection layer, which is formed as an outermost layer of a photoreceptor having a CGL, and CTL, is insoluble in organic solvents, the resultant photoreceptor has dramatically improved abrasion resistance and scratch resistance. The solvent resistance of a protection layer can be checked by the following method:

(1) dropping a solvent, which can well dissolve polymers, such as tetrahydrofuran and dichloromethane, on the surface of the protection layer;

(2) naturally drying the solvent; and (3) visually observing the surface of the protection layer to determine whether the condition of the surface part is changed.

If the protection layer has poor solvent resistance, the following phenomena are observed:

(1) the surface part is recessed while the edge thereof is projected;

(2) the charge transport material in the protection layer is crystallized, and thereby the surface part is clouded; or (3) the surface part is at first swelled, and then wrinkled.

If the protection layer has good solvent resistance, the above-mentioned phenomena are not observed.

In order to prepare a crosslinked protection layer having good resistance to organic solvents, the key points are as follows:

(1) to optimize the formula of the protection layer coating liquid, i.e., to optimize the content of each of the components included in the liquid;

(2) to choose a proper solvent for diluting the protection layer coating liquid, while properly controlling the solid content of the coating liquid;

(3) to use a proper method for coating the protection layer coating liquid;

(4) to crosslink the coated layer under proper crosslink in a conditions; and (5) to form a CTL located below the protection layer and is hardly insoluble in the solvent included in the protection layer coating liquid.

It is preferable to use one or more of these techniques.

The protection layer coating liquid can include additives such as binder resins having no radical polymerizable group, antioxidants and plasticizers other than the radical polymerizable tri- or more-functional monomers having no charge transport structure and radical polymerizable monofunctional compounds having a charge transport structure. Since the additive amount of these additives is too large, the crosslinking density decreases and the protection layer causes a phase separation problem in that the crosslinked polymer is separated from the additives, and thereby the resultant protection layer becomes soluble in organic solvents. Therefore, the total amount of the additives is preferably not greater than 20% by weight based on the total weight of the solid components included in the protection layer coating liquid. In addition, in order not to decrease the crosslinking density, the total additive amount of the mono- or di-functional monomers, reactive oligomers and reactive polymers in the protection layer coating liquid is preferably not greater than 20% by weight based on the weight of the radical polymerizable tri- or more-functional monomers. In particular, when the additive amount of the di- or more-functional monomers having a charge transport structure is too large, units having a bulky structure are incorporated in the protection layer while the units are connected with plural chains of the protection layer, thereby generating strain in the protection layer, resulting in formation of aggregates of micro crosslinked materials in the protection layer. Such a protection layer is soluble in organic solvents. The additive amount of a radical polymerizable di- or more-functional monomer having a charge transport structure is determined depending on the species of the monomer used, but is generally not greater than 10% by weight based on the weight of the radical polymerizable monofunctional compound having a charge transport structure included in the protection layer.

When an organic solvent having a low evaporating speed is used for the protection layer coating liquid, problems which occur are that the solvent remaining in the coated layer adversely affects crosslinking of the protection layer; and a large amount of the components included in the CTL is migrated into the protection layer, resulting in deterioration of crosslinking density or formation of an unevenly crosslinked protection layer (i.e., the crosslinked protection layer becomes soluble in organic solvents). Therefore, it is preferable to use solvents such as tetrahydrofuran, mixture solvents of tetrahydrofuran and methanol, ethyl acetate, methyl ethyl ketone, and ethyl cellosolve. It is preferable that one or more proper solvents are chosen among the solvents in consideration of the coating method used. When the solid content of the protection layer coating liquid is too low, similar problems occur. The upper limit of the solid content is determined depending on the target thickness of the protection layer and the target viscosity of the protection layer coating liquid, which is determined depending on the coating method used, but in general, the solid content of the protection layer coating liquid is preferably from 10 to 50% by weight. Suitable coating methods for use in preparing the crosslinked protection layer include methods in which the weight of the solvent included in the coated layer is as low as possible, and the time during which the solvent in the coated layer contacts the CTL on which the coating liquid is coated is as short as possible. Specific examples of such coating methods include, but are not limited to, spray coating methods and ring coating methods in which the weight of the coated layer is controlled so as to be light. In addition, in order to control the amount of the components of the CTL migrating into the protection layer so as to be as small as possible, it is preferable to use a charge transport polymer for the CTL and/or to form an intermediate layer, which is hardly soluble in the solvent used for the protection layer coating liquid, between the CTL and the protection layer.

When the heating or irradiating energy is low in the crosslinking process, the coated layer is not completely crosslinked. In this case, the resultant layer becomes soluble in organic solvents. In contrast, when the energy is too high, uneven crosslinking is performed, resulting in increase of non-crosslinked parts or parts at which radical is terminated, or formation of aggregates of micro crosslinked materials. In this case, the resultant protection layer is soluble in organic solvents. In order to make a protection layer insoluble in organic solvents, the crosslinking conditions are preferably as follows:

Heat crosslinking conditions

Temperature: 100 to 170° C.

Heating time: 10 minutes to 3 hours

UV light crosslinking conditions

Illuminance intensity: 50 to 1000 mW/cm$^2$

Irradiation time: 5 seconds to 5 minutes

Temperature of coated material: 50° C. or less

In order to make a protection layer insoluble in organic solvents in a case where an acrylate monomer having three acryloyloxy group and a triarylamine compound having one acryloyloxy group are used for the protection layer coating liquid, the weight ratio (A/T) of the acrylate monomer (A) to the triarylamine compound (T) is preferably 7/3 to 3/7. The additive amount of a polymerization initiator is preferably from 3 to 20% by weight based on the total weight of the acrylate monomer (A) and the triarylamine compound (T). In addition, a proper solvent is preferably added to the coating liquid. Provided that the CTL, on which the protection layer coating liquid is coated, is formed of a triarylamine compound (serving as a CTM) and a polycarbonate resin (serving as a binder resin), and the protection layer coating liquid is coated by a spray coating method, the solvent of the protection layer coating liquid is preferably selected from tetrahydrofuran, 2-butanone, and ethyl acetate. The additive amount of the solvent is preferably from 300 to 1000 parts by weight per 100 parts by weight of the acrylate monomer (A).

After the protection layer coating liquid is prepared, the coating liquid is coated by a spray coating method on a peripheral surface of a drum, which includes, for example, an aluminum cylinder and an undercoat layer, a CGL and a CTL which are formed on the aluminum cylinder. Then the coated layer is naturally dried, followed by drying for a short period of time (from 1 to 10 minutes) at a relatively low temperature (from 25 to 80° C.). Then the dried layer is heated or exposed to UV light to be crosslinked.

When crosslinking is performed using UV light, metal halide lamps are preferably used. In this case, the illuminance intensity of UV light is preferably from 50 mW/cm$^2$ to 1000 mW/cm$^2$. Provided that plural UV lamps emitting UV light of 200 mW/cm$^2$ are used, it is preferable that plural lamps uniformly irradiate the coated layer with UV light along the peripheral surface of the coated drum for about 30 seconds. In this case, the temperature of the drum is controlled so as not to exceed 50° C.

When heat crosslinking is performed, the temperature is preferably from 100 to 170° C., and the heater is preferably an oven with an air blower. When the heating temperature is 115° C., the heating time is preferably from 20 minutes to 3 hours.

It is preferable that after the crosslinking operation, the thus prepared photoreceptor is heated for a time of from 10 minutes to 30 minutes at a temperature of from 100 to 150° C. to remove the solvent remaining in the protection layer. Thus, a photoreceptor (i.e., an image bearer) of the present invention is prepared.

In addition, protection layers in which an amorphous carbon layer or an amorphous SiC layer is formed by a vacuum thin film forming method such as sputtering can also be used for the photoreceptor for use in the present invention.

When a protection layer is formed as an outermost layer of the photoreceptor, there is a case where the discharging light hardly reaches the photosensitive layer if the protection layer greatly absorbs the discharging light, resulting in increase of residual potential and deterioration of the protection layer. Therefore, the protection layer preferably has a transmission of not less than 30%, more preferably not less than 50% and even more preferably not less than 85% against the discharging light.

As mentioned above, by using a charge transport polymer for the CTL and/or forming a protection layer as an outermost layer, the durability of the photoreceptor can be improved. In addition, when such a photoreceptor is used for the below-mentioned tandem type full color image forming apparatus, a new effect can be produced.

In the photoreceptor for use in the present invention, the following antioxidants can be added to the protection layer, CTL, CGL, charge blocking layer, anti-moiré layer, etc., to improve the stability to withstand environmental conditions (particularly, to avoid deterioration of sensitivity and increase of residual potential). Suitable antioxidants for use in the layers of the photoreceptor include the following compounds but are not limited thereto.

(a) Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocopherol compounds, etc.

(b) Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(c) Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(d) Organic Sulfur-containing Compounds

Dilauryl-3,3'-thiodipropionate, distearyl-3,3'-thiodipropionate, ditetradecyl-3,3'-thiodipropionate, etc.

(e) Organic Phosphorus-containing Compounds

Triphenylphosphine, tri(nonylphenyl)phosphine, tri(dinonylphenyl)phosphine, tricresylphosphine, tri(2,4-dibutylphenoxy)phosphine, etc.

These compounds have been used as antioxidants for rubbers, resins and oils and fats, and are commercially available. The content of the antioxidants in a layer is from 0.01 to 10% by weight based on the total weight of the layer.

When full color images are formed, color images of various patterns are produced. In this case, all the parts of the photoreceptor are subjected to image forming processes such as imagewise irradiating and developing. In contrast, there are original documents having a fixed color image (such as a stamp of approval). A stamp of approval is typically located on an edge part of a document, and the color thereof is limited. When such images are formed on a photoreceptor, a specific part of a photoreceptor is mainly used for image formation. In this case, the part is deteriorated faster than the other parts of the photoreceptor. If a photoreceptor having insufficient durability (i.e., insufficient physical, chemical and mechanical durability) is used therefor, an image problem tends to be caused. However, the photoreceptor for use in the present invention has good durability, and therefore such an image problem is hardly caused.

After the image bearer (i.e., the photoreceptor) is charged with a charger, a light irradiator irradiates the charged photoreceptor with imagewise light to form an electrostatic latent image on the photoreceptor, wherein the charger and the light irradiator serve as an electrostatic latent image former.

The electrostatic latent image former typically includes a charger configured to uniformly charge the photoreceptor and a light irradiator.

The charger for use in the image forming apparatus of the present invention is not particularly limited, and known chargers can be used. Specific examples thereof include, but are not limited to, contact chargers (e.g., conductive or semi-conductive rollers, brushes, films, and rubber blades); short-range chargers in which a charging member charges a photoreceptor with a gap on the order of 100 μm disclosed in Unexamined Published Japanese Patent Applications Nos. 2002-148904 and 2002-148905, etc.; non-contact chargers such as chargers utilizing corona discharging (e.g., corotrons and scorotrons); etc. The strength of the electric field formed on a photoreceptor by a charger is preferably from 20 to 60 V/μm and more preferably from 30 to 50 V/μm. The greater the electric field strength, the better dot reproducibility the resultant image has. However, when the electric field strength is too high, problems occur in that the photoreceptor causes dielectric breakdown and carrier particles are adhered to an electrostatic latent image.

The electric field strength (E) is represented by the following equation.

$$E(V/\mu m)=SV/G$$

wherein SV represents the potential (V) of a non-lighted part of a photoreceptor at a developing position; and G represents the thickness of the photosensitive layer of the photoreceptor, which includes at least a CGL and a CTL.

The image irradiation is performed by irradiating the charged photoreceptor with imagewise light using a light irradiator. Known light irradiators can be used and a proper light irradiator is chosen and used for the image forming apparatus for which the toner of the present invention is used. Specific examples thereof include, but are not limited to, optical systems for use in reading images in copiers; optical systems using rod lens arrays; optical systems using laser; and optical systems using a liquid crystal shutter. It is possible to irradiate the photoreceptor from the backside of the photoreceptor.

Specific examples of the light sources for use in the light irradiator include, but are not limited to, light emitting diodes (LEDs), laser diodes (LDs) and electroluminescence devices (ELs) Particularly, multibeam irradiators using plural laser beams, surface emitting lasers using three or more multibeam light sources, two-dimensional surface emitting lasers are preferably used, e.g., Multichannel Laser Diode Array (LDA) locating LDs in an array, disclosed in Japanese Patent No. 3227226 and surface emitting lasers two-dimensionally locating light emitting points, disclosed in Unexamined Published Japanese Patent Application No. 2004-287085 are very advantageously used.

The resolution of an electrostatic latent image (and a toner image) depends on the resolution of the image writing light. Namely, the higher the resolution of the image writing light, the better the resolution of the resultant electrostatic latent image. However, when the resolution of the image writing light is high, it takes a long time to write an image. When only one light source is used for image writing, the image processing speed (i.e., the speed of the image bearer) depends on the image writing speed. Therefore, when only one light source is used for image writing, the upper limit of the resolution is about 1,200 dpi (dots per inch) and preferably 2,400 dpi. When plural light sources (n pieces) are used, the upper limit of the resolution is 1,200 (or 2,400) dpi×n. Among these light sources, LEDs and LDs are preferably used.

The electrostatic latent image formed on the photoreceptor is developed with an image developer using a developer including a toner, and a toner image is formed on the photoreceptor. A negative-positive developing method is typically used. Therefore a toner having the same polarity as that of the charges formed on the photoreceptor is used. Both one-component developers including only a toner, and two-component developers including a toner and a carrier can be used for the image forming apparatus of the present invention.

In the present invention, it is essential that a time for a given point on the photoreceptor to pass from the irradiator to the image developer (irradiation-development time) is not greater than 50 msec.

The transferer transfers the toner image onto a receiving material. The transfer method is classified into a direct transfer method in which the toner image is directly transferred to a receiving material; and an indirect transfer method in which the toner image is transferred to an intermediate transfer medium (primary transfer) and then transferred to a receiving material (secondary transfer). Both the transfer methods can be used for the image forming apparatus of the present invention. When high resolution images are produced, the direct transfer method is preferably used.

When a toner image is transferred, the photoreceptor is typically charged with a transfer charger which is included in the transferer. The transferer is not limited thereto, and known transferers such as transfer belts and rollers can also be used.

Suitable transferers (primary and secondary transferers) of the image forming apparatus of the present invention include transferers which charge toner images so as to be easily transferred to a receiving material. Specific examples of the transferers include, but are not limited to, corona-charge transferers, transfer belts, transfer rollers, pressure transfer rollers, adhesion transferees, etc. The transferer may be one or more of these. The receiving material is not particularly limited, and known receiving materials such as papers and films can be used.

Suitable transfer chargers include, but are not limited to, transfer belt chargers and transfer roller chargers. In view of the amount of ozone generated, contact type transfer belt chargers and transfer roller chargers are preferably used. Both constant voltage type charging methods and constant current type charging methods can be used in the present invention, but constant current type charging methods are preferably used because constant transfer charges can be applied and thereby charging can be stably performed.

As mentioned above, the quantity of charges passing through the photoreceptor in one image formation cycle largely changes depending on the residual potential of the photoreceptor after the transfer process. Namely, the higher residual potential a photoreceptor has, the faster the photoreceptor deteriorates.

The charge quantity means the quantity of charges passing in the thickness direction of the photoreceptor. Specifically, the photoreceptor is (negatively) charged with a main charger so as to have a predetermined potential. Then imagewise light irradiation is performed on the charged photoreceptor. In this case, the lighted part of the photoreceptor generates photocarriers, and thereby the charges on the surface of the photoreceptor are decayed. In this case, a current corresponding to the quantity of the generated carriers flows in the thickness direction of the photoreceptor. In contrast, anon-lighted part of the photoreceptor is fed to the discharging position after the developing and transferring processes (and optionally a cleaning process). If the potential of the non-lighted part is near the potential thereof just after the charging process, charges whose quantity is almost the same as that of charges passing through the photoreceptor in the imagewise light irradiation process pass through the photoreceptor in the discharging process.

In general, images to be produced have a small image area, and therefore almost all charges pass through the photoreceptor in the discharging process in one image formation cycle. When the image area is 10%, 90% of the current flows in the discharging process.

The electrostatic properties of a photoreceptor are largely influenced by the charges passing through the photoreceptor if the materials constituting the photoreceptor are deteriorated by the charges. Specifically, the residual potential of the photoreceptor increases depending on the quantity of the charges passing through the photoreceptor. If the residual potential increases, a problem occurs in that the image density of the resultant toner image decreases when a nega-posi developing method is used. Therefore, in order to prolong the life of a photoreceptor, the quantity of charges passing through the photoreceptor has to be reduced.

There is a proposal that image forming is performed without performing a discharging process. In this case, it is impossible to uniformly charge all the parts of the photoreceptor (which results in formation of a ghost image) unless a high power charger is used.

In order to reduce the quantity of charges passing through a photoreceptor, it is preferable to discharge the charges on the photoreceptor without using light. Accordingly, it is effective to reduce the potential of a non-lighted part of the photoreceptor by controlling the transfer bias. Specifically, it is preferable to reduce the potential of a non-lighted part of the photoreceptor to about (−)100V (preferably 0V) before the discharging process. In this case, the quantity of charges passing through the photoreceptor can be reduced. It is more preferable to charge the photoreceptor so as to have a potential with a polarity opposite to that of charges formed on the photoreceptor in the main charging process because photocarriers are not generated in this case. However, in this case problems in that the toner image is scattered and the photoreceptor cannot be charged so as to have the predetermined potential unless a high power charger is used as the main charger occur. Therefore, the potential of the photoreceptor is preferably not greater than 100V after the transferring process.

When plural color images are transferred to form a multicolor (or full color) image, the fixing operation can be performed on each color image or on overlaid color images.

Known fixers can be used for the image forming apparatus of the present invention. Among the fixers, heat/pressure fixer including a combination of a heat roller and a pressure roller or a combination of a heat roller, a pressure roller and an endless belt are preferably used. The temperature of the heating member is preferably from 80 to 200° C. The fixer is not limited thereto, and known light fixers can also be used.

The discharger for use in the image forming apparatus of the present invention is not particularly limited, and known devices such as a fluorescent lamps, a tungsten lamp, a halogen lamp, a mercury lamps, a sodium lamp, and a xenon lamp, a LED, a LD and an EL can be used. An optical filter capable of selectively obtaining light having a desired wavelength, such as a sharp-cut filter, a bandpass filter, a near-infrared cutting filter, a dichroic filter, an interference filter and a color temperature converting filter can be used.

The image forming apparatus of the present invention can include a cleaner removing toner particles remaining on the surface of the photoreceptor even after the transfer process. The cleaner is not particularly limited, and known cleaners such as a magnetic brush cleaner, an electrostatic brush cleaner, a magnetic roller cleaner, a blade cleaner, a brush cleaner and a web cleaner can be used.

The image forming apparatus of the present invention can include a toner recycler feeding the toner particles collected by the cleaner to the image developer. The toner recycler is not particularly limited, and known powder feeders can be used therefor.

The image forming apparatus of the present invention can include a controller controlling the processes mentioned above.

Any known controllers such as sequencers and computers can be used therefor.

The image forming apparatus of the present invention will be explained referring to drawings.

Figure 9:
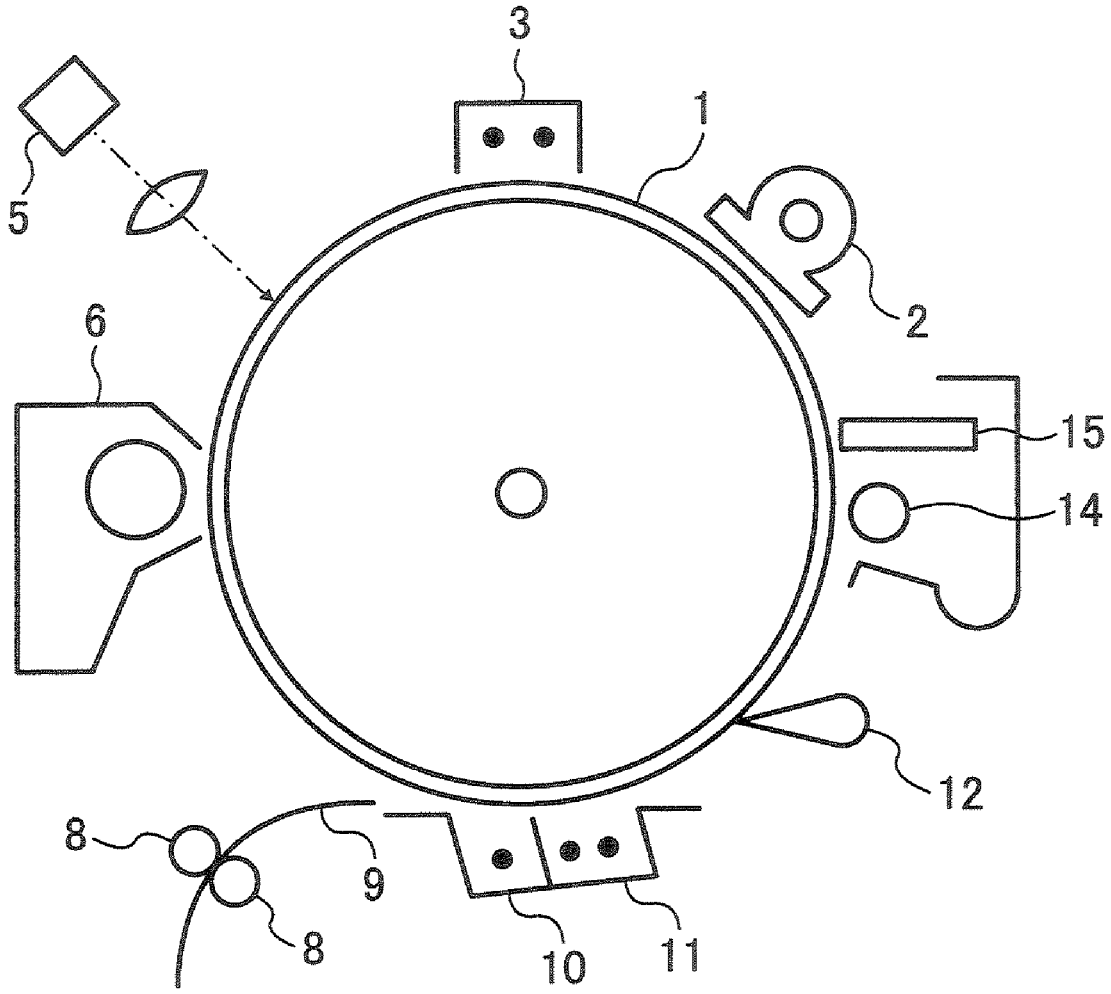
FIG. 9 is a schematic view for explaining the electrophotographic process and image forming apparatus of the present invention.

FIG. 9 is a schematic view illustrating an embodiment of the image forming apparatus. A photoreceptor 1 as an electrostatic latent image bearer includes a multilayer photosensitive layer including at least a CGL and a CTL on a substrate, wherein the transit time thereof is shorter than the irradiation-development timer of the image forming apparatus. Although the photoreceptor 1 has a drum-form, the shape is not limited thereto and sheet-form and endless belt-form photoreceptors can also be used. In addition, it is essential that a time for the surface of the photoreceptor right in front of an irradiator 5 to travel to a position right in front of an image developer 6 is not greater than 50 msec.

As the charger 3, wire chargers and roller chargers are preferably used. When high speed charging is needed, scorotron chargers are preferably used. Roller chargers are preferably used for compact image forming apparatuses and tandem type image forming apparatuses because the amount of acidic gases such as NOx and SOx and ozone generated by charging is small. The strength of the electric field formed on the photoreceptor by the charger is preferably not less than 20 V/μm. The greater the electric field strength, the better dot reproducibility the resultant image has. However, when the electric field strength is too high, problems in that the photoreceptor causes dielectric breakdown and carrier particles are adhered to an electrostatic latent image occur. Therefore, the electric field strength is preferably not greater than 60 V/μm and more preferably not greater than 50 V/μm.

Suitable light sources for use in the light irradiator 5 include, but are not limited to, light emitting diodes (LEDs), laser diodes (LDs) and electroluminescence devices (ELs) having high intensity light sources and emitting writing light having a wavelength shorter than 450 nm (a metal oxide in the intermediate layer does not absorb). The resolution of an electrostatic latent image (and a toner image) depends on the resolution of the image writing light. Namely, the higher the resolution of the image writing light, the better the resolution of the resultant electrostatic latent image. However, when the resolution of the image writing light is high, it takes a long time to write an image. When only one light source is used for image writing, the image processing speed (i.e., the speed of the image bearer) depends on the image writing speed. Therefore, when only one light source is used for image writing, the upper limit of the resolution is about 1,200 dpi (dots per inch). When plural light sources (n pieces) are used, the upper limit of the resolution is substantially 1,200 dpi×n. Among these light sources, LEDs and LDs are preferably used because of having high illuminance.

Particularly, the surface emitting laser is very advantageously used in the image forming apparatus using high-density writing because of being capable of writing many points at the same time.

The image developer 6 includes at least one developing sleeve. The image developer develops an electrostatic latent image formed on the photoreceptor with a developer including a toner, using a nega-posi developing method. The current digital image forming apparatus uses a nega-posi developing method in which a toner is adhered to a lighted part because the image area of original images is low and therefore it is preferable for the irradiator to irradiate the image part of a photoreceptor with light in view of the life of the light irradiator. With respect to the developer, both one-component developers including only a toner, and two-component developers including a toner and a carrier can be used for the image forming apparatus of the present invention.

With respect to the transfer charger 10, transfer belts and transfer rollers can also be used therefor. Particularly, contact transfer belts and transfer rollers are preferably used because the amount of ozone generated during the transferring process is small. Both constant voltage type charging methods and constant current type charging methods can be used in the present invention, but constant current type charging methods are preferably used because constant transfer charges can be applied and thereby charging can be stably performed. In the transferring process, it is preferable to control the current flowing in the photoreceptor through the transfer member in the transferring process when a voltage is applied from a power source to the transferee.

The transfer current is flown due to application of charges to remove the toner, which is electrostatically adhered to the photoreceptor, from the photoreceptor and transfer the toner to a receiving material. In order to prevent occurrence of a transfer problem in that a part of a toner image is not transferred, the transfer current is increased. However, when a nega-posi developing method is used, a voltage having a polarity opposite to that of the charge formed on the photoreceptor is applied in the transferring process, and thereby the photoreceptor suffers a serious electrostatic fatigue. In the transferring process, the higher the transfer current, the better the transfer efficiency of a toner image, but a discharging phenomenon occurs between the photoreceptor and the receiving material if the current is greater than a threshold, resulting in formation of scattered toner images. Therefore, the transfer current is preferably controlled so as not to exceed the threshold current. The threshold current changes depending on the factors such as distance between the photoreceptor and the receiving material, and materials constituting the photoreceptor and the receiving material, but is generally about 200 μA to prevent occurrence of a discharging phenomenon.

The transfer method is classified into a direct transfer method in which the toner image is directly transferred to a receiving material; and an indirect transfer method in which the toner image is transferred to an intermediate transfer medium (primary transfer) and then transferred to a receiving material (secondary transfer). Both the transfer methods can be used for the image forming apparatus of the present invention.

As mentioned above, it is preferable to control the transfer current to decrease the potential of an unirradiated part of the photoreceptor, which results in decrease of quantity of charges passing through the photoreceptor in one image forming cycle.

Suitable light sources for use in the discharger 2 include, but are not limited to, known light sources such as a fluorescent lamps, a tungsten lamp, a halogen lamp, a mercury lamps, a sodium lamp, and a xenon lamp, a LED, a LD and an EL, particularly emitting light having a wavelength a metal oxide included the intermediate layer does no absorb. An optical filter capable of selectively obtaining light having a desired wavelength, such as a sharp-cut filter, a band pass filter, a near-infrared cutting filter, a dichroic filter, an interference filters and a color temperature converting filter can be used.

In FIG. 9, numeral 8 is a registration roller, 11 is a separation charger and 12 is a separation pick.

A toner developed on the photoreceptor 1 by the image developer 6 is transferred on to transfer paper 9, however, the toner remaining thereon is removed by a fur brush 14 and a cleaning blade 15. The cleaning may be performed only by a cleaning brush. Known brushes such as a fur brush and a mag-fur brush can be used for the cleaning brush.

Figure 10:
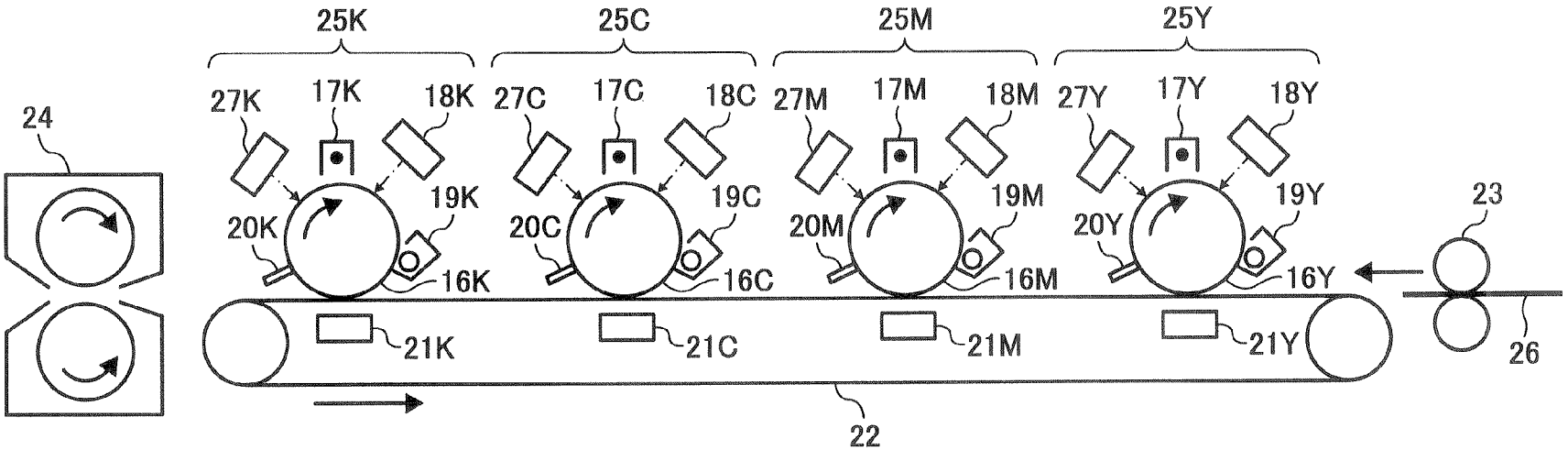
FIG. 10 is a schematic view for explaining the tandem full-color image forming apparatus of the present invention.

FIG. 10 is a schematic view illustrating another embodiment of the image forming apparatus (i.e., a tandem type image forming apparatus) of the present invention. In FIG. 10, each of drum-shaped photoreceptors 16Y, 16M, 16C and 16K includes a multilayer photosensitive layer including at least a CGL and a CTL on a substrate, wherein the transit time thereof is shorter than the irradiation-development timer of the image forming apparatus. In addition, it is essential that a time for each of the surfaces of the photoreceptors right in front of each of irradiators 18Y, 18M, 18C and 18K to travel to a position right in front of each of image developers 19Y, 19M, 19C and 19K is not greater than 50 msec.

Around the photoreceptors 16Y, 16M, 16C and 16K rotating in the direction indicated by respective arrows, chargers 17Y, 17M, 17C and 17K, light irradiators 18Y, 18M, 18C and 18K, image developers 19Y, 19M, 19C and 19K, cleaners 20Y, 20M, 20C and 20K and dischargers 27Y, 27M, 27C and 27K are arranged respectively in this order in the clockwise direction. As the chargers, the above-mentioned chargers which can uniformly charge the surfaces of the photoreceptors are preferably used. The light irradiators 18Y, 18M, 18C and 18K irradiate the surfaces of the respective photoreceptors with laser light beams at points between the chargers and the image developers to form electrostatic latent images on the respective photoreceptors. The four image forming units 25Y, 25M, 25C and 25K are arranged along a transfer belt 22. The transfer belt 22 contacts the respective photoreceptors 16 at image transfer points located between the respective image developers and the respective cleaners to receive color images formed on the photoreceptors. At the backsides of the image transfer points of the transfer belt 22, transfer brushes 21Y, 21M, 21C and 21K are arranged to apply a transfer bias to the transfer belt 22. The image forming units have substantially the same configuration except that the color of the toner is different from each other.

The image forming process will be explained referring to FIG. 10.

At first, in each of the image forming units 25Y, 25M, 25C and 25K, the photoreceptors 16Y, 16M, 16C and 16K rotating in the direction indicated by the arrows are charged with the chargers 17Y, 17M, 17C and 17K so as to have electric fields of from 20 to 60 V/μm, and preferably from 20 to 50 V/μm.

Then the light irradiators 18Y, 18M, 18C and 18K irradiate the photoreceptors 16Y, 16M, 16C and 16K with imagewise laser beams having a wavelength shorter than 450 nm, which is not absorbed in a metal oxide in the intermediate layer to form electrostatic latent images on each photoreceptor, which typically have a resolution of not less than 1,200 dpi (and preferably not less than 2,400 dpi).

Then the electrostatic latent image formed on the photoreceptor is developed with the image developers 19Y, 19M, 19C and 19K using a yellow, a magenta, a cyan or a black toner to form different color toner images on the respective photoreceptors. The thus prepared color toner images are transferred onto a receiving material 26, which has been fed to a pair of registration roller 23 from a paper tray and which is timely fed to the transfer belt 22 by the registration rollers 23. Each of the toner images on the photoreceptors is transferred onto the receiving material 26 at the contact point (i.e., the transfer position) of each of the photoreceptors 16Y, 16M, 16C and 16K and the receiving material 26.

The toner image on each photoreceptor is transferred onto the receiving material 26 due to an electric field which is formed due to the difference between the transfer bias voltage applied to the transfer members 21Y, 21M, 21C and 21K and the potential of the respective photoreceptors 16Y, 16M, 16C and 16K. After passing through the four transfer positions, the receiving material 26 having the color toner images thereon is then transported to a fixer 24 so that the color toner images are fixed to the receiving material 26. Then the receiving material 26 is discharged from the main body of the image forming apparatus.

Toner particles, which remain on the photoreceptors even after the transfer process, are collected by the respective cleaners 20Y, 20M, 20C and 20K.

Then the dischargers 27Y, 27M, 27C and 27K remove residual potentials from the respective photoreceptors 16Y, 16M, 16C and 16K such that the photoreceptors 16Y, 16M, 16C and 16K are ready for the next image forming operation.

In the image forming apparatus, the image forming units 25Y, 25M, 25C and 25K are arranged in this order in the paper feeding direction, but the order is not limited thereto. In addition, when a black color image is produced, the operation of the photoreceptors 16Y, 16M and 16C other than the photoreceptor 16K may be stopped.

As mentioned above, it is preferable for the photoreceptors 16 to have a potential of not higher than 100V (i.e., −100V when the photoreceptor is negatively charged by a main charger). More preferably, the photoreceptor is charged so as to have a potential of not lower than +100V in the transferring process when the photoreceptor is negatively charged by a main charger (i.e., 100V with a polarity opposite to that of the charge formed on the photoreceptor). In this case, occurrence of the residual potential increasing problem can be well prevented.

Figure 11:
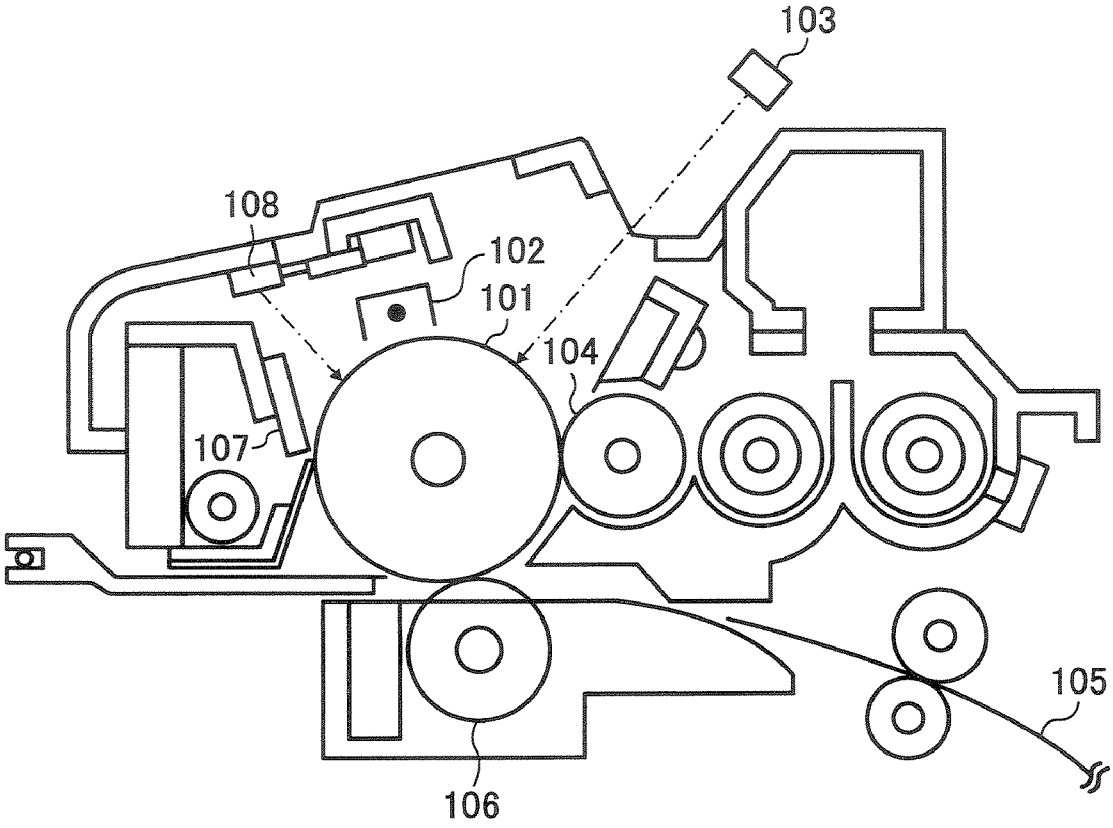
FIG. 11 is a schematic view for explaining the process cartridge for image forming apparatus of the present invention.

The above-mentioned image forming unit may fixedly be set in an image forming apparatus such as copiers, facsimiles and printers. However, the image forming unit may be set therein as a process cartridge. The process cartridge means an image forming unit which includes at least the photoreceptor mentioned above, and one or more of a charger, an irradiator, an image developer, a transferer, a cleaner and a discharger. FIG. 11 is a schematic view illustrating an embodiment of the process cartridge of the present invention. In FIG. 11, the process cartridge includes a photoreceptor 101 including a multilayer photosensitive layer including at least a CGL and a CTL on a substrate, wherein the transit time thereof is shorter than the irradiation-development timer of the image forming apparatus. In addition, it is essential that a time for the surface of the photoreceptor right in front of an irradiator 103 to travel to a position right in front of an image developer 104 is not greater than 50 msec.

In FIG. 11, 102 is a charger, 105 is a transfer body, 106 is a transferee, 107 is a cleaner and 108 is a discharger.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

First, methods of synthesizing the azo pigments and titanylphthalocyanine crystals for use in the present invention will be explained. The azo pigments are prepared according to the methods disclosed in Published Examined Japanese Patent Application No. 60-29109 and Japanese Patent No. 3026645. The titanylphthalocyanine crystals are prepared according to the methods disclosed in Published Unexamined Japanese Patent Application No. 2004-83859.

Synthesis of titanylphthalocyanine crystal

Synthesis Example 1

A titanylphthalocyanine crystal is prepared by the method disclosed in Synthesis Example 1 of Published Unexamined Japanese Patent Application No. 2001-19871. Specifically, at first 29.2 g of 1,3-diiminoisoindoline and 200 ml of sulfolane are mixed. Then 20.4 g of titanium tetrabutoxide is dropped into the mixture under a nitrogen gas flow. The mixture is then heated to 180° C. and a reaction is performed for 5 hours at a temperature of from 170 to 180° C. while agitating. After the reaction, the reaction product is cooled, followed by filtering. The thus prepared wet cake is washed with chloroform until the cake is colored blue. Then the cake is washed several times with methanol, followed by washing several times with hot water heated to 80° C. and drying. Thus, a crude titanylphthalocyanine is prepared. One part of the thus prepared crude titanylphthalocyanine is dropped into 20 parts of concentrated sulfuric acid to be dissolved therein. The solution is dropped into 100 parts of ice water while stirred, to precipitate a titanylphthalocyanine pigment. The pigment is obtained by filtering. The pigment is washed with ion-exchange water having a pH of 7.0 and a specific conductivity of 1.0 μS/cm until the filtrate becomes neutral. In this case, the pH and specific conductivity of the filtrate are 6.8 and 2.6 μS/cm. Thus, an aqueous paste of a titanylphthalocyanine pigment is obtained. Forty (40) grams of the thus prepared aqueous paste of the titanylphthalocyanine pigment, which has a solid content of 15% by weight, is added to 200 g of tetrahydrofuran (THF) and the mixture is stirred for about 4 hours. The weight ratio of the titanylphthalocyanine pigment to the crystal changing solvent (i.e., THF) is 1/33. Then the mixture is filtered and the wet cake is dried to prepare a titanylphthalocyanine powder (Pigment 1). The materials used therefor do not include a halogenated compound.

Figure 12:
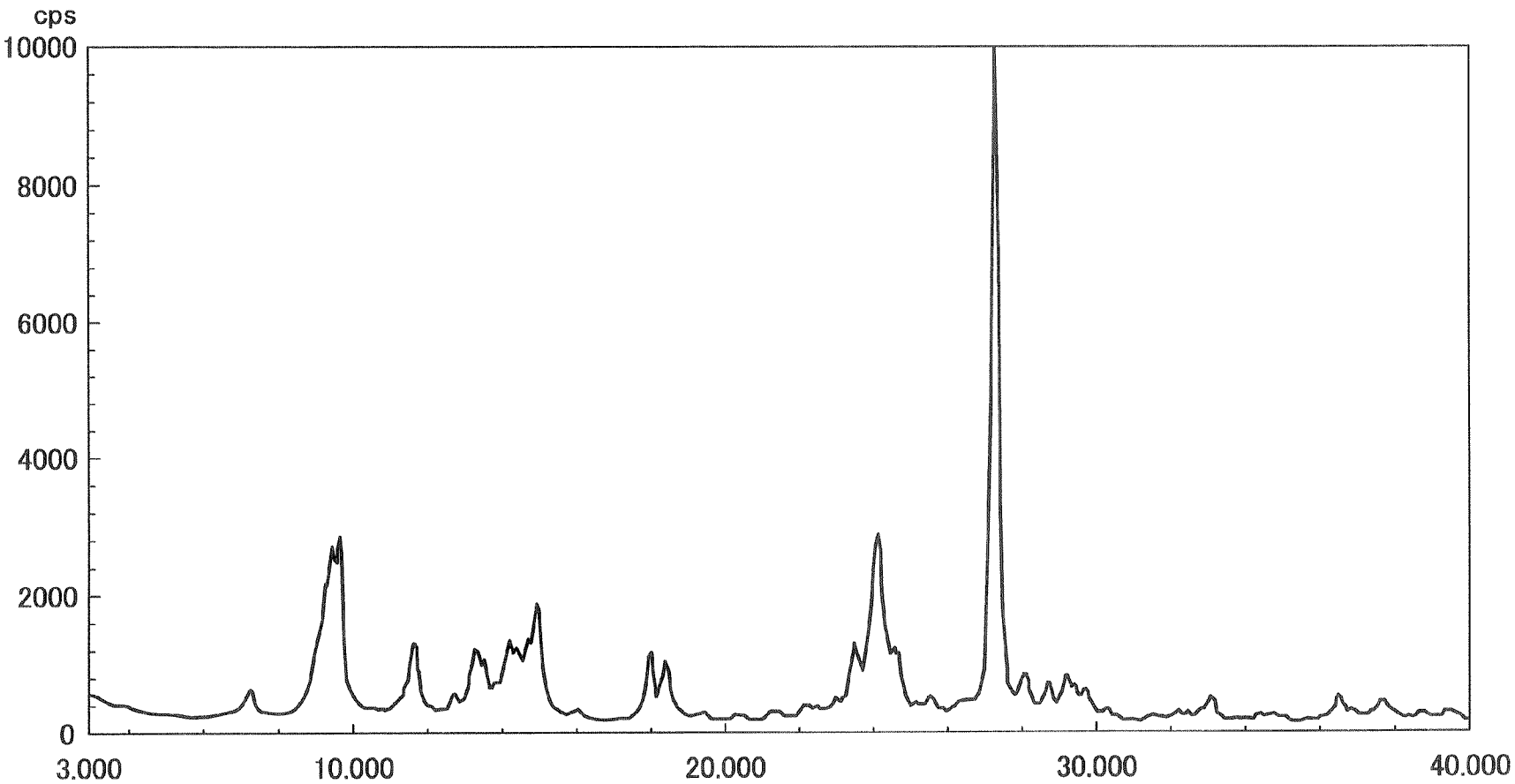
FIG. 12 is a X-ray diffraction spectrum of the titanylphthalocyanine crystal prepared in Synthesis Example 1.

When the thus prepared titanylphthalocyanine powder is subjected to the X-ray diffraction analysis using a marketed X-ray diffraction analyzer RINT 1100 from Rigaku Corp. under the following conditions, it is confirmed that the titanylphthalocyanine powder has an X-ray diffraction spectrum such that a maximum peak is observed at a Bragg (2θ) angle of 27.2±0.2°, a lowest angle peak at an angle of 7.3±0.2°, and a main peak at each of angles of 9.4±0.2°, 9.6±0.2°, and 24.0±0.2°, wherein no peak is observed between the peaks of 7.3° and 9.4° and at an angle of 26.3. The X-ray diffraction spectrum thereof is illustrated in FIG. 12.

Figure 13:
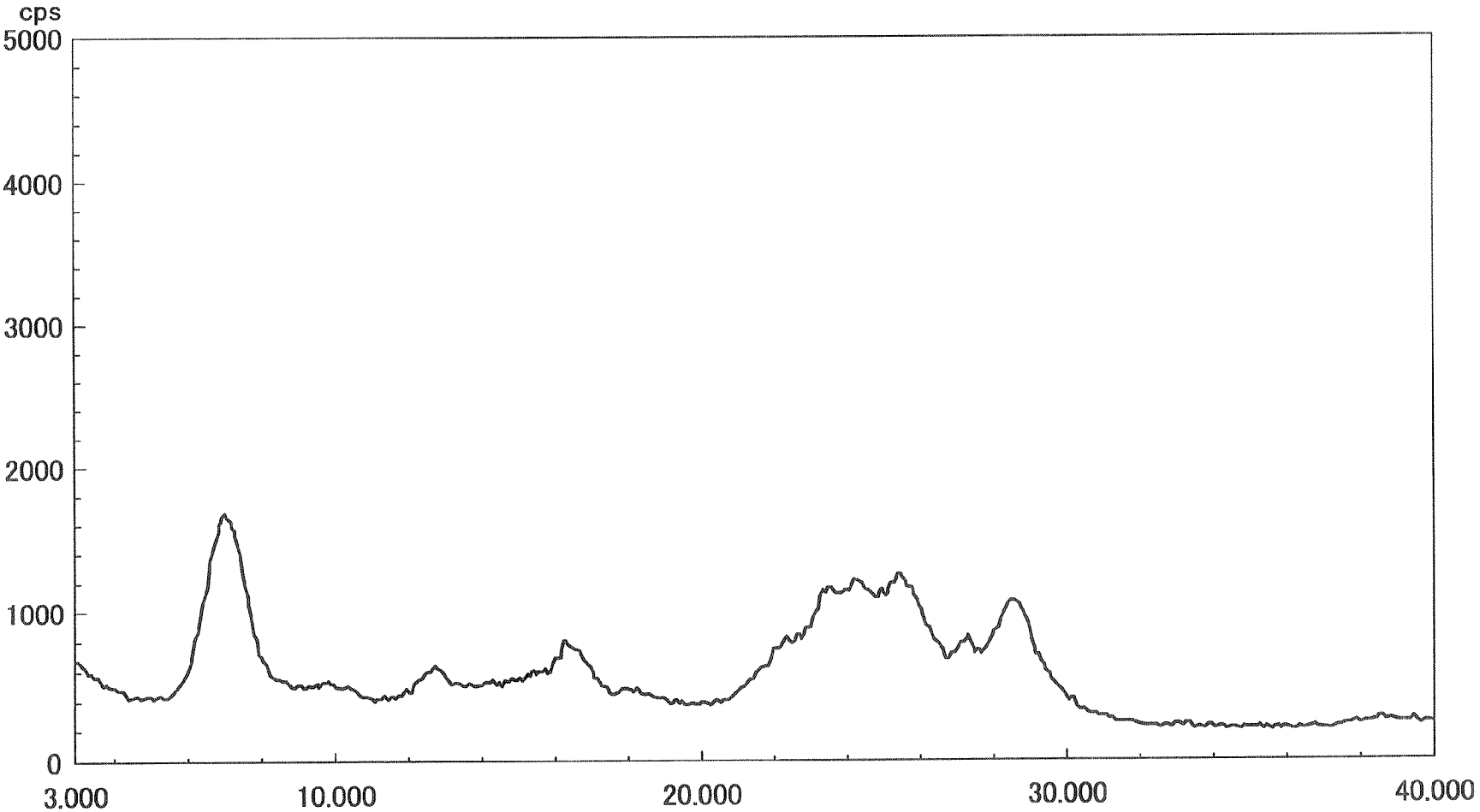
FIG. 13 is a X-ray diffraction spectrum of the titanylphthalocyanine pigment obtained by drying the wet paste prepared in Synthesis Example 1.

In addition, a part of the aqueous paste prepared above is dried at 80° C. for 2 days under a reduced pressure of 5 mmHg, to prepare a titanylphthalocyanine pigment, which has a low crystallinity. The X-ray diffraction spectrum of the titanylphthalocyanine pigment is illustrated in FIG. 13.

X-ray Diffraction Spectrum Measuring Conditions

X-ray tube: Cu

X-ray used: Cu—$K_\alpha$ having a wavelength of 1.542 Å

Voltage: 50 kV

Current: 30 mA

Scanning speed: 2°/min

Scanning range: 3° to 40°

Time constant: 2 seconds

A part of the aqueous paste of the titanylphthalocyanine pigment prepared above in Synthesis Example 1, which has not been subjected to a crystal change treatment, is diluted with ion-exchange water such that the resultant dispersion has a solid content of 1% by weight. The dispersion is placed on a 150-mesh copper net covered with a continuous collodion membrane and a conductive carbon layer. The titanylphthalocyanine pigment is observed with a transmission electron microscope (H-9000NAR from Hitachi Ltd. hereinafter referred to as a TEM) of 75,000 power magnification to measure the average particle size of the titanylphthalocyanine pigment. The average particle diameter thereof is determined as follows.

The image of particles of the titanylphthalocyanine pigment in the TEM is photographed. Among the particles (needle form particles) of the titanylphthalocyanine pigment in the photograph, 30 particles are randomly selected to measure the lengths of the particles in the long axis direction of the particles. The lengths are arithmetically averaged to determine the average particle diameter of the titanylphthalocyanine pigment. As a result, it is confirmed that the titanylphthalocyanine pigment in the aqueous paste prepared in Synthesis Example 5 has an average primary particle diameter of 0.06 μm.

The titanylphthalocyanine crystal prepared in Synthesis Example 1, which has been subjected to the crystal change treatment but is not filtered, is diluted with tetrahydrofuran such that the resultant dispersion has a solid content of 1% by weight. The average particle diameter of the crystal is measured by the method mentioned above. The form of the crystals is not uniform and includes triangle forms, quadrangular forms, etc., although the sizes of which are almost the same. Therefore, the maximum lengths of the diagonal lines of the particles are arithmetically averaged. As a result, the average particle diameter thereof is 0.12 μm.

Dispersion Preparation Example 1

A dispersion as a CGL coating liquid is prepared with the following formulation and conditions, using the titanylphthalocyanine pigment (pigment 1) prepared in Synthesis Example 1.

Formula of Dispersion

| | |
|---|---|
| Titanylphthalocyanine pigment (Pigment 1) | 15 |
| Polyvinyl butyral (BX-1 from Sekisui Chemical Co., Ltd.) | 10 |
| 2-butanone | 280 |

At first, the polyvinyl butyral resin is dissolved in 2-butanone. The solution is mixed with the titanylphthalocyanine crystal (Pigment 1) and the mixture is subjected to a dispersion treatment for 30 minutes using a marketed bead mill including PSZ balls having a diameter of 0.5 mm and rotating at a revolution of 1,200 rpm to prepare a dispersion 1.

Dispersion Preparation Example 2

A dispersion as a CGL coating liquid is prepared with the following formulation and conditions.

Formula of Dispersion

Azo pigment having the following formula 5

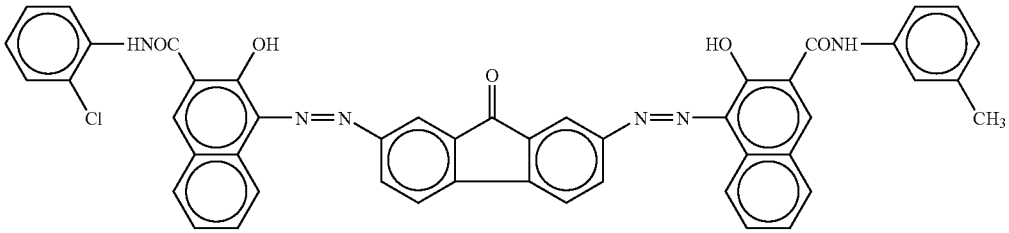

| | |
|---|---|
| Polyvinyl butyral (BX-1 from Sekisui Chemical Co., Ltd.) | 2 |
| Cyclohexanone | 250 |
| 2-butanone | 100 |

At first, the polyvinyl butyral resin is dissolved in the cyclohexanone and 2-butanone. The solution is mixed with the azopigment and the mixture is subjected to a dispersion treatment for 7 days using a ball mill which includes PSZ balls having a diameter of 10 mm and which is rotated at a revolution of 85 rpm to prepare a dispersion 2.

Dispersion Preparation Example 3

The procedure for preparation of dispersion 5 in Dispersion Preparation Example 2 is repeated to prepare a dispersion 3 except for replacing the azo pigment with an azo pigment having the following formula:

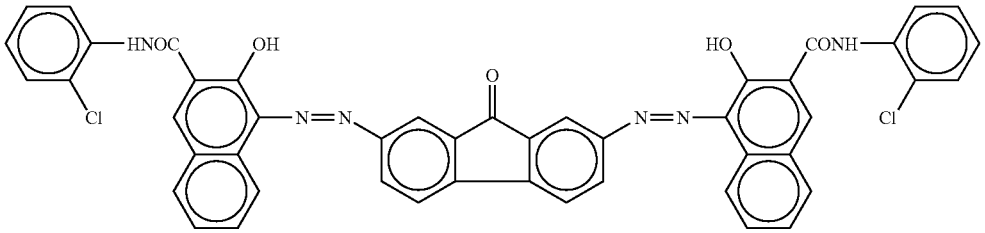

The particle diameter distributions of the pigments in the thus prepared dispersions 1 to 3 are measured with a particle diameter measuring instrument (CAPA-700 from Horiba, Ltd.). The results are shown in Table 1.

TABLE 1

| Dispersion | Average particle diameter (μm) | Standard deviation of particle diameter (μm) |
|---|---|---|
| Dispersion 1 | 0.19 | 0.13 |
| Dispersion 2 | 0.26 | 0.18 |
| Dispersion 3 | 0.27 | 0.17 |

Photoreceptor Preparation Example 1

On an aluminum drum of JIS 1050 having a diameter of 30 mm, the following intermediate layer coating liquid, CGL coating liquid, and CTL coating liquid are coated and dried in this order to prepare a multi-layered photoreceptor (photoreceptor 1) having an intermediate transfer layer having a thickness of 3.5 μm, a CGL having a thickness of 0.5 μm and a CTL having a thickness of 17 μm.

Formula of Intermediate Layer Coating Liquid

| | |
|---|---|
| Surface-untreated anatase-type titanium oxide (CR-EL from Ishihara Sangyo Kaisha Ltd., having an average particle diameter of 0.25 μm) | 112 |
| Alkyd resin (BEKKOLITEM6401-50-S from Dainippon Ink & Chemicals, Inc., solid content of 50%) | 33.6 |
| Melamine resin (SUPER BEKKAMIN G821-60 from Dainippon Ink & Chemicals, Inc., solid content of 60%) | 18.7 |
| 2-Butanone | 115 |

Formula of CGL Coating Liquid

Dispersion 1 is used.

Formula of CTL Coating Liquid

| | |
|---|---|
| Polycarbonate (TS2050 from Teijin Chemicals Ltd.) | 10 |
| CTM having the following formula: | 8 |

-continued

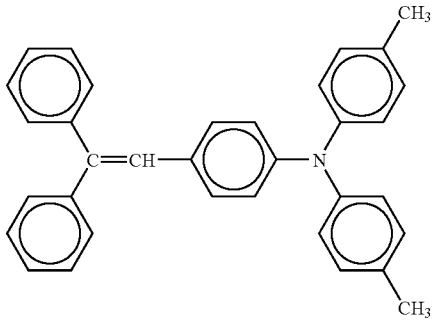

| | |
|---|---|
| Methylene chloride | 80 |

Photoreceptor Preparation Example 2

The procedure for preparation of the photoreceptor 1 in Photoreceptor Preparation Example 1 is repeated to prepare a photoreceptor 2 except for changing the thickness of the CTL to 27 μm.

Photoreceptor Preparation Example 3

The procedure for preparation of the photoreceptor 1 in Photoreceptor Preparation Example 1 is repeated to prepare a photoreceptor 3 except for changing the thickness of the CTL to 37 μm.

Photoreceptor Preparation Example 4

The procedure for preparation of the photoreceptor 1 in Photoreceptor Preparation Example 1 is repeated to prepare a photoreceptor 4 except for changing the thickness of the CTL to 15 μm and forming a protection layer having a thickness of 1 μm with a protection layer coating liquid having the following formula on the CTL.

Formula of Protection Layer Coating Liquid

| | |
|---|---|
| Polycarbonate (TS2050 from Teijin Chemicals Ltd.) | 10 |

-continued

| | |
|---|---|
| CTM having the following formula: | 10 |

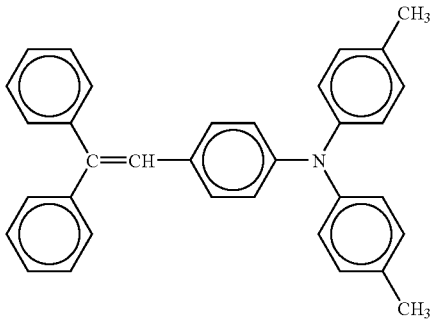

| | |
|---|---|
| α-alumina (SUMICORUNDUM AA-03 from Sumitomo Chemical Co., Ltd.) | 2 |
| Resistivity lowerer BYK-P105 from Byk Chemie) | 0.1 |
| Cyclohexanone | 160 |
| Tetrahydrofuran | 570 |

Photoreceptor Preparation Example 5

The procedure for preparation of the photoreceptor 4 in Photoreceptor Preparation Example 4 is repeated to prepare a photoreceptor 5 except for changing the thickness of the protection layer to 7 μm.

Photoreceptor Preparation Example 6

The procedure for preparation of the photoreceptor 1 in Photoreceptor Preparation Example 1 is repeated to prepare a photoreceptor 6 except for changing the thickness of the CTL to 15 μm and forming a protection layer having a thickness of 1 μm with a protection layer coating liquid having the following formula on the CTL.

Formula of Protection Layer Coating Liquid

| | |
|---|---|
| Tri- or more-functional radical polymerizable monomer having no charge transport structure (trimethylolpropane triacrylate, KAYARAD TMPTA fro Nippon Kayaku Co., Ltd., having a molecular weight (M) of 296, three functional groups (F) and ratio (M/F) of 99) | 10 |
| Monofunctional radical polymerizable monomer having a charge transport structure and the following formula: | 10 |

-continued

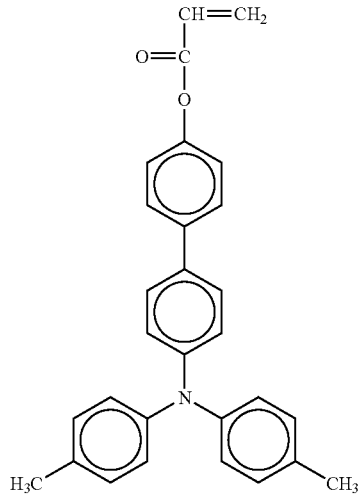

| | |
|---|---|
| Photopolymerization initiator (1-hydroxycyclohexyl-phenyl-ketone, IRGACURE 184 from Ciba Specialty Chemicals) | 1 |
| Tetrahydrofuran | 100 |

The protection layer coating liquid is coated by a spray coating method and the coated liquid is naturally dried for 20 minutes. Then the coated layer is irradiated with a metal halide lamp at power of 160 W/cm to be hardened. The hardening conditions are as follows.

Light intensity: 500 mW/cm$^2$

Irradiation time: 60 seconds

Photoreceptor Preparation Example 7

The procedure for preparation of the photoreceptor 6 in Photoreceptor Preparation Example 6 is repeated to prepare a photoreceptor 7 except for changing the thickness of the protection layer to 8 μm.

Photoreceptor Preparation Example 8

The procedure for preparation of the photoreceptor 1 in Photoreceptor Preparation Example 1 is repeated to prepare a photoreceptor 8 except for replacing the intermediate layer with a combination of a charge blocking layer with a thickness of 1.0 μm and an anti-moiré layer with a thickness of 3.5 μm located on the charge blocking layer, which are formed by coating the respective coating liquids having the following formulae, followed by drying.

Formula of Charge Blocking Layer Coating Liquid

| | |
|---|---|
| N-methoxymethylated nylon (FINE RESIN FR-101 from Namariichi Co., Ltd.) | 4 |
| Methanol | 70 |
| n-Butanol | 30 |

Formula of Anti-Moiré Layer Coating Liquid

| | |
|---|---|
| Surface-untreated anatase-type titanium oxide | 126 |

-continued

| | |
|---|---|
| (CR-EL from Ishihara Sangyo Kaisha Ltd., having an average particle diameter of 0.25 μm) | |
| Alkyd resin | 25.2 |
| (BEKKOLITE M6401-50-S from Dainippon Ink & Chemicals, Inc., solid content of 50%) | |
| Melamine resin | 14.0 |
| (SUPER BEKKAMIN G821-60 from Dainippon Ink & Chemicals, Inc., solid content of 60%) | |
| 2-Butanone | 150 |

The transit time of each of the photoreceptors 1 to 8 is measured as follows.

The surface potential of irradiated part thereof is measured using an apparatus disclosed in Published Unexamined Japanese Patent Application No. 2000-275872 under the following conditions.

Linear speed of the photoreceptor: 262 mm/sec

Resolution of sub-scanning direction: 400 dpi

Image surface stillness power: 0.3 mW (Light exposure: 0.4 $\mu J/cm^2$)

Writing wavelength: 780 nm

Discharger: On

Figure 3:
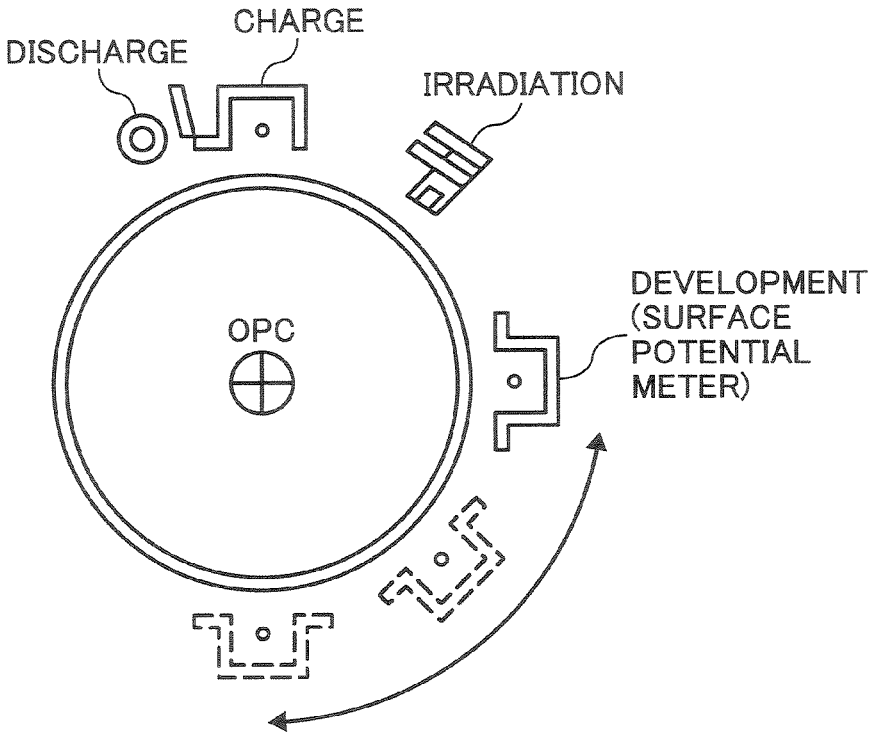
FIG. 3 is a schematic view showing a method of evaluating the light attenuation property.

Charging conditions: controlled such that the surface potential of the photoreceptor before irradiated is −800 V As shown in FIG. 3, the location of the surface potential meter set at the developing position is changed along the circumferential direction of the photoreceptor and 10 points thereon are measured for 20 to 155 msec as an irradiation-development time.

Figure 4:
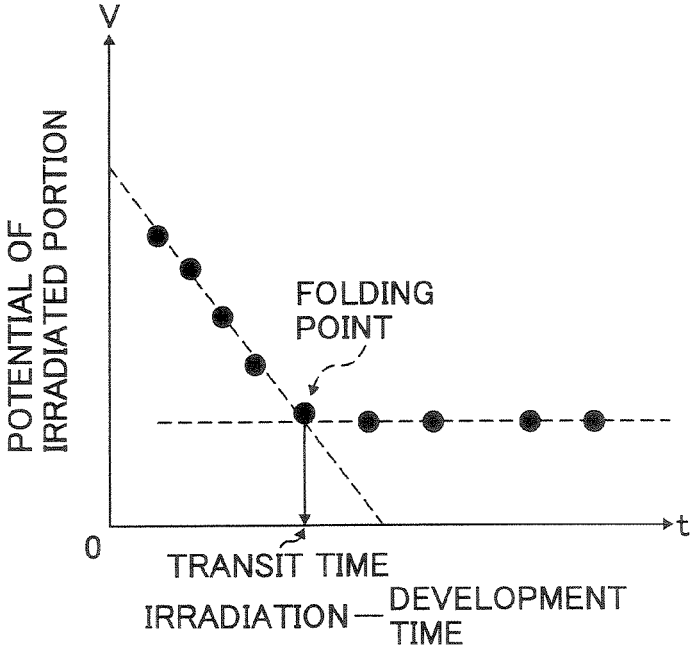
FIG. 4 is a graph showing a method for measuring a transit time.

The surface potentials of the 10 irradiated parts are plotted as FIG. 4 according to the irradiation-development time to determine a folding point and the transit time of each photoreceptor. The results are shown in Table 2.

TABLE 2

| Photoreceptor No. | Transit time (msec) |
|---|---|
| 1 | 42 |
| 2 | 47 |
| 3 | 55 |
| 4 | 44 |
| 5 | 60 |
| 6 | 46 |
| 7 | 65 |
| 8 | 43 |

Example 1

The photoreceptor 1 is installed in a single drum monochrome image forming apparatus as shown in FIG. 9. A roller charger located close to the photoreceptor with a gap of 50 μm, therebetween charges the photoreceptor, which a gap forming tape having a thickness of 50 μm is wound around such that only non-image forming areas at both ends of the photoreceptor and the roller charger contact each other. A four-channel LDA having 4 LDs having a wavelength of 780 nm in the shape of an array is used as an imagewise light source to irradiate the photoreceptor with imagewise light having a resolution of 1,200 dpi through a polygon mirror. A two-component developer including a toner having an average-particle diameter of 6.8 μm is used to develop an electrostatic latent image to form a toner image on the photoreceptor, a transfer belt is used to directly transfer the toner image onto a transfer paper, the photoreceptor is cleaned with a cleaning blade and discharged with light using a LED having a wavelength of 660 nm as a light source.

A straight line from the irradiation part of the imagewise light source (center of writing the photoreceptor) to the center of the photoreceptor and a straight line from the center of the developing sleeve thereto form an angle of 45. The linear speed of the photoreceptor is 240 mm/sec and the irradiation-development time is 49 msec.

The initial process conditions are as follows.

Potential of charged photoreceptor: −800 V (potential of unirradiated part)

Developing bias: −550 V (Negative-positive developing method)

Potential of irradiated part of the photoreceptor: −120 V (a solid image)

Evaluation Items (1) Surface Potential (SP)

The potential of irradiated part of each of the other photoreceptors 2 to 8 is measured as done with the photoreceptor 1. The results are shown in Tables 3-1 to 3-2.

(2) Background Fouling (BF)

A blank solid image is produced under an environmental condition of 22° C. and 50% RH and observed to determine whether the blank solid image has background fouling. The quality is classified into the following four grades.

◎: Excellent

O: Good

Δ: Poor

X: Very poor

The results are shown in Tables 3-1 to 3-2.

(3) Dot Reproducibility (DOT)

One (independent) dot image is produced and observed with an optical microscope whether the outline thereof is clear. The dot reproducibility of the photoreceptor is classified into the following four grades.

◎: Excellent

O: Good

Δ: Poor

X: Very poor

The results are shown in Tables 3-1 to 3-2.

After the above-mentioned evaluations (1) to (3) were finished, 10,000 images a chart having an image (letters) area of 6% are continuously produced. After 10,000 images are produced, the above-mentioned evaluations (1) to (3) are repeated.

(4) Abrasion Loss (AL)

The thickness of the photoreceptor before and after the evaluations (1) to (3) is measured to determine the thickness difference, i.e., the abrasion loss of the photoreceptor. The thickness of several points of the photoreceptor in the longitudinal direction thereof is measured at intervals of 1 cm except for both the edge portions having a width of 5 cm, and the thickness data are averaged. The results are shown in Tables 3-1 to 3-2.

Examples 2 to 5 and Comparative Examples 1 to 3

The procedures for evaluation of the photoreceptor 1 in Example 1 are repeated to evaluate the photoreceptors 2 to 8. The results are shown in Tables 3-1 to 3-2.

TABLE 3-1

| | Photoreceptor | Initial | | |
|---|---|---|---|---|
| | No. | SP (−V) | BF | DOT |
| Example 1 | 1 | 120 | ◎ | ◎ |
| Example 2 | 2 | 125 | ◎~O | ◎ |

TABLE 3-1-continued

| | Photoreceptor | Initial | | |
|---|---|---|---|---|
| | No. | SP (−V) | BF | DOT |
| Comparative Example 1 | 3 | 135 | ♯~♭ | ♯ |
| Example 3 | 4 | 120 | ♯~♭ | ♭ |
| Comparative Example 2 | 5 | 140 | ♯~♭ | ♯~Δ |
| Example 4 | 6 | 125 | ♯~♭ | ♭ |
| Comparative Example 3 | 7 | 145 | ♯~♭ | ♯~Δ |
| Example 5 | 8 | 120 | ♭ | ♭ |

TABLE 3-2

| | Photoreceptor | After 10,000 | | | AL |
|---|---|---|---|---|---|
| | No. | SP (−V) | BF | DOT | (μm) |
| Example 1 | 1 | 125 | ○~Δ | ◎ | 2.0 |
| Example 2 | 2 | 130 | ○ | ○ | 2.0 |
| Comparative Example 1 | 3 | 155 | ○~◎ | ○~Δ | 2.0 |
| Example 3 | 4 | 125 | ○~◎ | ○~◎ | 0.7 |
| Comparative Example 2 | 5 | 170 | ○~◎ | Δ | 0.7 |
| Example 4 | 6 | 130 | ○~◎ | ○~◎ | 0.3 |
| Comparative Example 3 | 7 | 185 | ○~◎ | Δ~X | 0.3 |
| Example 5 | 8 | 125 | ◎ | ○~◎ | 2.0 |

As Tables 3-1 and 3-2 show, when the transit time is shorter than the irradiation-development time (Examples 1 to 5), each of the photoreceptors 1, 2, 4, 6 and 8 have good light attenuation initially and even after repeated use. When the transit time is longer (Comparative Examples 1 to 3), the surface potential increases and noticeably after repeated use. Each of the photoreceptors 3, 5 and 7 (Comparative Examples 1 to 3) produce a black solid image the image density of which deteriorates.

In addition, when the transit time is shorter than the irradiation-development time (Examples 1 to 5), each of the photoreceptors 1, 2, 4, 6 and 8 have good dot reproducibility even after repeated use. Each of the photoreceptors 3, 5 and 7 (Comparative Examples 1 to 3) produce images the dot reproducibility of which deteriorates after repeated use.

Further, the photoreceptor 8 (Example 5) having a multilayer intermediate layer including a charge blocking layer and an anti-moiré layer has less background fouling even after repeated use.

The protection layer decreases the abrasion loss and background fouling after repeated use.

Example 6

The photoreceptor 1 is installed in a process cartridge as shown in FIG. 11, and which is installed in an image forming apparatus as shown in FIG. 10. A roller charger located close to the photoreceptor with a gap of 50 μm, therebetween charges the photoreceptor, which a gap forming tape having a thickness of 50 μm is wound around such that only non-image forming areas at both ends of the photoreceptor and the roller charger contact each other. A surface emitting laser as disclosed in Unexamined Published Japanese Patent Application No. 2004-287085, having 32 (8×4) laser beams having a wavelength of 780 nm in the shape of a two-dimensional array is used as an imagewise light source to irradiate the photoreceptor with image wise light having a resolution of 2,400 dpi. A two-component developer including a toner (yellow, magenta, cyan and black in each station) having an average-particle diameter of 6.2 μm is used to develop an electrostatic latent image to form a toner image on the photoreceptor, a transfer belt is used to directly transfer the toner image onto a transfer paper, the photoreceptor is cleaned with a cleaning blade and discharged with light using a LED having a wavelength of 655 nm as a light source.

A straight line from the irradiation part of the imagewise light source (center of writing the photoreceptor) to the center of the photoreceptor and a straight line from the center of the developing sleeve thereto form an angle of 45°. The linear speed of the photoreceptor is 240 mm/sec and the irradiation-development time is 49 msec.

The initial process conditions are as follows.

Potential of charged photoreceptor: −800 V (potential of unirradiated part)

Developing bias: −550 V (Negative-positive developing method)

Potential of irradiated part of the photoreceptor: −150 V (a solid image)

Evaluation Items (1) Surface Potential (SP)

The potential of irradiated part of each of the other photoreceptors 2 to 8 is measured as done with the photoreceptor 1 was except for locating a surface potential meter at the station developing a magenta image in FIG. 10. The results are shown in Tables 4-1 to 4-2.

(2) Color Reproducibility (CR)

A copy of an ISO/JIS-SCID N1 portrait image is produced to evaluate the color reproducibility of each of the photoreceptor, and which are classified to the following 4 grades.

◎: Very good

O: Good

Δ: Poor

X: Very poor

The evaluation results are shown in Tables 4-1 to 4-2.

(3) Residual Image (RI)

Figure 14:
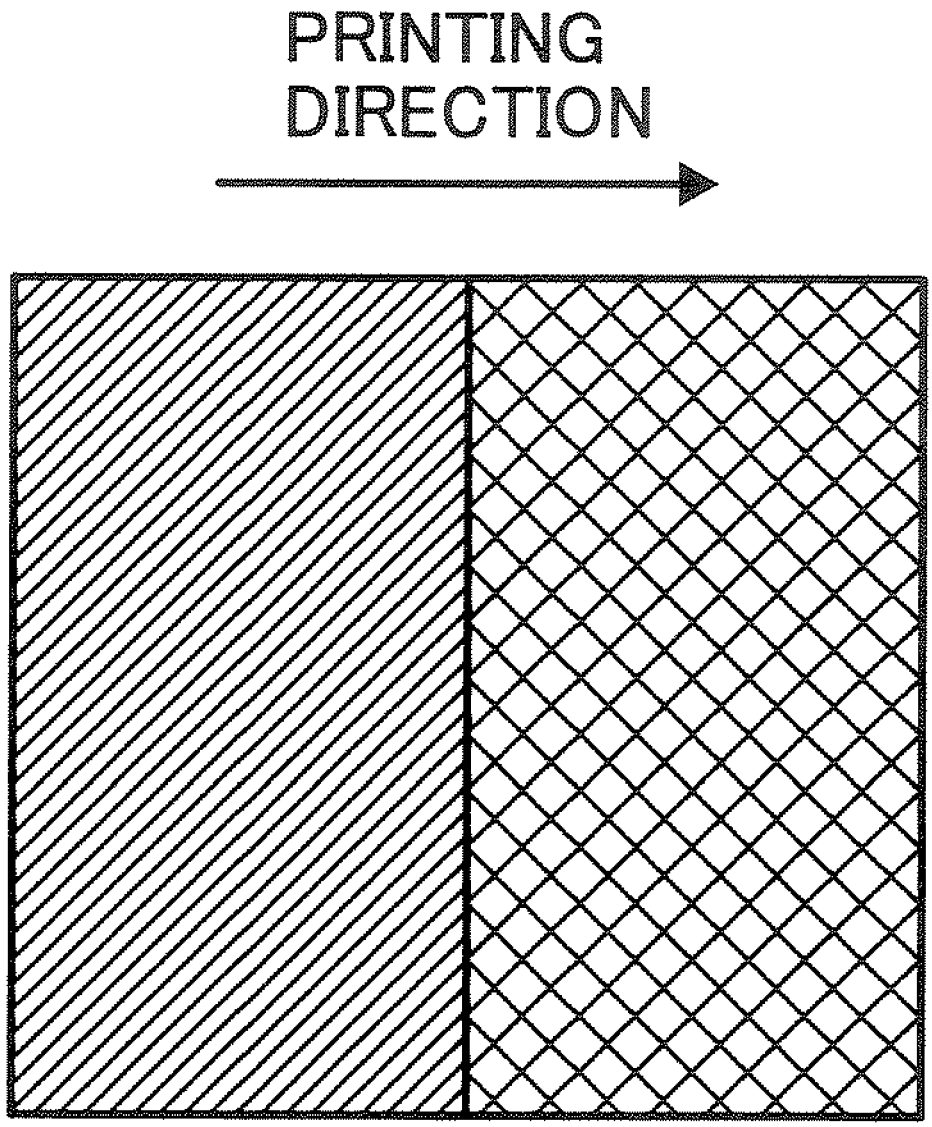
FIG. 14 is a test chart used in Example 6.

A monochrome (black) image of an A4 chart (first ⅖ hatching image and the other ⅗ halftone image) in FIG. 14 is produced. The resultant negative residual image (the hatching image is occasionally produced on the halftone image) is evaluated, which is classified to the following 4 grades.

◎: Very good

O: Good

Δ: Poor

X: Very poor

The evaluation results are shown in Tables 4-1 to 4-2.

After the above-mentioned evaluations (1) to (3) are finished, 10,000 images a full-color chart having an image (hatched line) area of 6% are continuously produced. After 10,000 images are produced, the above-mentioned evaluations (1) to (3) are repeated.

Examples 7 to 10 and Comparative Examples 4 to 6

The procedures for evaluation of the photoreceptor 1 in Example 6 are repeated to evaluate the photoreceptors 2 to 8. The results are shown in Tables 4-1 to 4-2.

TABLE 4-1

| | Photoreceptor | Initial | | |
|---|---|---|---|---|
| | No. | SP (−V) | CR | RI |
| Example 6 | 1 | 150 | ♭ | ♭ |
| Example 7 | 2 | 155 | ♭ | ♭ |
| Comparative Example 4 | 3 | 165 | ♯ | ♯ |
| Example 8 | 4 | 15 | ♭ | ♭ |
| Comparative Example 5 | 5 | 170 | ♯ | ♯~Δ |
| Example 9 | 6 | 155 | ♭ | ♭ |
| Comparative Example 6 | 7 | 175 | ♯ | ♯~Δ |
| Example 10 | 8 | 150 | ♭ | ♭ |

TABLE 4-2

| | Photoreceptor | After 10,000 | | |
|---|---|---|---|---|
| | No. | SP (−V) | CR | RI |
| Example 6 | 1 | 155 | ♯~♭ | ♭ |
| Example 7 | 2 | 160 | ♯ | ♯ |
| Comparative Example 4 | 3 | 185 | ♯~Δ | Δ |
| Example 8 | 4 | 155 | ♯~♭ | ♯~♭ |
| Comparative Example 5 | 5 | 200 | Δ~X | Δ~X |
| Example 9 | 6 | 160 | ♯~♭ | ♯~♭ |
| Comparative Example 6 | 7 | 215 | Δ~X | Δ~X |
| Example 10 | 8 | 155 | ♯ | ♯ |

As Tables 4-1 and 4-2 show, when the transit time is shorter than the irradiation-development time (Examples 6 to 10), each of the photoreceptors 1, 2, 4, 6 and 8 have good light attenuation initially and even after repeated use. When the transit time is longer (Comparative Examples 4 to 6), the surface potential increases and noticeably after repeated use.

In addition, when the transit time is shorter than the irradiation-development time (Examples 6 to 10), each of the photoreceptors 1, 2, 4, 6 and 8 have good color reproducibility even after repeated use. Each of the photoreceptors 3, 5 and 7 (Comparative Examples 4 to 6) produce images the color reproducibility of which deteriorates after repeated use.

Further, when the transit time is shorter than the irradiation-development time (Examples 6 to 10), each of the photoreceptors 1, 2, 4, 6 and 8 have good residual image resistance even after repeated use. Each of the photoreceptors 3, 5 and 7 (Comparative Examples 4 to 6) produce images the residual image resistance of which deteriorates after repeated use.

Photoreceptor Preparation Examples 9 to 16

The procedure for preparation of each of the photoreceptors 1 to 8 is repeated to prepare photoreceptors 9 to 16 except for replacing each of the CGL coating liquids with the dispersion 2.

Photoreceptor Preparation Example 17

The procedure for preparation of photoreceptor 1 is repeated to prepare photoreceptor 17 except for replacing the CGL coating liquid with the dispersion 3.

The transit time of each of the photoreceptors 9 to 17 is measured as follows.

The surface potential of irradiated part thereof is measured using an apparatus disclosed in Published Unexamined Japanese Patent Application No. 2000-275872 under the following conditions.

Linear speed of the photoreceptor: 262 mm/sec

Resolution of sub-scanning direction: 400 dpi

Image surface stillness power: 0.3 mW (Light exposure: 0.4 $\mu J/CM^2$)

Writing wavelength: 655 nm

Discharger: On

Charging conditions: controlled such that the surface potential of the photoreceptor before irradiated is −800 V As shown in FIG. 3, the location of the surface potential meter set at the developing position is changed along the circumferential direction of the photoreceptor and 10 points thereon are measured for 20 to 15S msec as an irradiation-development time.

The surface potentials of the 10 irradiated parts are plotted as FIG. 4 according to the irradiation-development time to determine a folding point and the transit time of each photoreceptor. The results are shown in Table 5.

TABLE 5

| Photoreceptor No. | Transit time (msec) |
|---|---|
| 9 | 43 |
| 10 | 48 |
| 11 | 57 |
| 12 | 45 |
| 13 | 62 |
| 14 | 47 |
| 15 | 67 |
| 16 | 44 |
| 17 | 44 |

Example 11

The photoreceptor 9 is installed in a single drum monochrome image forming apparatus as shown in FIG. 9. A roller charger located close to the photoreceptor with a gap of 50 μm, therebetween charges the photoreceptor, which a gap forming tape having a thickness of 50 μm is wound around such that only non-image forming areas at both ends of the photoreceptor and the roller charger contact each other. A four-channel LDA having 4 LDs having a wavelength of 780 nm in the shape of an array is used as an imagewise light source to irradiate the photoreceptor with imagewise light having a resolution of 1,200 dpi through a polygon mirror. A two-component developer including a toner having an average-particle diameter of 6.8 μm is used to develop an electrostatic latent image to form a toner image on the photoreceptor, a transfer belt is used to directly transfer the toner image onto a transfer paper, the photoreceptor is cleaned with a cleaning blade and d is charged with light using a LED having a wavelength of 660 nm as a light source.

A straight line from the irradiation part of the imagewise light source (center of writing the photoreceptor) to the center of the photoreceptor and a straight line from the center of the developing sleeve thereto form an angle of 45°. The linear speed of the photoreceptor is 240 mm/sec and the irradiation-development time is 49 msec.

The initial process conditions were as follows.

Potential of charged photoreceptor: −800 V (potential of unirradiated part)

Developing bias: −550 V (Negative-positive developing method)

Potential of irradiated part of the photoreceptor: −70 V (a solid image)

Evaluation Items (1) Surface Potential (SP)

The potential of irradiated part of each of the other photoreceptors 10 to 17 is measured as done with the photoreceptor 9. The results are shown in Tables 6-1 to 6-2.

(2) Background Fouling (EF)

A blank solid image is produced under an environmental condition of 22° C. and 50% RH and observed to determine whether the blank solid image has background fouling. The quality is classified into the following four grades.

◎: Excellent

O: Good

Δ: Poor

X: Very poor

The results are shown in Tables 6-1 to 6-2.

(3) Dot Reproducibility (DOT)

One (independent) dot image is produced and observed with an optical microscope whether the outline thereof is clear. The dot reproducibility of the photoreceptor is classified into the following four grades.

◎: Excellent

O: Good

Δ: Poor

X: Very poor

The results are shown in Tables 6-1 to 6-2.

After the above-mentioned evaluations (1) to (3) are finished, 10,000 images a chart having an image (letters) area of 6% are continuously produced. After 10,000 images are produced, the above-mentioned evaluations (1) to (3) are repeated.

Examples 12 to 16 and Comparative Examples 7 to 9

The procedures for evaluation of the photoreceptor 9 in Example 11 are repeated to evaluate the photoreceptors 10 to 17. The results are shown in Tables 6-1 to 6-2.

TABLE 6-1

| | Photoreceptor | After 10,000 | | |
|---|---|---|---|---|
| | No. | SP (−V) | BF | DOT |
| Example 11 | 9 | 75 | ♯~Δ | ♭ |
| Example 12 | 10 | 80 | ♯ | ♯ |
| Comparative Example 7 | 11 | 105 | ♯~♭ | ♯~Δ |
| Example 13 | 12 | 75 | ♯~♭ | ♯~♭ |
| Comparative Example 8 | 13 | 120 | ♯~♭ | Δ |
| Example 14 | 14 | 80 | ♯~♭ | ♯~♭ |
| Comparative Example 9 | 15 | 135 | ♯~♭ | Δ~X |
| Example 15 | 16 | 75 | ♭ | ♯~♭ |
| Example 16 | 17 | 90 | ♯~♭ | ♭ |

TABLE 6-2

| | Photoreceptor | Initial | | |
|---|---|---|---|---|
| | No. | SP (−V) | BF | DOT |
| Example 11 | 9 | 70 | ♯ | ♭ |
| Example 12 | 10 | 75 | ♯~♭ | ♭ |
| Comparative Example 7 | 11 | 85 | ♯~♭ | ♯ |
| Example 13 | 12 | 70 | ♯~♭ | ♭ |

TABLE 6-2-continued

| | Photoreceptor | Initial | | |
|---|---|---|---|---|
| | No. | SP (−V) | BF | DOT |
| Comparative Example 8 | 13 | 90 | ♯~♭ | ♯~Δ |
| Example 14 | 14 | 75 | ♯~♭ | ♭ |
| Comparative Example 9 | 15 | 95 | ♯~♭ | ♯~Δ |
| Example 15 | 16 | 70 | ♭ | ♭ |
| Example 16 | 17 | 85 | ♯~♭ | ♭ |

As Tables 6-1 and 6-2 show, when the transit time is shorter than the irradiation-development time (Examples 11 to 16), each of the photoreceptors 9, 10, 12, 14, 16 and 17 have good light attenuation initially and even after repeated use. When the transit time is longer (Comparative Examples 7 to 9), the surface potential increases and noticeably after repeated use. Each of the photoreceptors 11, 13 and 15 (Comparative Examples 7 to 9) produce a black solid image the image density of which deteriorates.

In addition, when the transit time is shorter than the irradiation-development time (Examples 11 to 16), each of the photoreceptors 9, 10, 12, 14, 16 and 17 have good dot reproducibility even after repeated use. Each of the photoreceptors 11, 13 and 15 (Comparative Examples 7 to 9) produce images the dot reproducibility of which deteriorates after repeated use.

Further, the photoreceptor 16 (Example 15) having a multilayer intermediate layer including a charge blocking layer and an anti-moiré layer has less background fouling even after repeated use.

The irradiated surface part potential of the photoreceptor 9 is lower than that of the photoreceptor 17 because an asymmetric azo pigment used in the photoreceptor 9 makes the photoreceptor 9 more sensitive.

This application claims priority and contains subject matter related to Japanese Patent Application No. 2006-137183 filed on May 17, 2006, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus, comprising:

an electrostatic latent image bearer;

a charger configured to charge the electrostatic latent image bearer;

an irradiator configured to irradiate the electrostatic latent image bearer with imagewise light having an image resolution not less than 1,200 dpi to form an electrostatic latent image thereon;

an image developer configured to develop the electrostatic latent image with a toner to form a toner image on the electrostatic latent image bearer;

a transferer configured to transfer the toner image onto a recording medium; and a fixer configured to fix the toner image on the recording medium, wherein a time for a given point on the electrostatic latent image bearer to travel from a position right in front of the irradiator to a position right in front of the image developer is shorter than 50 msec and longer than a transit time of the electrostatic latent image bearer.

2. The image forming apparatus of claim 1, further comprising a plurality of the electrostatic latent image bearers, the chargers, the irradiators and the image developers.

3. The image forming apparatus of claim 1, wherein the electrostatic latent image bearer comprises a cylindrical substrate having an outer diameter not greater than 40 mm.

4. The image forming apparatus of claim 1, wherein the irradiator is a multibeam irradiator comprising a plurality of laser beams.

5. The image forming apparatus of claim 4, wherein the multibeam irradiator comprises three or more surface emitting lasers.

6. The image forming apparatus of claim 5, wherein the three or more surface emitting lasers are two-dimensionally arrayed.

7. The image forming apparatus of claim 1, wherein the electrostatic latent image bearer comprises a photosensitive layer comprising:

a charge generation layer comprising an organic charge generation material; and a charge transport layer, wherein the organic charge generation material is an azo pigment having the following formula (I):

(I)

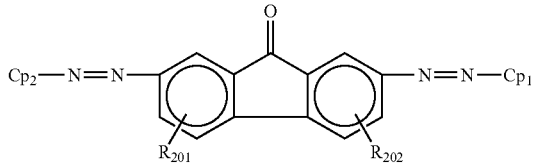

wherein $Cp_1$ and $Cp_2$ each, independently, represent a coupler residue and have the following formula (II):

(II)

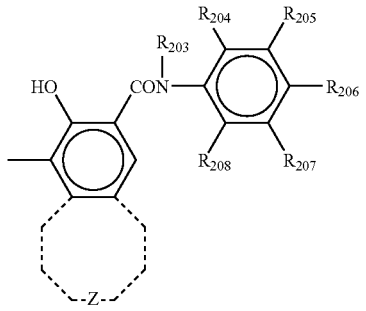

wherein $R_{203}$ represents a hydrogen atom, an alkyl group or an aryl group; $R_{204}$, $R_{205}$, $R_{206}$, $R_{207}$ and $R_{208}$ each, independently, represent a member selected from the group consisting of a hydrogen atom, a nitro group, a cyano group, a halogen atom, a halogenated alkyl group, an alkyl group, an alkoxy group, dialkylamino group and a hydroxyl group; Z represents atoms which are required to form a substituted or an unsubstituted aromatic carbon ring, or a substituted or an unsubstituted aromatic heterocycle; and $R_{200}$ and $R_{202}$ each, independently, represent a member selected from the group consisting of a hydrogen atom, a halogen atom, an alkyl group, an alkoxy group and a cyano group.

8. The image forming apparatus of claim 7, wherein the $Cp_1$ and $Cp_2$ are different from each other.

9. The image forming apparatus of claim 1, wherein the electrostatic latent image bearer comprises a photosensitive layer comprising:

a charge generation layer comprising an organic charge generation material; and a charge transport layer, wherein the organic charge generation material is a titanylphthalocyanine crystal having an X-ray diffraction spectrum such that a maximum peak is observed at least at a Bragg (2θ) angle (±0.2°) of 27.2°; or an X-ray diffraction spectrum such that a maximum peak is observed at a Bragg (2θ) angle of 27.2±0.2°, a main peak at each of Bragg (2θ) angles (±0.2°) of 9.4°, 9.6° and 24.0°, and a lowest angle peak at an angle of 7.3±0.2°, and wherein no peak is observed between the peaks of 7.3° and 9.4° and at an angle of 26.3 (±0.2°).

10. The image forming apparatus of claim 1, wherein the electrostatic latent image bearer comprises a protection layer on the photosensitive layer.

11. The image forming apparatus of claim 10, wherein the protection layer comprises an inorganic pigment having a specific resistivity not less than $10^{10}$ Ω·cm.

12. The image forming apparatus of claim 10, wherein the protection layer is formed by crosslinking a radical polymerizable tri- or more-functional monomer having no charge transport structure and a radical polymerizable monofunctional compound having a charge transport structure.

13. The image forming apparatus of claim 1, further comprising a process cartridge detachable from the image forming apparatus, comprising one or more of the electrostatic latent image bearer, the charger, the irradiator, the image developer, a discharger and a cleaner.

14. An image forming method, comprising:

charging an electrostatic latent image bearer;

irradiating the electrostatic latent image bearer with imagewise light having an image resolution not less than 1,200 dpi to form an electrostatic latent image thereon;

developing the electrostatic latent image with a toner to form a toner image on the electrostatic latent image bearer;

transferring the toner image onto a recording medium; and fixing the toner image on the recording medium, wherein a time for a given point on the electrostatic latent image bearer to travel from a position right in front of the irradiator to a position right in front of the image developer is shorter than 50 msec and longer than a transit time of the electrostatic latent image bearer.

15. The image forming method of claim 14, further comprising a plurality of charging steps, irradiating steps and developing steps.

16. The image forming method of claim 14, wherein the electrostatic latent image bearer comprises a cylindrical substrate having an outer diameter not greater than 40 mm.

17. The image forming apparatus of claim 14, wherein the irradiating is performed with a multibeam irradiator comprising a plurality of laser beams.

18. The image forming apparatus of claim 17, wherein the multibeam irradiator comprises three or more surface emitting lasers.

19. The image forming apparatus of claim 18, wherein the three or more surface emitting lasers are two-dimensionally arrayed.

* * * * *